United States Patent [19]

Kurematsu et al.

[11] Patent Number: 4,914,008

[45] Date of Patent: Apr. 3, 1990

[54] PROCESSING METHOD OF LIGHT-SENSITIVE SILVER HALIDE COLOR PHOTOGRAPHIC MATERIAL

[75] Inventors: Masayuki Kurematsu; Shigeharu Koboshi, both of Hino, Japan

[73] Assignee: Konishiroku Photo Industry Co., Ltd., Tokyo, Japan

[21] Appl. No.: 283,006

[22] Filed: Dec. 8, 1988

Related U.S. Application Data

[63] Continuation of Ser. No. 173,030, Mar. 22, 1988, abandoned, which is a continuation of Ser. No. 854,187, Apr. 21, 1986, abandoned.

[30] Foreign Application Priority Data

Apr. 25, 1985 [JP] Japan ..... 60-89997
May 16, 1985 [JP] Japan ..... 60-105217

[51] Int. Cl.[4] ..... G03C 7/40; G03C 7/34; G03C 5/39

[52] U.S. Cl. ..... 430/372; 430/393; 430/418; 430/430; 430/432; 430/460; 430/461; 430/552; 430/553; 430/558

[58] Field of Search ..... 430/372, 393, 430, 432, 430/552, 553, 558, 418, 460, 461

[56] References Cited

U.S. PATENT DOCUMENTS

| | | | |
|---|---|---|---|
| 3,591,380 | 7/1971 | Ohkubu et al. | 430/393 |
| 4,440,852 | 4/1984 | Onishi et al. | 430/522 |
| 4,500,630 | 2/1985 | Sato et al. | 430/387 |
| 4,525,451 | 6/1985 | Ohki et al. | 430/372 |
| 4,546,070 | 10/1985 | Kishimoto et al. | 430/393 |
| 4,567,134 | 1/1986 | Koboshi et al. | 430/372 |
| 4,587,195 | 5/1986 | Ishikawa et al. | 430/372 |
| 4,600,688 | 7/1986 | Kawakasu et al. | 430/558 |
| 4,601,975 | 7/1986 | Koboshi et al. | 430/393 |
| 4,717,647 | 1/1988 | Abe et al. | 430/393 |

FOREIGN PATENT DOCUMENTS

| | | |
|---|---|---|
| 0071402 | 2/1983 | European Pat. Off. . |
| 0159913 | 10/1985 | European Pat. Off. . |
| 0175311 | 3/1986 | European Pat. Off. . |
| 2165954 | 4/1985 | United Kingdom . |

*Primary Examiner*—Paul R. Michl
*Assistant Examiner*—Patrick A. Doody
*Attorney, Agent, or Firm*—Frishauf, Holtz, Goodman & Woodward

[57] ABSTRACT

There is disclosed a processing method of a light-sensitive silver halide color photographic material comprising, in a method of processing a light-sensitive silver halide color photographic material with a bleach-fixing solution after color developing, and successively with a stabilizing solution substituted for water washing, said bleach-fixing solution contains as main components an organic acid ferric complex salt with which a molecular weight of a free acid being not more than 280, a thiosulfate and a sulfite, and a processing time by said stabilizing solution substituted for water washing is 2 minutes or shorter.

14 Claims, No Drawings

PROCESSING METHOD OF LIGHT-SENSITIVE SILVER HALIDE COLOR PHOTOGRAPHIC MATERIAL

This application is a continuation, of application Ser. No. 173,030, filed Mar. 22, 1988 which is a continuation of Ser. No. 854,187 filed Apr. 21, 1986 both (abandoned).

BACKGROUND OF THE INVENTION

This invention relates to a processing method of a light-sensitive silver halide color photographic material (hereinafter abbreviated to as light-sensitive material), particularly to a processing method which processes with a processing solution substituted for washing using a small amount of water during a washing treatment which uses a large amount of water processed after a bleach-fixing processing.

In recent years, in a photofinisher which is carried out a development processing of a light-sensitive material automatically and continuously, problems of environmental preservation and water resources are granted as important and it has earnestly been desired to diminish or become zero a small amount of washing water used in a washing treatment successively processed after bleach-fixing processing.

Thus, methods in which an amount of washing water used with a large amount is diminished are provided and it has been known a method as a technique in which an amount of washing water is to be made small by constituting washing tanks to a multi-layered and by flowing water backward as described in West German Pat. No. 2,920,222 specification and S. R. Goldwasser, "Water flow rate in immersionwashing of motionpict ure film", Jour. SMPTE, 64, pp. 248 to 253, May (1955) as a technical literature. Further, a method in which washing treatment is abbrebiated and without carrying out washing substantially to carry out a stabilizing treatment (a treatment substituted for washing) as disclosed in Japanese Provisional Patent Publications No. 8543/1982, No. 14834/1983, No. 134636/1983 and the like.

A pre-bath of such a stabilizing treatment contains a thiosulfate, and a staying time of processing solutions used in these processing is extremely prolonged when the aforesaid pre-washing using a small amount of washing water or a multi-stage countercurrent washing using a small amount of washing water is carried out or when a processing substituted for water washing processed by supplementing a small amount of supplementing solution is carried out without carrying out a washing processing using large amount of washing water, after a bleach-fixing processing which solution contains the above thiosulfate. Accordingly, it exists a disadvantage that fine black precipitates will likely be generated in the processing solution during preservation or allowed to stand.

In order to eliminate such a disadvantage, as a method in which precipitation of sulfates during washing processing is to be prevented, there is known a technique of adding a polyalkyleneoxide series nonionic active agent in a washing tank as disclosed in U.S. Pat. No. 4,059,446. Further, a technique in which an isothiazoline or benzisothiazoline compound is added in a washing water is known as disclosed in Japanese Provisional Patent Publication No. 8542/1982.

However, prevention effects of the above techniques are insufficient and further a technique in which there is no problems concerning staying in the washing water and the stabilizing processing solution has been desired.

Further, when a supplementing amount of a processing substituted for the washing is more diminished or when a processing time is made short, there is a disadvantage that a concentration of a bleach-fixing component in the final tank of the stabilizing solution substituted for the washing is increased whereby a yellow stain at an unexposed portion of the light-sensitive material is increased due to a long period of preservation.

Moreover, there is a disadvantage that a contamination substance is remained at an unexposed portion just after the processing, and in such a case, if the light-sensitive material is a printing paper, contamination at a white portion becomes serious problems since the unexposed portion of the printing paper is a white ground. Further, it is always required by a user that the processing is carried out rapidly.

SUMMARY OF THE INVENTION

Accordingly, a first object of the present invention is to provide a processing method of a light-sensitive silver halide color photographic material, which can prevent black precipitates occured during preservation or with a lapse of time in a stabilizing solution substituted for a water washing.

A second object of the present invention is to provide a processing method of a light-sensitive silver halide color photographic material, which can prevent an increment of yellow stain of an unexposed portion of a light-sensitive material due to preservation for a long period of time even when a supplementing amount of a stabilizing solution substituted for a water washing is decreased.

A third object of the present invention is to provide a processing method of a light-sensitive silver halide color photographic material, which can prevent an occurence of the aforesaid white ground contamination at an unexposed portion.

A fourth object of the present invention is to provide a rapid processing method of a light-sensitive silver halide color photographic material.

The above objects are accomplished by a processing method of a light-sensitive silver halide color photographic material which comprises, in a method of processing a light-sensitive silver halide color photographic material with a bleach-fixing solution after color developing, and successively with a stabilizing solution substituted for a water washing, said bleach-fixing solution contains as main components an organic acid ferric complex salt with which a molecular weight of a free acid being not more than 280, a thiosulfate and a sulfite, and a processing time by said stabilizing solution substituted for a water washing is 2 minutes or shorter.

DESCRIPTION OF THE PREFERRED EMBODIMENTS

In the following, the present invention will be explained in more detail.

Heretofore, an organic ferric complex salt has been known as a bleaching agent employed for a bleach-fixing solution, and in the conventional bleach-fixing solution using a thiosulfate as a fixing agent and a sulfite as a preservative, ethylenediaminetetraacetic acid ferric salt has been used as the organic ferric salt. The reason why the ethylenediaminetetraacetic acid ferric salt is employed is because it is preferred in the points of desilvering characteristics, recoloration and preservability of the solution of the bleach-fixing solution.

Accordingly, a processing in which a washing processing which uses a large amount of water and is successively treated after a processing step due to a bleach-fixing solution has been replaced by a processing step due to a stabilizing solution substituted for a water washing processed with a small amount of an aqueous solution has been used as a next tank following to a processing step due to a bleach-fixing solution using ethylenediaminetetraacetic acid ferric salt as a bleaching agent. In such a system, it has occured problems that preservability with a lapse of time of the aforesaid stabilizing solution substituted for washing is bad, a yellow stain has occured at an unexposed portion of a light-sensitive material to be processed and a contamination at an unexposed white portion will likely be caused.

The present inventors have intensively studied concerning the above problems, and as a result, surprisingly, it has found that by using an organic ferric salt having a molecular weight of a free acid being not more than 280 as a bleaching agent of a bleach-fixing solution and by setting a processing time using a stabilizing solution substituted for washing for 2 minutes or less, the above technical tasks have been solved and has accomplished the present invention.

That is, effects of the present invention have obtained by the reason as stated below. It is considered that by using a bleaching agent of the present invention dissolution of a component which makes increase yellow stain generated by the storage has been accelarated, effusion of a contamination preventive agent for a white portion (for example, a fluorescent brightening agent) added at a procuding procedure or contained at a color developing step in a light-sensitive material eluted in a stabilizing solution substituted for washing, an improving agent for image preservation and the like is little since short time processing, and as a result, increase of yellow stain due to preservation at a lapse of time and contamination of an unexposed white portion have been prevented.

The effects are found to be particularly good markedly revealed when the organic acid ferric salt is a compound represented by the formula (I). In addition, compounds represented by the formulae (II) to (V) in the light-sensitive material is extremely preferred for prevention of yellow stain and contamination of white portion during long term storage.

As the organic acid ferric complex salt having a molecular weight of a free acid being not more than 280 to be used in the present invention, there may be mentioned an aminopolycarboxylic acid compound and a polyphosphonic acid compound as preferred ones, and of these compounds, the former is more preferred, and a compound represented by the formula (I) is particularly preferred.

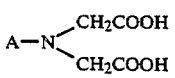

(I)

In the formula, A represents a hydrogen atom, an alkyl group having 1 to 4 carbon atoms, a hydroxyalkyl group having 1 to 4 carbon atoms or a carboxyalkyl group having 1 to 4 carbon atoms. Particularly preferred A is a methyl group, a hydroxyethyl group, a carboxymethyl group, a butyl group and a hydrogen atom.

In the polyphosphonic acid compound,

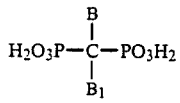

(where B and $B_1$ each represent a hydrogen atom, a hydroxy group, an alkyl group or an amino group) is included.

Representative examples of the above free acid are mentioned in the following, but the present invention is not limited by these (number of parentheses represents a molecular weight).

(1) Nitrilotriacetic acid (191.14)
(2) Nitrilodiacetic acid propionic acid (250.17)
(3) Iminodiacetic acid (133.10)
(4) Iminodimethylenephosphonic acid (204.98)
(5) N-methyliminodiacetic acid (147.063)
(6) Iminodipropionic acid (161.074)
(7) N-(3,3-dimethylbutyl)iminodiacetic acid (217.12)
(8) Hydroxyethyliminodipropionic acid (205.10)
(9) Hydroxypropyliminodiacetic acid (191.09)
(10) Methoxyethyliminodiacetic acid (191.09)
(11) N-(carbamoylmethyl)iminodiacetic acid (190.08)
(12) Aminoethyliminodiacetic acid (179.08)
(13) β-(N-trimethylammonium)ethyliminodiacetic acid cation (219.12)
(14) Phosphonomethyliminodiacetic acid (227.04)
(15) Phosphonoethyliminodiacetic acid (241.2)
(16) Sulfoethyliminodiacetic acid (241.14)
(17) Hydroxyethyliminodiacetic acid (177.16)
(18) Dihydroxyethylglicine (163.17)
(19) Nitrilotripropionic acid (233.22)
(20) Ethylenediaminediacetic acid (176.17)
(21) Carboxyethyliminodiacetic acid (205.08)
(22) N,N-ethylenediaminediacetic acid (172.08)
(23) N,N-di(hydroxyethyl)ethylenediaminediacetic acid (264.13)
(24) Ethylenediaminedipropionic acid (277.15)
(25) Hydroxyethylethylenediaminetriacetic acid (278.26)
(26) 1-Hydroxyethylidene-1,1-diphosphonic acid (205.97)
(27) Hydroxymethylidenediphosphonic acid (191.96)
(28) 1-Aminoethylidene-1,1-diphosphonic acid (203.98)
(29) 1-Aminopropylidene-1,1-diphosphonic acid (217.99), The organic acid ferric complex salts to be used in the present invention may be used singly or in a combination of two or more. Its concentration is required to select depending upon a silver amount of the light-sensitive material to be processed and a composition of a silver halide, etc., but is generally, in the range of $2\times10^{-2}$ to 2 moles per one liter of a used solution is preferred and more preferably in the range of $5\times10^{-2}$ to 1.0 mole.

The bleach-fixing solution of the present invention can also contained other compounds than the above organic acid ferric complex salt, for example, an organic acid ferric complex salt having a molecular weight of a free acid being 280 or more, but an amount of it is 50 mole % or less, preferably 10 mole % or less based on the total amount of the bleaching agent.

A thiosulfate to be contained in the bleach-fixing solution of the present invention is preferably an alkali metal salt and an ammonium salt, and there may be mentioned, for example, potassium thiosulfate, sodium thiosulfate, ammonium thiosulfate and the like. Its concentration is 5 g/liter or more to a range of capable of dissolving it and more preferably in the range of 70 to 250 g/liter.

In the present invention, as a sulfite to be contained in the bleach-fixing solution, there may be mentioned compounds such as sodium sulfite, potassium sulfite, ammonium sulfite, ammonium bisulfite, potassium bisulfite, sodium bisulfite, sodium metabisulfite, potassium metabisulfite, ammonium metabisulfite, hydrosulfite, sodium glutaraldehydebisbisulfite, sodium succinic aldehydebisbisulfite, etc. and any compounds which release a sulfite ion can be employed.

It is preferred that the above sulfite is contained in the bleach-fixing solution in an amount of $1\times10^{-3}$ to 0.1 mole/liter.

The phrase that the bleach-fixing solution of the present invention contains as main components the above organic acid ferric complex salt, the thiosulfate and the sulfite means that 50 mole % or more of the total amount of the bleaching agent included in said bleach-fixing solution is the aforesaid organic acid ferric complex salt, and additives conventionally used in the bleach-fixing solution other than the above three kinds of components may be added thereto. That is, in the bleach-fixing solution of the present invention, various pH buffers such as boric acid, borax, sodium hydroxide, potassium hydroxide, sodium carbonate, potassium carbonate, sodium bicarbonate, potassium bicarbonate, acetic acid, sodium acetate, ammonium hydroxide, etc. may be contained singly or in combination of two or more kinds. Furthermore, various kinds of fluorescent brightening agents, defoaming agents or surfactants may be contained therein. Further, preservatives such as hydroxylamine, hydrazine, bisulfite adducts of aldehyde compounds, etc.; organic chelating agents such as aminopolycarboxylic acids, etc.; stabilizers such as nitroalcohol, nitrate, etc.; or organic solvents such as methanol, dimethylsulfoamide, dimethylsulfoxide, etc. may optionally be contained. Moreover, various bleaching accelerators as disclosed in Japanese Provisional Patent Publication No. 280/1971; Japanese Patent Publications No. 8506/1970 and No. 556/1971; Belgian Pat. No. 770,910; Japanese Patent Publications No. 8836/1970 and No. 9854/1978; Japanese Provisional Patent Publications No. 71634/1979 and No. 42349/1974 may be added therein.

The pH of the bleach-fixing solution of the present invention may be used in the range of 4.0 or more, preferably pH 5.0 or more to pH 9.5 or less, more preferably pH 6.0 or more to pH 8.5 or less. The temperature of processing is 80° C. or less and it is used at a temperature of lower than 3° C. or more, preferably 5° C. or more than the processing temperature of a color developing tank, but desirably it is used at 55° C. or less to depress evaporation, etc.

In the present invention, processing with the bleach-fixing solution and successively with the stabilizing solution substituted for washing means that a linsing processing, processings of supplemental washing and of washing accelerating tank for an extremely short time due to single or plural tanks countercurrent system may be carried out so long as a concentration of the fixing solution or the bleach-fixing solution brought within a stabilizing processing foremost tank does not become 1/200 or less.

In the present invention, processing using a stabilizing solution in place of washing means for stabilization processing which is carried immediately after processing of bleach-fixing solution and with substantially no washing processing. The processing solution to be used in said stabilizing processing is called the stabilizing solution substituted for washing and the processing tank is called the stabilizing bath or the stabilizing tank.

In the present invention, the stabilizing processing can be used with one tank or plural number of tanks without problems, but preferably 1 to 4 tanks.

The present invention has great effect when the amount of the washing substituted solution added to the stabilizing bath is small, and said added amount is preferably in the range of 1 to 50-fold based on the amount carried from the pre-bath per unit area of the light-sensitive material to be processed and the effects of the present invention are marked in the range of 2 to 20-fold.

The stabilizing solution substituted for washing is supplemented when the light-sensitive material is processed with a small amount of water, and may be substantially water only, but various compounds can be added to it. As the preferably used compound in the present invention, there may be mentioned antimicrobial agents, ammonium salts, chelating agents and metal salts.

The antimicrobial agents to be preferably used in the stabilizing solution substituted for washing of the present invention may include hydroxybenzoic acid series compounds, phenol series compounds, thiazole series compounds, pyridine series compounds, guanizine series compounds, carbamate series compounds, morpholine series compounds, quaternary phosphonium series compounds, ammonium series compounds, urea series compounds, isoxazole series compounds, propanolamine series compounds, sulfamide derivatives and amino acid series compounds.

The aforesaid hydroxybenzoic acid series compounds may be mentioned a hydroxybenzoic acid and as an esterified compound of a hydroxybenzoic acid, a methyl ester, an ethyl ester, a propyl ester, a butyl ester, etc., preferably an n-butyl ester, an isobutyl ester and a propyl ester of a hydroxybenzoic acid, and more preferably a mixture of the aforesaid three kinds of hydroxybenzoic acid esters.

The phenol series compounds are compounds which have an aryl group or an alkyl group having 1 to 6 carbon atoms as substituents at the alkyl group portion of the compound and preferred example is orthophenylphenol, orthocyclohexylphenol, etc.

The thiazole series compounds are compounds which have nitrogen atom and sulfur atom in 5-membered ring, and preferably include 1,2-benzisothiazolin-3-one, 2-methyl-4-isothiazolin-3-one, 2-octyl-4-isothiazolin-3-one, 5-chloro-2-methyl-4-isothiazolin-3-one, 2-(4-thiazolyl)-benzimidazole, etc.

The pyridine series compounds may be specifically mentioned 2,6-dimethylpyridine, 2,4,6-trimethylpyridine, sodium-pyridinethiol-1-oxide, etc., and preferably sodium-pyridinethiol-1-oxide.

The guanizine series compounds may be specifically mentioned cyclohexizine, polyhexamethyleneguanizine hydrochloride, dodecylguanizine hydrochloride, etc., and preferably dodecylguanizine and its salts.

The carbamate series compounds may by specifically mentioned methyl-1-(butylcarbamoyl)-2-benzimidazolcarbamate, methylimidazolcarbamate, etc.

The morpholine series compounds may be specifically mentioned 4-(2-nitrobutyl)morpholine, 4-(3-nitrobutyl)morpholine, etc.

The quaternary phosphonium series compounds may include tetraalkylphosphonium salts, tetraalkoxyphosphonium salts, etc., and preferably tetraalkylphosphonium salt, and more specifically preferred compounds are tri-n-butyl-tetradecylphosphonium chloride, tri-phenyl!nitrophenylphosphonium chloride and the like.

The ammonium compounds may include benzalkonium salts, benzetonium salts, tetraalkylammonium salts, alkylpyridinium salts, etc., specifically dodecylmethylbenzylammonium chloride, didecyldimethylammonium chloride, laurylpyridinium chloride, etc.

The urea series compounds may specifically include N-(3,4-dichlorophenyl)-N'-(4-chlorophenyl)urea, N-(3-trifluoromethyl-4-chlorophenyl)-N'-(4-chlorophenyl-)urea, etc.

The isoxazole series compounds may specifically include 3-hydroxy-5-methyl-isoxazole, etc.

The propanolamine series compounds may include n-propanols and isopropanoles, more specifically DL-2-benzylamino-1-propanol, 3-diethylamino-1-propanol, 2-dimethylamino-2-methyl-1-propanol, 3-amino-1-propanol, isopropanolamine, diisopropanolamine, N,N-dimethyl-isopropanolamine, etc.

The sulfamide derivatives may specifically include fluorinated sulfamide, 4-chloro-3,5-dinitrobenzenesulfamide, sulfanylamide, acetsulfamine, sulfapyridine, sulfaguanidine, sulfathiazole, sulfadiazine, sulfamerazine, sulfamethazine, sulfaisoxazole, homosulfamine, sulfisomizine, sulfaguanidine, sulfamethizole, sulfapyradine, phthalisosulfathiazole, succinylsulfathiazole, etc.

The amino acid series compounds may specifically include N-lauryl-$\beta$-alanine, etc.

Of the above mentioned antimicrobial agents, compounds to be preferably used in the present invention are the thiazole series compounds, the pyridine series compounds, the guanidine series compounds, the quaternary ammonium series compounds. Further, particularly preferred is the thiazole series compounds.

An amount of the antimicrobial agent to be added to the processing solution substituted for washing is preferably in the range of 0.002 g to 50 g per liter of the washing substituted processing solution, more preferably in the range of 0.005 g to 10 g.

As a desired compound to be added to the stabilizing solution substituted for washing to be used in the present invention, there may be mentioned an ammonium compound.

These are provided from various ammonium salts of inorganic or organic compounds and may include ammonium hydroxide, ammonium bromide, ammonium carbonate, ammonium chloride, ammonium hypophosphite, ammonium phosphate, ammonium phosphite, fluorinated ammonium, acidic fluorinated ammonium, ammonium fluoroborate, ammonium arsenate, ammonium hydrogencarbonate, ammonium hydrogen fluoride, ammonium hydrogensulfate, ammonium sulfate, ammonium iodide, ammonium nitrate, ammonium pentaborate, ammonium acetate, ammonium adipate, ammonium laurintricarbonate, ammonium benzoate, ammonium carbamate, ammonium citrate, ammonium diethylthiocarbamate, ammonium formate, ammonium hydrogenmalate, ammonium hydrogenoxalate, ammonium hydrogenphthalate, ammonium hydrogentartarate, ammonium thiosulfate, ammonium sulfite, ammonium ethylenediaminetetraacetate, ammonium 1-hydroxyethylidene-1,1-diphosphonate, ammonium lactate, ammonium malate, ammonium maleate, ammonium oxalate, ammonium phthalate, ammonium picrate, ammonium pyrodindithiocarbamate, ammonium salicylate, ammonium succinate, ammonium sulfanylate, ammonium tartalate, ammonium thioglycolate, 2,4,6-trinitrophenol ammonium, etc. These may be used alone or in combination of two or more.

An amount of ammonium compounds to be formulated is in the range of 0.001 mole to 1.0 mole per liter of the stabilizing solution, preferably in the range of 0.002 mole to 0.2 mole.

In the present invention, the washing substituted processing solution may preferably include a chelating agent having a chelate stabilization constant to the iron ion of 8 or more.

In the above, the chelate stabilization constant means a constant well known in the art as disclosed in L. G. Sill'en, A. E. Martell, "Stability Constants of Metal-ion Complexes", The Chemical Society, London (1964); S. Chaberek, A. E. Martell, "Organic Sequestering Agents", Wiley (1959); etc.

In the present invention, the chelating agent having the chelate stabilization constant to iron ion of 8 or more may include organic carboxylic acid chelating agents, organic phosphoric acid chelating agents, inorganic phosphoric acid chelating agents, polyhydroxy compounds, etc. Incidentally, the above iron ion means ferric ion ($Fe^{3+}$).

In the present invention, exemplary compounds of chelating agents having the chelate stabilization constant to ferric ion of 8 or more may be mentioned the following compounds, but the present invention is not limited by these compounds. That is, ethylenediaminediorthohydroxyphenylacetic acid, diaminopropanetetraacetic acid, nitrilotriacetic acid, hydroxyethylethylenediaminetriacetic acid, dihydroxyethyl glycine, ethylenediaminediacetic acid, ethylenediaminedipropionic acid, iminodiacetic acid, diethylenetriaminepentaacetic acid, hydroxyethyliminodiacetic acid, diaminopropanoltetraacetic acid, transcyclohexanediaminetetraacetic acid, ethylenediaminetetraacetic acid, glycoletherdiaminetetraacetic acid, ethylenediaminetetrakismethylenephosphonic acid, nitrilotrimethylenephosphonic acid, 1-hydroxyethylidene-1,1-diphosphonic acid, 1,1-diphosphonoethane-2-carboxylic acid, 2-phosphonobutane-1,2,4-tricarboxylic acid, 1-hydroxy-1-phosphonopropane-1,2,3-tricarboxylic acid, catechol-3,5-disulfonic acid, sodium pyrophosphate, sodium tetrapolyphosphate, sodium hexametaphosphate, etc. Particularly preferred are compounds represented by the formula $A\text{-}PO_3M_2$ (wherein M represents a hydrogen atom, sodium atom, potassium atom or cation such as ammonium; and A represents an inorganic or organic compound), more specifically 2-phosphonobutane-1,2,4-tricarboxylic acid, 1,1-diphosphonoethane-2-carboxylic acid, pyrophosphoric acid, sodium tetrapolyphosphate, sodium hexametaphosphate, sodium polyphosphate, nitrilotrimethylenephosphonic acid, ethylenediaminetetraphosphonic acid, diethylenetriaminepentaphosphonic acid, 1-hydroxypropylidene1,1-diphosphonic acid, 1-aminoethylidene- 1,1-diphosphonic acid, 1-hydroxyethylidene-1,1-diphosphonic acid and salts of the above acids.

A used amount of the above chelating agent to be used in the present invention is 0.01 to 50 g per liter of the washing substituted processing solution, preferably in the range of 0.05 to 20 g to obtain good results.

The processing solution substituted for water washing in the present invention is preferred to contain a metal salt in combination with the above chelating agent. These metal salts may include a metal salt of Ba, Bi, Ca, Ce, Co, In, La, Mn, Ni, Pb, Sn, Zn, Ti, Zr, Mg, Al or Sr, and they may be provided as inorganic salts such as halides, hydroxides, sulfates, carbonates, phosphates, acetates, etc. or water soluble chelating agents. An amount thereof is in the range of $1\times10^{-4}$ to $1\times10^{-1}$ mole per liter of the stabilizing solution, preferably $4\times10^{-4}$ to $2\times10^{-2}$ mole, more preferably $8\times10^{-4}$ to $1\times10^{-2}$ mole.

In addition to the above, as the conventionally known additives for the stabilizing bath, there may be mentioned, for example, fluorescent brightening agents, surfactants, organic sulfur compounds, onium salts, formalin, hardeners such as chromium, etc., and various metal salts, and these additives may be used with any combinations in amounts necessary for maintaining a pH of the stabilizing bath of the present invention so long as affecting any bad influence to stability during preservation of a color photographic image and generation of precipitation.

The processing temperature of the stabilizing processing is within the range of 15° C. to 60° C., preferably 20° C. to 45° C.

The processing time is 2 minutes or less and in this range, generation of edge contamination has remarkably improved. More preferably, the processing time is 1 minute 30 seconds or less. On the other hand, the processing time is too short, an effect of stabilization is insufficient so that the processing time should desirably be 20 seconds or longer.

In case where a stabilizing processing due to plural numbers of tanks, it is preferred that the processing time is shorter in the former portion tanks and longer in the latter portion tanks. Particularly, it is desired that the processing time is successively processed with increased time of 20% to 50% than the previous tank. After the stabilizing processing of the present invention, no water washing processing is required but linsing with a little water washing, surface washing with a flashing solution containing formalin, surfactants, etc. within an extremely short time may optionally be carried out if necessary.

A supplementing method of the stabilizing solution substituted for water washing during the stabilizing processing step according to the present invention is preferably carried out by supplementing it in a latter bath and overflown from a former bath when a multilayer counter current system is employed.

The processing due to the stabilizing solution substituted for water washing according to the present invention is preferably carried out in the presence of compounds represented by the following formulae (II), (III), (IV) or (V):

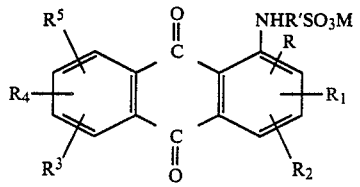

(II)

In the formula, R, $R_1$, $R_2$, $R_3$, $R_4$ and $R_5$ each represent a hydrogen atom, a halogen atom (e.g. a chlorine atom, a bromine atom, a fluorine atom), a hydroxy group, an alkyl group (preferably having 1 to 4 carbon atoms, for example, a methyl group, an ethyl group, a propyl group), an alkoxy group (preferably having 1 to 4 carbon atoms, for example, a methoxy group, an ethoxy group, a propoxy group), —$SO_3M$, or —NHR'$SO_3M$ group, where R' represents an alkylene group (e.g. a methylene group, an ethylene group); M represents a cation such as a hydrogen atom, an alkali metal atom (e.g. a sodium atom, a potassium atom), an ammonium, an organic ammonium salt (e.g. pyridinium, piperidinium, triethylammonium, triethanolamine, etc.).

Representative specific examples of the compound represented by the above formula (II) will be shown in the following, but the compound is not limited by these compounds.

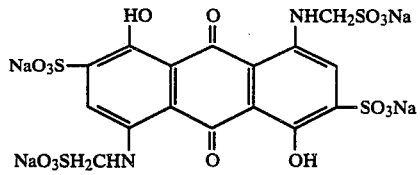

(A-1)

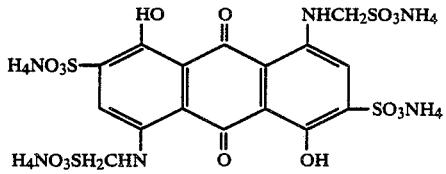

(A-2)

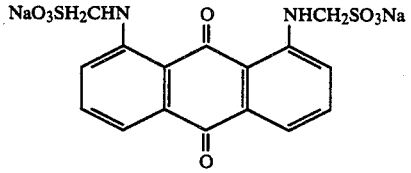

(A-3)

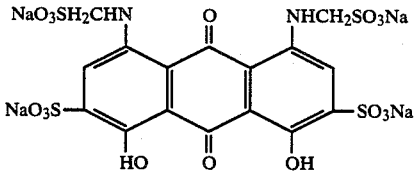

(A-4)

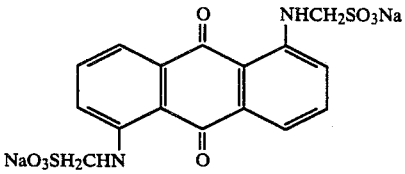

(A-5)

-continued

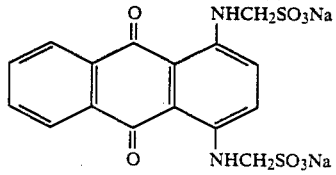

(A-6)

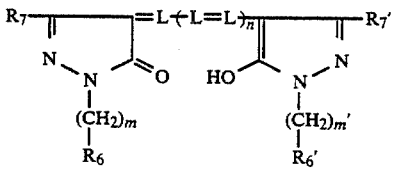

(III)

In the formula, $R_6$ and $R_6'$ each represent a hydrogen atom or an alkyl group, an aryl group or a heterocyclic group each of which may be substituted, and the alkyl group may be any of straight, branched or cyclic, preferably having 1 to 4 carbon atoms such as an ethyl group, a β-sulfoethyl group, etc.

The above aryl group may be mentioned, for example, a phenyl group, a naphthyl group, etc., and they may have a substituent such as a sulfo group (which may be bonded to an aryl group through a divalent organic group such as a phenyleneoxy group, an alkylene group, an alkyleneamino group, an alkyleneoxy group, etc.), a carboxy group, an alkyl group having 1 to 5 carbon atoms (e.g. a methyl group, an ethyl group), a halogen atom (e.g. a chlorine atom, a bromine atom, etc.), an alkoxy group having 1 to 5 carbon atoms (e.g. a methoxy group, an ethoxy group, etc.), a phenoxy group and the like, and there may be mentioned, for example, a 4-sulfophenyl group, a 4-(β-sulfobutyl)phenyl group, a 3-sulfophenyl group, a 2,5-disulfophenyl group, a 3,5-disulfophenyl group, a 6,8-disulfo-2-naphthyl group, a 4,8-disulfo-2-naphthyl group, a 3,5-dicarboxyphenyl group, a 4-carboxyphenyl group, a 4-(4-sulfophenoxy)phenyl group, a 4-(2-sulfoethyl)phenyl group, a 3-(sulfomethylamino)phenyl group, a 4-(2-sulfoethoxy)phenyl group, etc.

As the above heterocyclic group, there may be mentioned, for example, a 2-(6-sulfo)benzthiazolyl group, a 2-(6-sulfo)benzoxazolyl group, etc., and they may have a substituent such as a halogen atom (e.g. a fluorine atom, a chlorine atom, a bromine atom, etc.), an alkyl group (e.g. a methyl group, an ethyl group, etc.), an aryl group (e.g. a phenyl group, etc.), a carboxy group, a sulfo group, a hydroxy group, an alkoxy group (e.g. a methoxy group, etc.), an aryloxy group (e.g. a phenoxy group, etc.) and the like.

$R_7$ and $R_7'$ each represent a hydroxy group, an alkoxy group (preferably having 1 to 4 carbon atoms such as a methoxy group, an ethoxy group, an isopropoxy group, an n-butoxy group), a substituted alkoxy group such as an alkoxy group having 1 to 4 carbon atoms substituted by a halogen atom or an alkoxy group having up to 2 carbon atoms (e.g. a β-chloroethoxy group, a β-methoxyethoxy group), a cyano group, a trifluoromethyl group, $—COOR_8$, $—CONHR_8$, $—NHCOR_8$ [where $R_8$ represents a hydrogen atom, analkyl group having 1 to 4 carbon atoms, or an aryl group such as a phenyl group, a naphthyl group, and said alkyl group and aryl group may have a sulfo group or a carboxy group as a substituent], a ureido group, an imino group, an amino group, a substituted amino group substituted by an alkyl group having 1 to 4 carbon atoms (e.g. an ethylamino group, a dimethylamino group, a diethylamino group, a di-n-butylamino group), or a cyclic amino group (e.g. a morpholino group, a piperidino group, a piperazino group) represented by

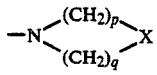

(where p and q each represent integers of 1 or 2; and X represents an oxygen atom, a sulfur atom, or a $—CH_2—$ group).

A methine group represented by L may be substituted by an alkyl group having 1 to 4 carbon atoms (e.g. a methyl group, an ethyl group, an isopropyl group, a tertiary butyl group, etc.) or an aryl group (e.g. a phenyl group, a tolyl group, etc.).

Further, at least one of a sulfo group, a sulfoalkyl group and a carboxy group which are substituted for the above heterocyclic group may form a salt with an alkali metal (e.g. sodium, potassium), an alkaline earth metal (e.g. calcium, magnesium), ammonia or an organic base (e.g. diethylamine, triethylamine, morpholine, pyridine, piperidine, etc.). n represents 0, 1 or 2, and m and m' each represent 0 or 1.

Next, representative specific examples of the compound represented by the above formula (III) are shown, but the present invention is not limited by these compounds.

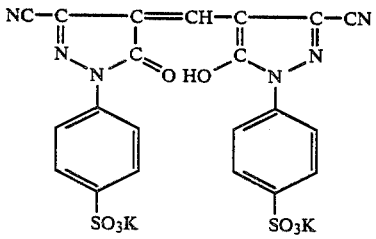

(B-1)

-continued
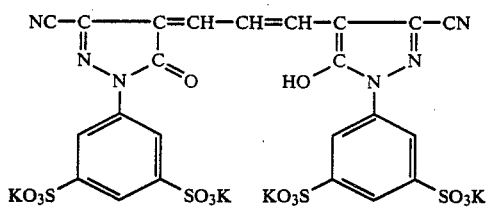
(B-2)
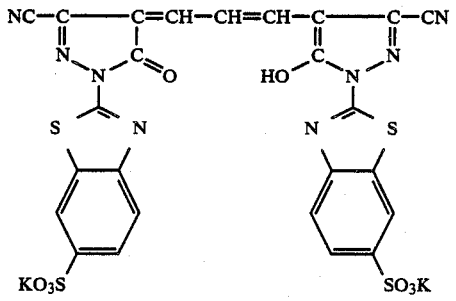
(B-3)
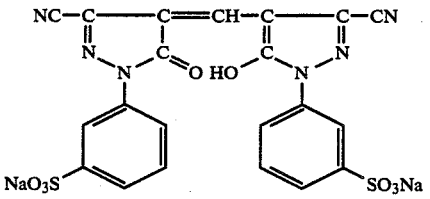
(B-4)
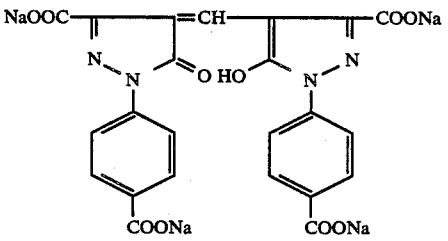
(B-5)
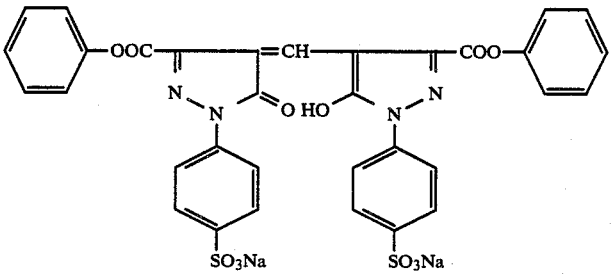
(B-6)
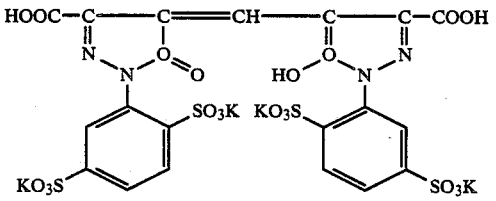
(B-7)

-continued
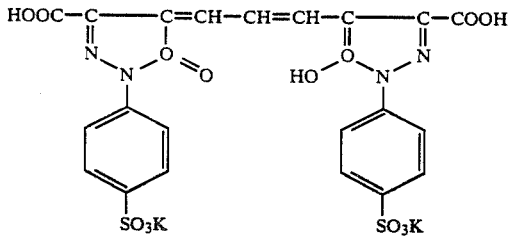
(B-8)
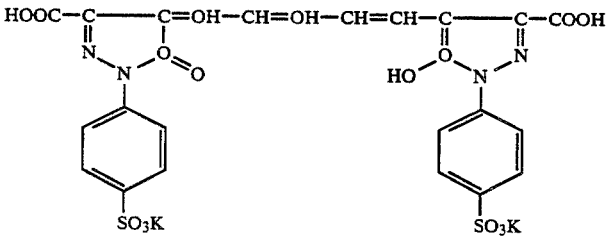
(B-9)
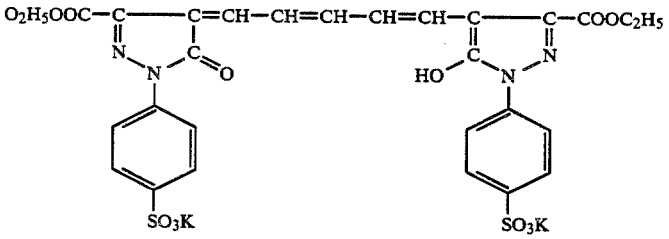
(B-10)
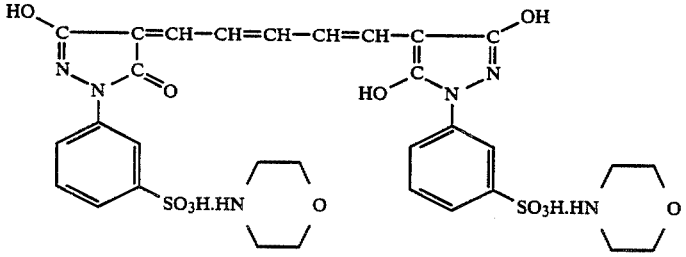
(B-11)
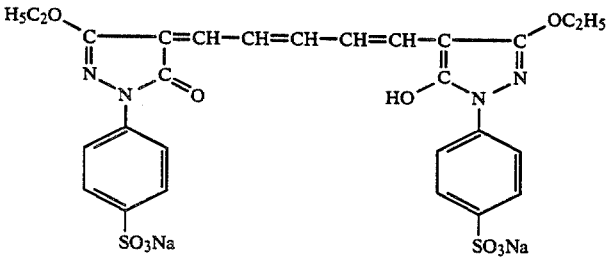
(B-12)
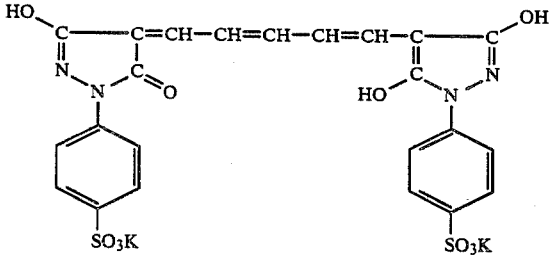
(B-13)

-continued
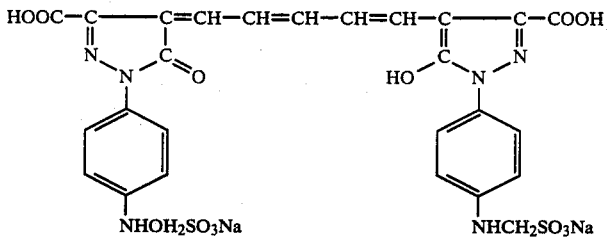
(B-14)
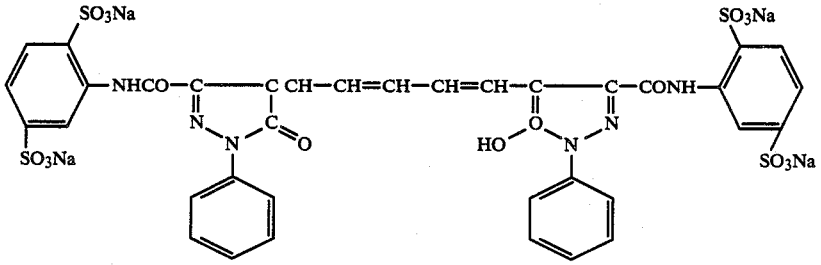
(B-15)
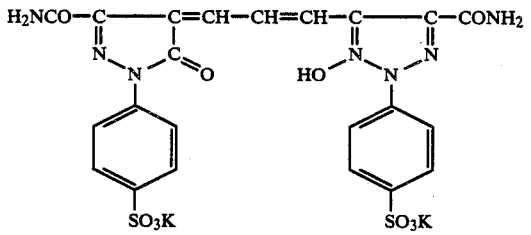
(B-16)
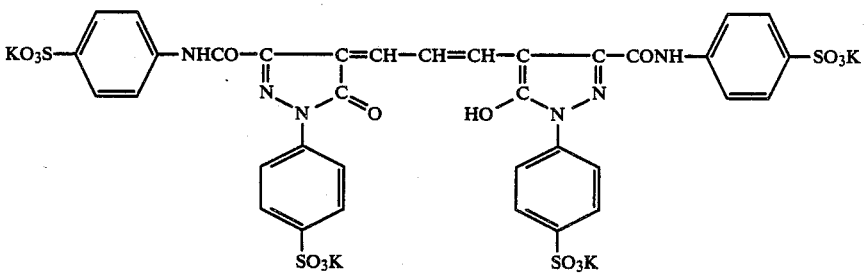
(B-17)
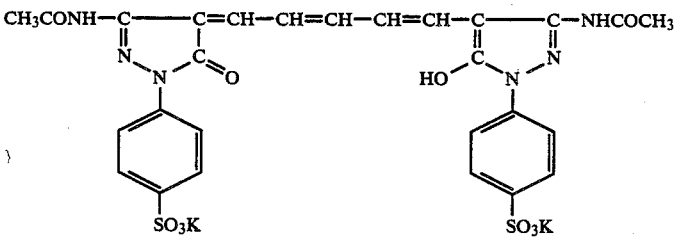
(B-18)
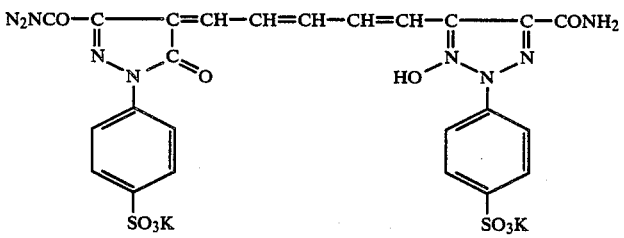
(B-19)

-continued
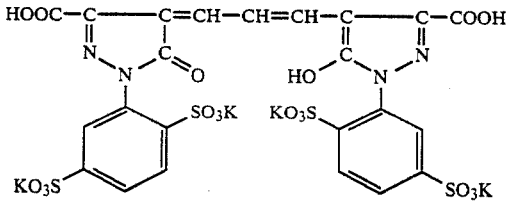
(B-20)
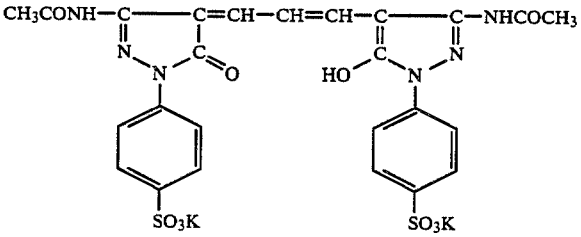
(B-21)
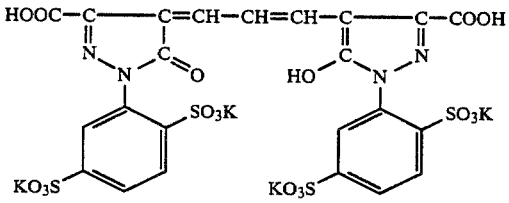
(B-22)
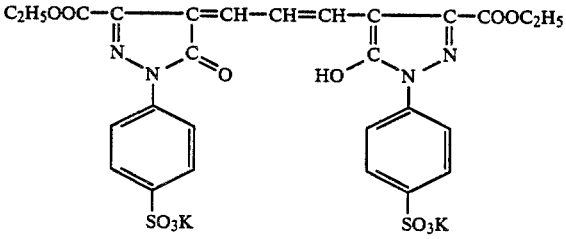
(B-23)
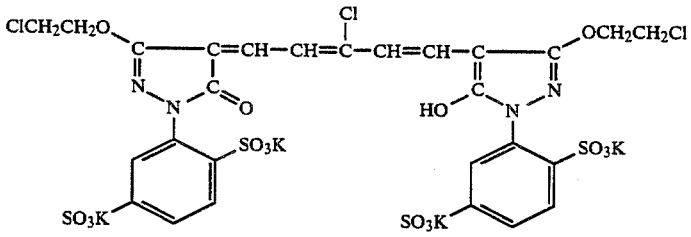
(B-24)
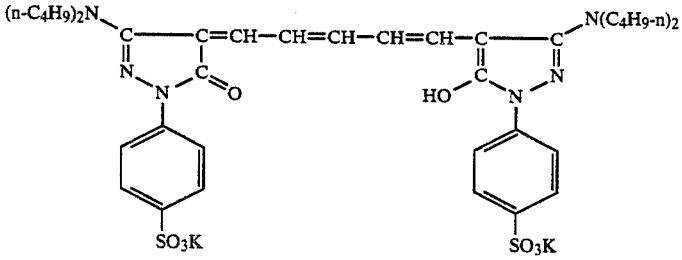
(B-25)
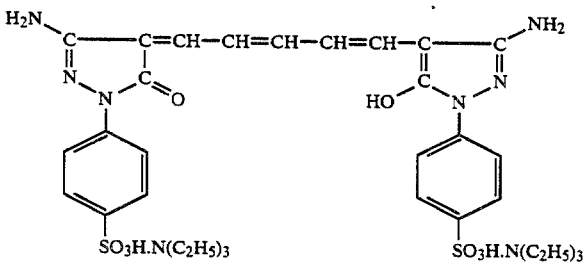
(B-26)

-continued (B-27)

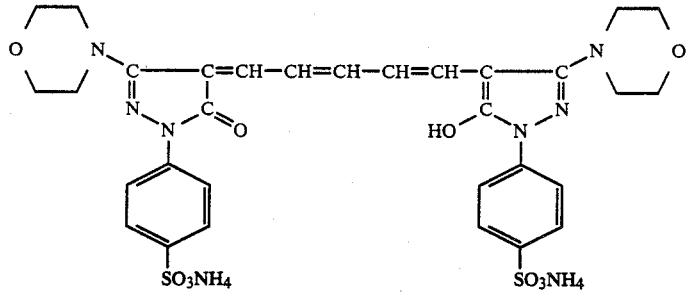

(B-28)

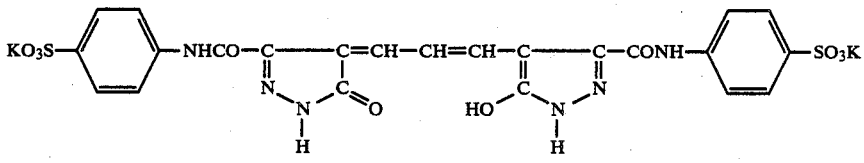

(B-29)

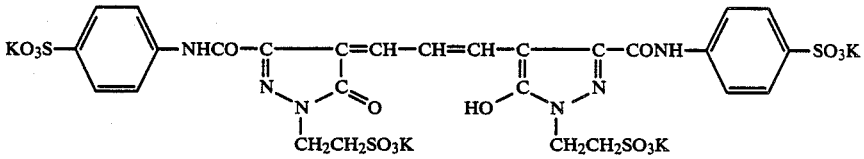

(IV)

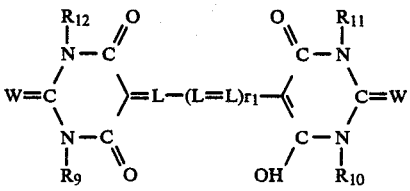

In the formula, r represents an integer of 1 to 3; W represents an oxygen atom or a sulfur atom; L represents a methine group; and $R_9$ to $R_{12}$ each represent a hydrogen atom, an alkyl group, an aryl group, an aralkyl group or a heterocyclic group, and at least one of $R_9$ to $R_{12}$ is a substituent other than the hydrogen atom.

The methine group represented by L may be mentioned those as described in the explanation of the formula (III).

As the alkyl group represented by $R_9$ to $R_{12}$, there may be mentioned the same alkyl group of $R_6$ and $R_6'$ as described in the explanation of the formula (III). The alkyl group may have a substituent and as the substitiuent, there may be mentioned various kinds described as substituents introduced in the groups of $R_6$ and $R_6'$ of the formula (III), but preferably each groups of sulfo, carboxy, hydroxy, alkoxy, alkoxycabonyl, cyano and sulfonyl.

The aryl group represented by $R_9$ to $R_{12}$ may preferably be a phenyl group and as a substituent introduced in the phenyl group, there may be mentioned various kinds described as the substituent introduced in $R_6$ and $R_6'$ of the formula (III), but desirably have at least one group selected from the group consisting of a sulfo group, a carboxy group and a sulfamoyl group on the aromatic nucleus.

The aralkyl group represented by $R_9$ to $R_{12}$ may preferably be a benzyl group or a phenethyl group and as a substituent introduced on the aromatic necleus, there may be mentioned the same as described in the substituents for the above aryl group of $R_9$ to $R_{12}$.

The heterocyclic group represented by $R_9$ to $R_{12}$ may preferably be a pyridyl group, a pyrimidyl group, etc. and as a substituent introduced on the heterocyclic ring, there may be mentioned the same as described in the substituents for the above aryl group of $R_9$ to $R_{12}$.

As the groups represented by $R_9$ to $R_{12}$, the alkyl group and the aryl group are preferred and desirably have at least one group selected from the group consisting of each groups of carboxy, sulfo and sulfamoyl in the molecule of barbituric acid and thiobarbituric acid represented by the formula (IV) and preferably symmetric type.

Next, representative examples of the compound of the above formula (IV) are shown, but the present invention is not limited by these compounds.

(C-1)

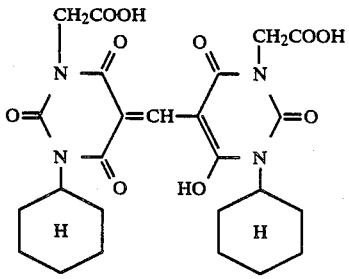

-continued (C-2)

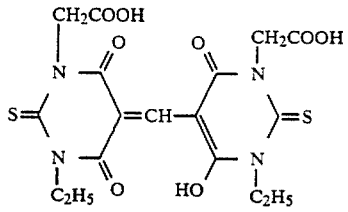

(C-3)

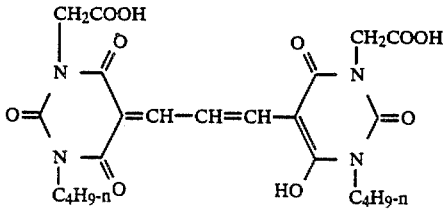

(C-4)

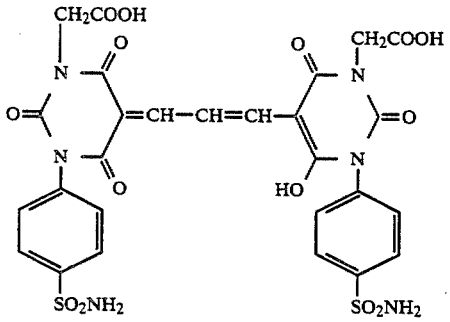

(C-5)

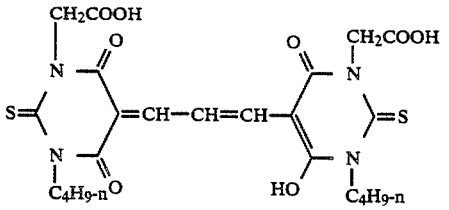

(C-6)

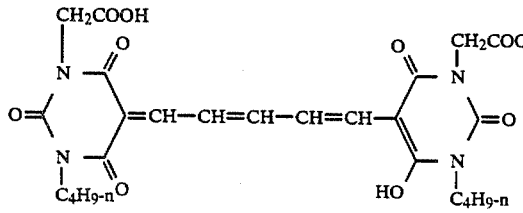

(C-7)

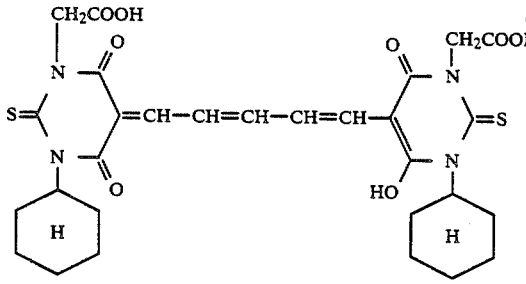

(V)

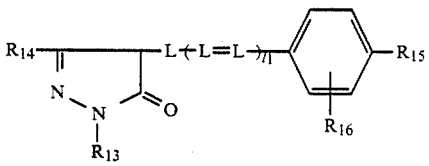

In the formula, l represents an integer of 1 or 2; L represents a methine group; $R_{13}$ represents an alkyl group, an aryl group and a heterocyclic group which have the same meanings as $R_6$ and $R_6'$ of the formula (III), and preferably an alkyl group and an aryl group and the aryl group may desirably have at least one of a sulfo group.

$R_{14}$ and $R_{15}$ each may be introduced all the substituents described in $R_7$ and $R_7'$ of the formula and an alkyl group, and preferably selected from the group consisting of an alkyl group, a carboxy group, an alkoxycarbonyl group, a carbamoyl group, a ureido group, an acylamino group, an imino group and a cyano group. The alkyl group of $R_{14}$ may be any of straight, branched and cyclic preferably having 1 to 6 carbon atoms, may be substituted by a hydroxy group, a carboxy group, a sulfo group, etc. and may be mentioned, for example, a methyl group, an ethyl group, an iso-propyl group, an n-butyl group, a hydroxyethyl group, etc. As the alkoxy group and the alkyl group of the alkyl group-substituted amino group of $R_{14}$ and $R_{15}$, there may be mentioned, for example, a methyl group, an ethyl group, a butyl group, a hydroxyalkyl group (e.g. a hydroxyethyl group, etc.), an alkoxyalkyl group (e.g. a beta-carboxyethyl group, etc.) an alkoxycarbonylalkyl group (e.g. a $\beta$-ethoxyethyl group, etc.), a carboxyalkyl group (e.g. a $\beta$-ethoxycarbonylethyl group, etc.), a cyanoalkyl group (e.g. a $\beta$-cyanoethyl group, etc.), a sulfoalkyl group (e.g. a $\beta$-sulfoethyl group, a $\beta$-sulfopropyl group, etc.) and the like.

$R_{16}$ represents a hydrogen atom, an alkyl group, a chlorine atom or an alkoxy group, and the alkyl group may be mentioned, for example, a methyl group, an ethyl group, etc. and the alkoxy group may be a methoxy group, an ethoxy group, etc.

Next, representative specific examples of the compound represented by the above formula (V) are shown, but the present invention is not limited by these compounds.

(D-1)
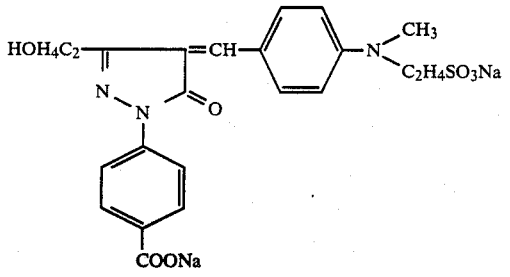
(D-2)
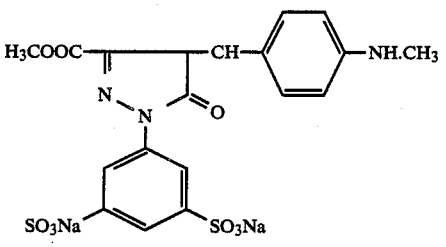
(D-3)
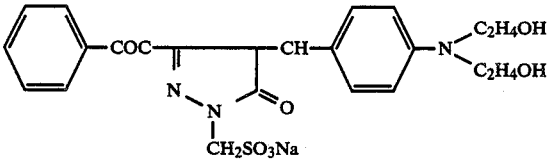
(D-4)
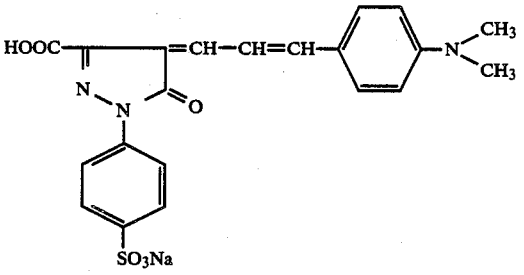
(D-5)
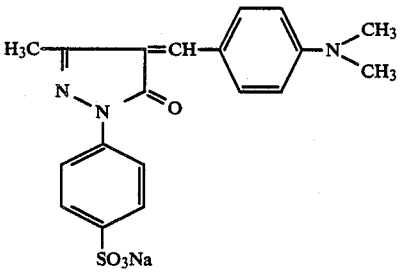
(D-6)
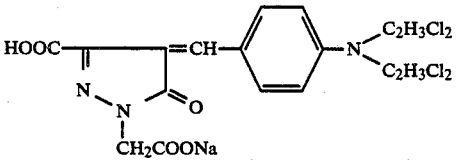

-continued (D-7)

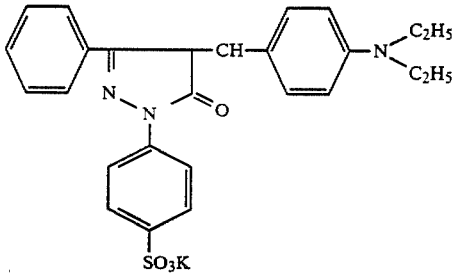

(D-8)

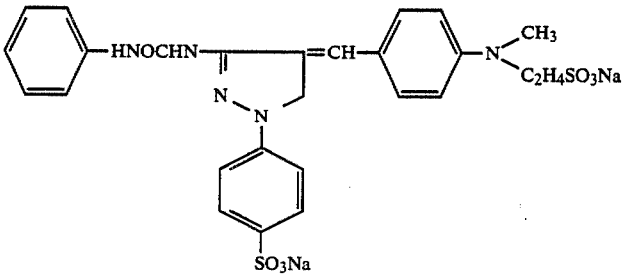

The compounds of the above formulae (II), (III), (IV) or (V) can be synthesized by the synthetic method as described in U.S. Pat. Nos. 3,575,704, 3,247,127, 3,540,887 and 3,653,905, Japanese Provisional Patent Publications Nos. 85130/1973, 99620/1974, 111640/1984, 111641/1984 and 170838/1984.

Further, the compounds represented by the formula (II), (III), (IV) or (V) may be contained in any layers in the silver halide emulsion layers and the other hydrophilic colloidal layers, and they are contained in the light-sensitive material by dissolving organic or inorganic alkali salts of the above compounds in water, adding in a coating solution of an emulsion, etc. in the form of a dye aqueous solution having a suitable concentration and coating them by a conventional method, and preferably they are contained in emulsion layers and layers adjacent to the emulsion layer. A contained amount of these compounds are 1 to 800 mg per 1 $m^2$ of the light-sensitive material by coating, preferably 2 to 200 $mg/m^2$.

Of these compounds represented by the above formula (II), (III), (IV) or (V), the compound represented by the formula (III) is particularly preferred. Further, these compounds are preferably used in combination of two kinds or more with respect to the effect of the present invention.

When the cyan couplers represented by the formula (VI) to (VIII) are combindly used in the present invention, it has been understood that there is an effect of improving a color fading of the cyan dye due to light during preservation with a lapse of time as well as the object of the present invention has well performed.

(VI)

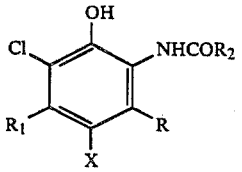

In the formula, R and $R_1$ represent one of which is a hydrogen atom and the other is a straight or branched alkyl group having at least 2 to 12 carbon atoms; X represents a hydrogen atom or an eliminable group by the coupling reaction with a oxidized product of an aromatic primary amine color developing agent; and $R_2$ represents a ballast group.

(VII)

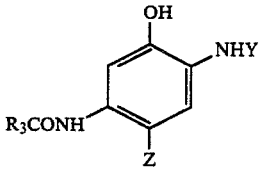

(VIII)

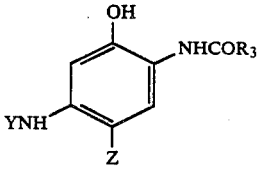

In the formula, Y represents

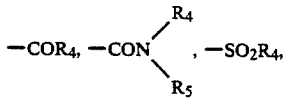

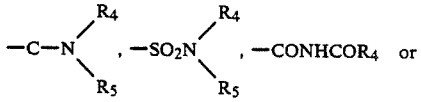

$-CONHSO_2R_4$ (where $R_4$ represents an alkyl group, an alkenyl group, a cycloalkyl group, an aryl group or a heterocyclic group; $R_5$ represents a hydrogen atom, an alkyl group, an alkenyl group, a cycloalkyl group, an aryl group or a heterocyclic group; and $R_4$ and $R_5$ may be bonded with each other to form a 5- or 6-membered ring); $R_3$ represents a ballast group; and Z represents a hydrogen atom or an eliminable group by the coupling reaction with an aromatic primary amine color developing agent.

While the cyan color forming coupler in accordance with the present invention can be represented by the above formulae (VI) to (VIII), the formula (VI) will further be explained in the following.

In the present invention, the straight or branched alkyl group having at least 2 to 12 carbon atoms represented by $R_1$ and R of the above formula (VI) are, for example, an ethyl group, a propyl group, a butyl group.

In the formula (VI), the ballast group represented by $R_2$ is an organic group having such a size and a form which provides to the coupler molecule a sufficient bulk to substantially inhibit diffusion of the coupler from the layer which is applied the coupler to the other layer. As the representative ballast group, there may be mentioned an alkyl group or an aryl group each having total carbon atoms of 8 to 32, preferably those having total carbon atoms of 13 to 28. As the substituent for the alkyl group and the aryl group, there may be mentioned, for example, an alkyl group, an aryl group, an alkoxy group, an aryloxy group, a carboxy group, an acyl group, an ester group, a hydroxy group, a cyano group, a nitro group, a carbamoyl group, a carbonamide group, an alkylthio group, an arylthio group, a sulfonyl group, a sulfonamide group, a sulfamoyl group, a halogen atom and the like, and as the substituent for the alkyl group, those as mentioned for the above aryl group except for the alkyl group.

Preferred ones for the ballast group are those as shown in the following formula:

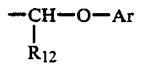

$R_{12}$ represents analkyl group having 1 to 12 carbon atoms; and Ar represents an aryl group such as a phenyl group, etc. and the aryl group may have a substituent. As the substituent, an alkyl group, a hydroxy group, a halogen atom, an alkylsulfonamide group, etc. may be mentioned and the most preferred is a branched alkyl group such as a t-butyl group, etc.

The eliminable group by the coupling with the oxidized product of the color developing agent defined by X in the above formula (VI) decides as well known for a man skilled in the art equivalent number of the coupler as well as affect to the reactivity of the coupling reaction. As the representative examples, a halogen represented by chlorine and fluorine, an aryloxy group, a substituted or unsubstituted alkoxy group, an acyloxy group, a sulfonamide group, an arylthio group, a heteroylthio group, a heteroyloxy group, a sulfonyloxy group, a carbamoyloxy group and the like. As the further representative examples, the groups as disclosed in Japanese Provisional Patent Publications Nos. 10135/1975, 120334/1975, 130414/1975, 48237/1979, 146828/1976, 14736/1979, 37425/1972, 123341/1975 and 95346/1983, Japanese Patent Publication No. 36894/1973, and U.S. Pat. Nos. 3,476,563, 3,737,316 and 3,227,551.

Next, exemplary compounds of the cyan coupler represented by the formula (VI) are shown below, but the present invention is not limited by these compounds.

(Exemplary compounds)

| Coupler No. | $R_1$ | X | $R_2$ | R |
|---|---|---|---|---|
| C-1 | $-C_2H_5$ | $-H$ | 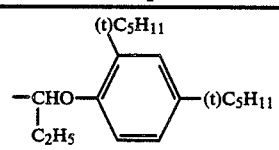 | $-H$ |
| C-2 | $-C_2H_5$ | $-Cl$ | 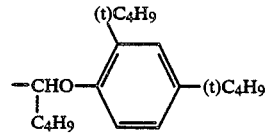 | $-H$ |
| C-3 | $-C_2H_5$ | $-H$ | 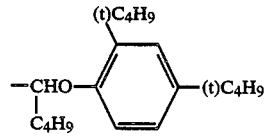 | $-H$ |
| C-4 | $-C_2H_5$ | $-Cl$ | 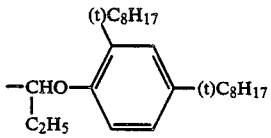 | $-H$ |
| C-5 | $-C_2H_5$ | $-Cl$ | 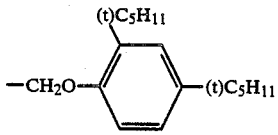 | $-H$ |

-continued
(Exemplary compounds)
| Coupler No. | $R_1$ | X | $R_2$ | R |
|---|---|---|---|---|
| C-6 | $-C_2H_5$ | 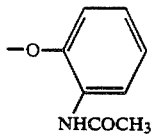 | 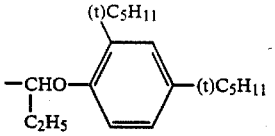 | —H |
| C-7 | $-CH(CH_3)_2$ | —Cl | 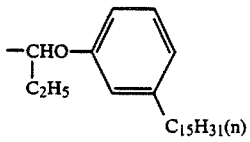 | —H |
| C-8 | $-C_2H_5$ | —Cl | 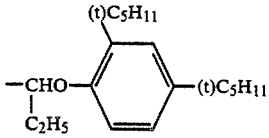 | —H |
| C-9 | $-C_2H_5$ | —Cl | 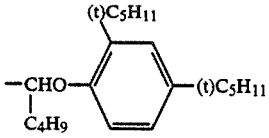 | —H |
| C-10 | $-C_4H_9$ | —F | 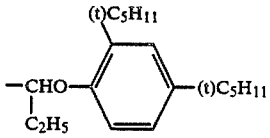 | —H |
| C-11 | $-C_2H_5$ | —F | 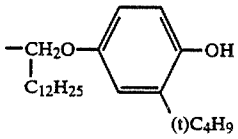 | —H |
| C-12 | $-C_2H_5$ | —Cl | 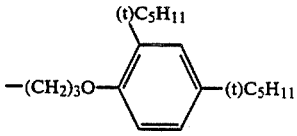 | —H |
| C-13 | $-C_2H_5$ | —F | 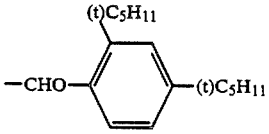 | —H |
| C-14 | $-C_4H_9$ | —Cl | 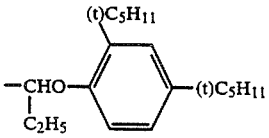 | —H |
| C-15 | $-C_2H_5$ | —Cl | 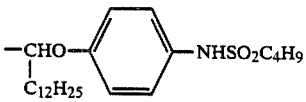 | —H |

-continued
(Exemplary compounds)
| Coupler No. | $R_1$ | X | $R_2$ | R |
|---|---|---|---|---|
| C-16 | $-C_2H_5$ | $-Cl$ | 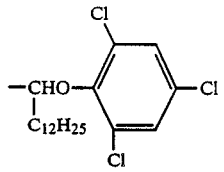 | $-H$ |
| C-17 | $-CH(CH_3)_2$ | $-Cl$ | $-C_{18}H_{37}$ | $-H$ |
| C-18 | $-C_2H_5$ | 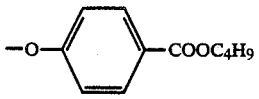 | 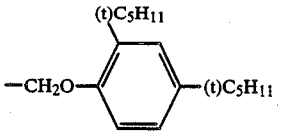 | $-H$ |
| C-19 | $-C_2H_5$ | $-F$ | 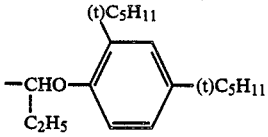 | $-H$ |
| C-20 | $-C_2H_5$ | $-Cl$ | 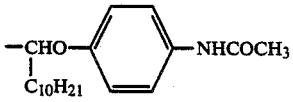 | $-H$ |
| C-21 | $-C_3H_7$ | $-Cl$ | 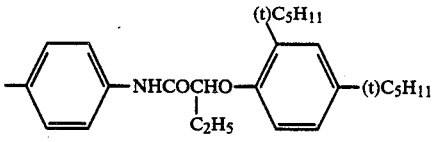 | $-H$ |
| C-22 | $-C_3H_7$ | $-Cl$ | 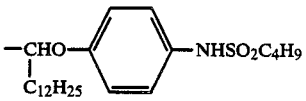 | $-H$ |
| C-23 | $-C_2H_4NHCOCH_3$ | $-Cl$ | 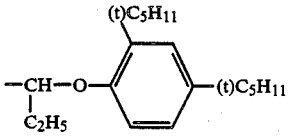 | $-H$ |
| C-24 | $-C_3H_6OCOH_3$ | $-Cl$ | 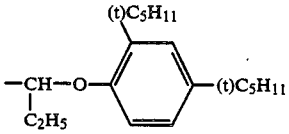 | $-H$ |
| C-25 | $-H$ | $-Cl$ | 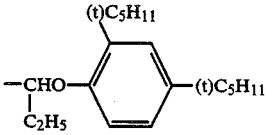 | $-C_2H_5$ |
| C-26 | $-H$ | $-Cl$ | 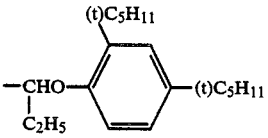 | $-C_3H_7$ |

-continued (Exemplary compounds)

| Coupler No. | $R_1$ | X | $R_2$ | R |
|---|---|---|---|---|
| C-27 | —H | —Cl | 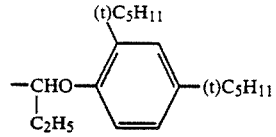 | $-C_5H_{11}$ |
| C-28 | $-C_2H_5$ | —Cl | 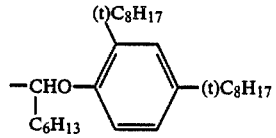 | —H |

In the following, the synthetic method of the exemplary compounds are shown, but the other exemplary compounds can also be synthesized by the similar method.

SYNTHESIS OF EXEMPLARY COMPOUND C-5

[(1)-a] Synthesis of 2-nitro-4,6-dichloro-5-ethylphenol

In 150 ml of glacial acetic acid were dissolved 33 g of 2-nitro-5-ethylphenol, 0.6 g of iodine and 1.5 g of ferric chloride. To the mixture was added dropwise 75 ml of sulfuryl chloride at 40° C. for 3 hours. Precipitates formed during dripwise addition were after completion of the dropwise addition of the sulfuryl chloride reacted and dissolved by refluxing under heating. The refluxing under heating was required for about 2 hours. The reaction mixture was poured into water and the formed crystals were recrystallized from methaol to purify. Confirmation of (1)-a was carried out by the nuclear magnetic resonance spectrum and the elemental analysis.

[(1)-b] Synthesis of 2-nitro-4,6-dichloro-5-ethylphenol

In 300 ml of alcohol was dissolved 21.2 g of the compound of [(1)-a], and to the solution was added a catalytic amount of Raney nickel and hydrogen was passed therethrough under ambient pressure until no hydrogen absorption was observed. After the reaction, the Raney nickel was removed and the alcohol was distilled out under reduced pressure. The residual [(1)-b] was carried out the following acylation without purification.

[(1)-c] Synthesis of 2-[(2,4-di-tert-acylphenoxy)acetamido]-4,6-dichloro-5-ethylphenol In a mixed solution comprising 500 ml of glacial acetic acid and 16.7 g of sodium acetate was dissolved a crude amino derivative obtained in [(1)-b], and to the mixture was added dropwise at room temperature an acetic acid solution dissolved 28.0 g of 2,4-di-tert-aminophenoxyacetic acid chloride in 50 ml of acetic acid. The acetic solution was added dropwise for 30 minutes, and after further stirring for 30 minutes, the reaction mixture was poured into ice-cold water. After the formed precipitates were collected by filtration and dried, recrystallized twice from acetnitrile to obtain the title compound. Confirmation of the title compound was carried out by the elemental analysis and the nuclear magnetic resonance spectrum.

| | $C_{21}H_{35}NO_3Cl_2$ | | | |
|---|---|---|---|---|
| | C | H | N | Cl |
| Calculated (%) | 65.00 | 7.34 | 2.92 | 14.76 |
| Observed (%) | 64.91 | 7.36 | 2.99 | 14.50 |

Next, the cyan coupler represented by the formulae (VII) or (VIII) to be used in the present invention are explained. In the above formulae (VII) and (VIII), Y is a group represented by

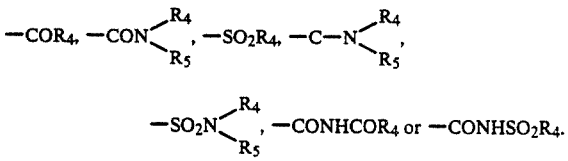

In the formula, $R_4$ represents an alkyl group, preferably an alkyl group having 1 to 20 carbon atoms (e.g. a methyl group, an ethyl group, a t-butyl group, a dodecyl group, etc.), an alkenyl group, preferably an alkenyl group having 2 to 20 carbon atoms (e.g. an allyl group, a heptadecenyl group, etc.), a cycloalkyl group, preferably that of 5 to 7-membered ring (e.g. a cyclohexyl group, etc.), an aryl group (e.g. a phenyl group, a tolyl group, a naphthyl group, etc.), or a heterocyclic group, preferably a 5-membered or 6-membered heterocyclic ring containing 1 to 4 nitrogen atom, oxygen atom or sulfur atom (e.g. a furyl group, a thienyl group, a benzothiazolyl group, etc.). $R_5$ represents a hydrogen atom or a group represented by $R_4$. $R_4$ and $R_5$ may be bonded with each other to form a 5- or 6-membered heterocyclic ring containing a nitrogen atom. $R_4$ and $R_5$ may be introduced optinal substituent and such substituents may include, for example, an alkyl group having 1 to 10 carbon atom (e.g. ethyl, i-propyl, i-butyl, t-butyl, t-oxtyl, etc.), an aryl group (e.g. phenyl, naphthyl, etc.), a halogen atom (fluorine, chlorine, bromine, etc.), a cyano group, a nitro group, a sulfonamide group (e.g. methansulfonamide, butansulfonamide, amide, p-toluenesulfonamide, etc.), a sulfamoyl group (e.g. methylsulfamoyl, phenylsulfamoyl, etc.), a sulfonyl group (e.g. methansulfonyl, p-toluenesulfonyl, etc.), a fluorosulfonyl group, a carbamoyl group (e.g. dimethylcarbamoyl, phenylcarbamoyl, etc.), an oxycarbonyl group (e.g. ethoxycarbonyl, phenoxycarbonyl, etc.), an acyl group (e.g. acetyl, benzoyl, etc.), a heterocyclic group (e.g. a pyridyl group, a pyrazolyl group, etc.), an alkoxy group, an aryloxy group, an acyloxy group and the like.

In the formulae (VII) and (VIII), $R_3$ represents a ballast group necessary for providing a diffusion resistance to the cyan coupler represented by the formulae (VII) and (VIII) and a cyan dye formed from said cyan coupler. Preferably, they are an alkyl group having 4 to 30 carbon atoms, an aryl group or a heterocyclic group. For example, there may be mentioned a straight or branched alkyl group (e.g. t-butyl, n-octyl, t-octyl, n-dodecyl, etc.), an alkenyl group, a cycloalkyl group, a 5-membered or 6-membered heterocyclic group and the like.

In the formulae (VII) and (VIII), Z represents a hydrogen atom or an eliminable group by the coupling reaction with an aromatic primary amine color developing agent. For example, there may be mentioned a halogen atom (e.g. chlorine, bromine, fluorine, etc.), a substituted or unsubstituted alkoxy group, an aryloxy group, a heterocyclicoxy group, an acyloxy group, a carbamoyloxy group, a sulfonyloxy group, an alkylthio group, an arylthio group, a heterocyclicthio group, a sulfonamide group, etc., and more specifically, those as disclosed in U.S. Pat. No. 3,741,563, Japanese Provisional Patent Publication No. 37425/1972, Japanese Patent Publication No. 36894/1973, Japanese Provisional Patent Publication Nos. 10135/1975, 108841/1976, 120343/1975, 18315/1978, 105226/1978, 14736/1979, 48237/1979, 32071/1980, 65957/1980, 1938/1981, 12643/1981, 27147/1981, 146050/1984, 166956/1984, 24547/1985, 35731/1985 and 37557/1985.

In the present invention, of these cyan couplers represented by the above formulae (VII) or (VIII), the cyan couplers represented by the following formulae (IX), (X) or (XI) are more preferred.

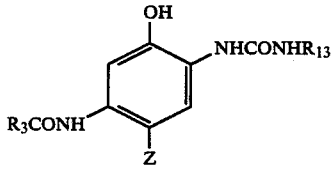

(IX)

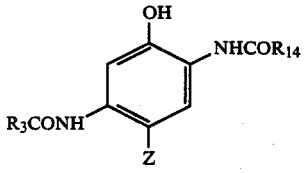

(X)

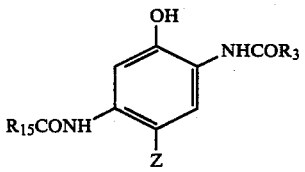

(XI)

In the formula (IX), $R_{13}$ is a substituted or unsubstituted aryl group (particularly preferred is a phenyl group). As the substituent when said aryl group has a substituent, they may include at least one substituent selected from $-SO_2R_{16}$, a halogen atom (e.g. fluorine, bromine, chlorine, etc.), $-CF_3$, $-NO_2$, $-CN$, $-COR_{16}$, $-COOR_{16}$, $-SO_2OR_{16}$, -continued $-CON\begin{matrix}R_{16}\\R_{17}\end{matrix}$, $-SO_2N\begin{matrix}R_{16}\\R_{17}\end{matrix}$, $-OR_{16}$, $-OCOR_{16}$, $-N\begin{matrix}R_{17}\\COR_{16}\end{matrix}$, $-N\begin{matrix}R_{17}\\SO_2R_{16}\end{matrix}$ and $-P(=O)\begin{matrix}OR_{16}\\OR_{16}\end{matrix}$.

In the above, $R_{16}$ represents an alkyl group, preferably an alkyl group having 1 to 20 carbon atoms (e.g. each groups of methyl, ethyl, tert-butyl, dodecyl, etc.), an alkenyl group, preferably an alkenyl group having 2 to 20 carbon atoms (e.g. an aryl group, a heptadecenyl group, etc.), a cycloalkyl group, preferably 5 to 7-membered ring group (e.g. a cyclohexyl group, etc.), an aryl group (e.g. a phenyl group, a tolyl group, a naphthyl group, etc.); and $R_{17}$ is a hydrogen atom or a group represented by the above $R_{16}$.

The preferred compounds of the phenol type cyan coupler represented by (IX) are such compounds that $R_{13}$ is a substituted or unsubstituted phenyl group, and a substituent for the phenyl group is a cyano group, a nitro group, $-SO_2R_{18}$ ($R_{18}$ is an alkyl group), a halogen atom or a trifluoromethyl group.

In the formulae (X) and (XI), $R_{14}$ and $R_{15}$ each represent an alkyl group, preferably an alkyl group having 1 to 20 carbon atoms (e.g. methyl, ethyl, tert-butyl, dodecyl, etc.), an alkenyl group, preferably an alkenyl group having 2 to 20 carbon atoms (e.g. allyl, oleyl, etc.), a cycloalkyl group, preferably a 5 to 7-membered cyclic group (e.g. cyclohexyl, etc.), an aryl group (e.g. a phenyl group, a tolyl group, a naphthyl group, etc.), a heterocyclic group (preferably a hetero ring of 5-membered or 6-membered ring having 1 to 4 hetero atoms of a nitrogen atom, an oxygen atom or a sulfur atom, such as a furyl group, a thienyl group, a benzothiazolyl group, etc.) and the like.

In the aforesaid $R_{16}$ and $R_{17}$, and $R_{14}$ and $R_{15}$ of the formulae (X) and (XI), optional substituents may be introduced therein and such substituents are substituents capable of introducing in $R_4$ and $R_5$ in the formulae (VII) and (VIII) as mentioned above. As to the substituents, a halogen atom (a chlorine atom, a fluorine atom, etc.) is particularly preferred.

In the above formulae (IX), (X) and (XI), Z and $R_3$ are each represent the same ones as in the formulae (VII) and (VIII). Preferred examples of the ballast group represented by $R_3$ is a group represented by the following formula (XII):

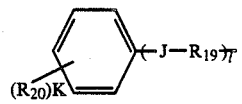

(XII)

In the formula, J represents an oxygen atom, a sulfur atom or a sulfonyl group; K represents an integer of 0 to 4; l represents 0 or 1; provided that K is 2 or more, $R_{20}$'s which exist 2 or more may be the same or different from each other; $R_{19}$ represents a straight or branched alkylene group having 1 to 20 carbon atoms which may be substituted by an aryl group, etc.; $R_{20}$ represents a divalent group, preferably a hydrogen atom, a halogen atom (e.g. chlorine, bromine, etc.), an alkyl group, preferably a straight or branched alkyl group having 1 to 20 carbon atoms (e.g. each groups of methyl, t-butyl, t-pentyl, t-octyl, dodecyl, pentadecyl, benzyl, phenethyl, etc.), an aryl group (e.g. a phenyl group), a heterocyclic group (preferably a nitrogen containing heterocyclic group), an alkoxy group, preferably a straight or branched alkoxy group having 1 to 20 carbon atoms (e.g. each groups of methoxy, ethoxy, t-butyloxy, octyloxy, decyloxy, dodecyloxy, etc.), an aryloxy group (e.g. a phenoxy group), a hydroxy group, an acyloxy group, preferably an alkylcarbonyloxy group, an arylcarbonyloxy group (e.g. an acetoxy group, a benzoyloxy group), a carboxy group, an alkyloxycarbonyl group, preferably a straight or branched alkyloxycarbonyl group having 1 to 20 carbon atoms, an aryloxycarbonyl group, preferably a phenoxycarbonyl group, an alkylthio group preferably having 1 to 20 carbon atoms, an acyl group, preferably a straight or branched alkylcarbonyl group having 1 to 20 carbon atoms, an acylamino group, preferably a straight or branched alkylcarboamide group having 1 to 20 carbon atoms, a benzenecarboamide group, a sulfonamide group, preferably a straight or branched alkylsulfonamide group having 1 to 20 carbon atoms or a benzenesulfonamide group, a carbamoyl group, preferably a straight or branched alkylaminocarbonyl group having 1 to 20 carbon atoms or a phenylaminocarbonyl group, a sulfamoyl group, preferably a straight or branched alkylaminosulfonyl group having 1 to 20 carbon atoms or a phenylaminosulfonyl group, and the like.

Next, representative exemplary compounds of the cyan coupler represented by the formulae (VII) or (VIII) are shown below, but the present invention is not limited by these compounds.

C-29

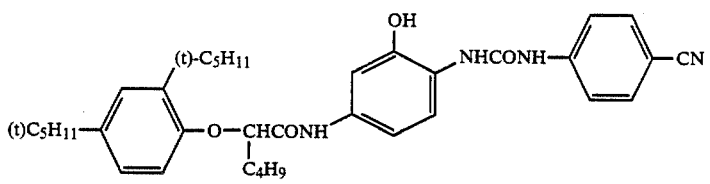

C-29'

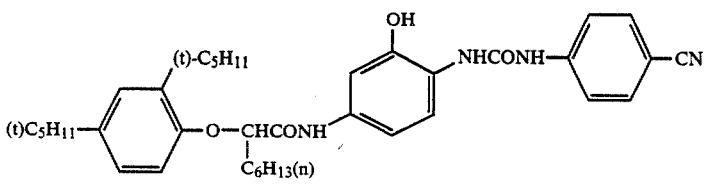

C-30

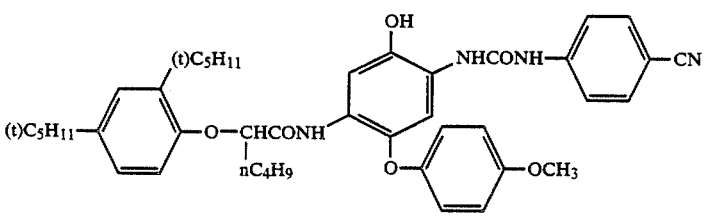

C-31

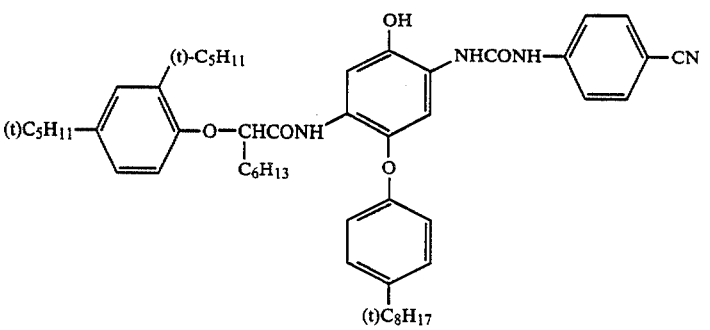

C-32

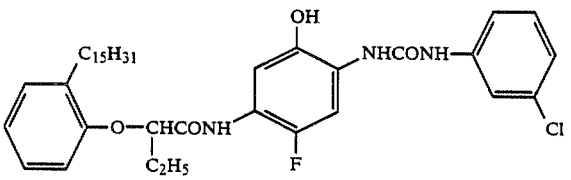

-continued
C-33
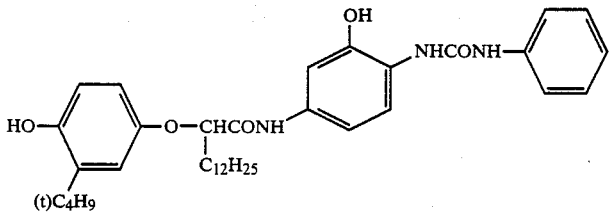
C-34
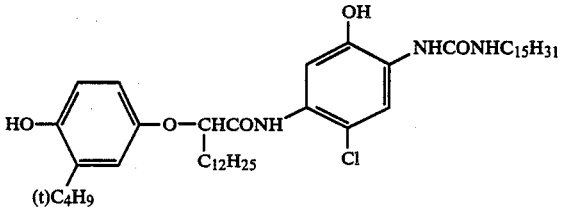
C-35
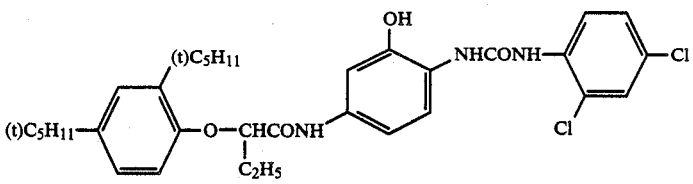
C-36
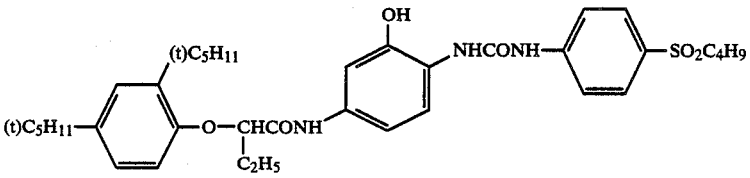
C-37
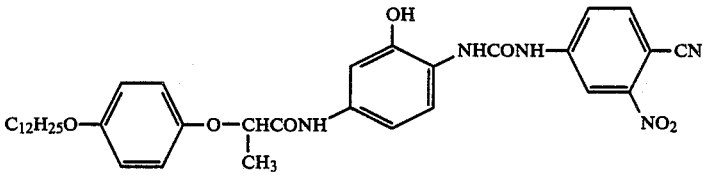
C-38
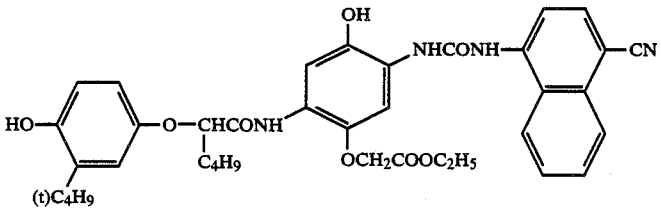
C-39
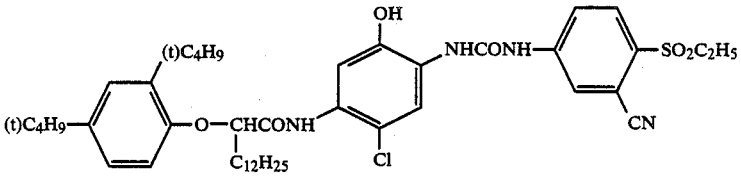
C-40
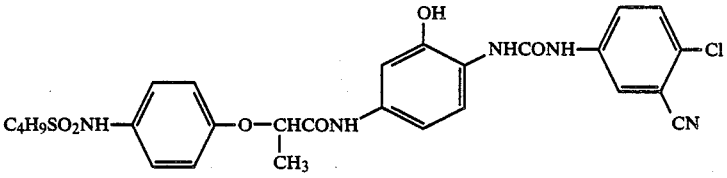

-continued
C-41
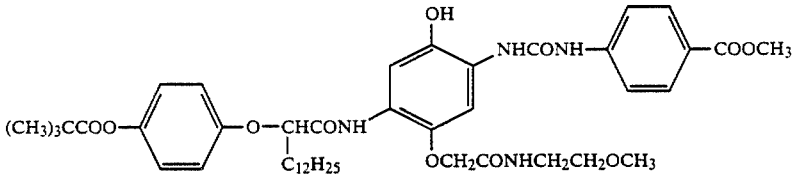
C-42
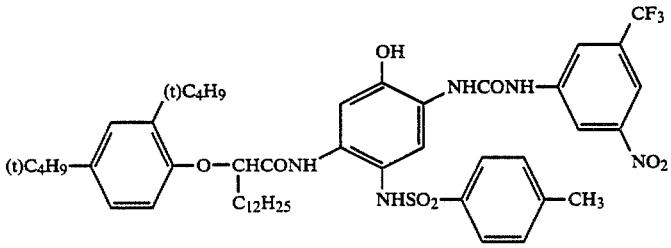
C-43
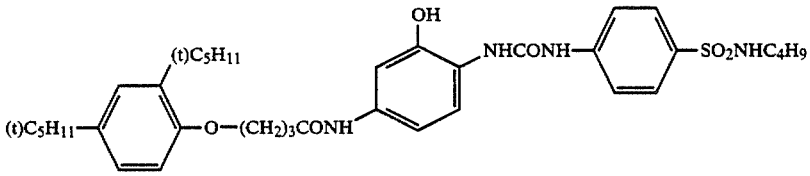
C-44
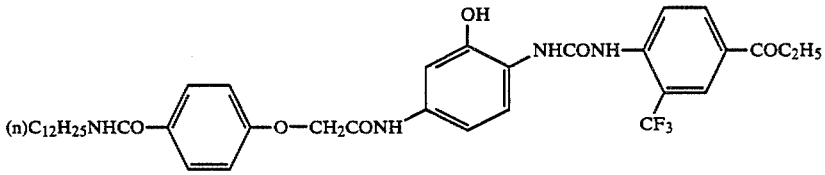
C-45
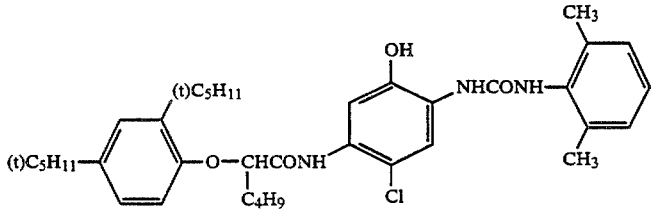
C-46
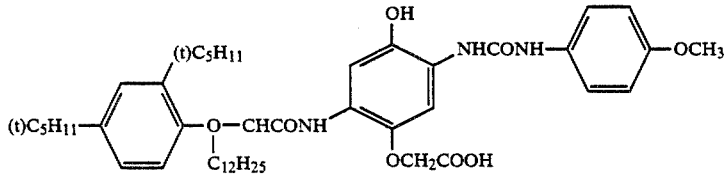
C-47
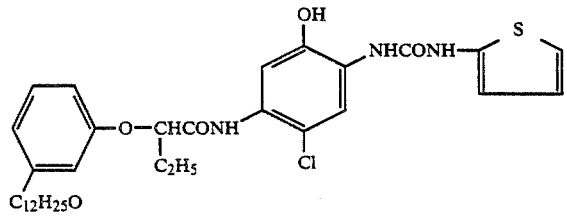

-continued

C-48

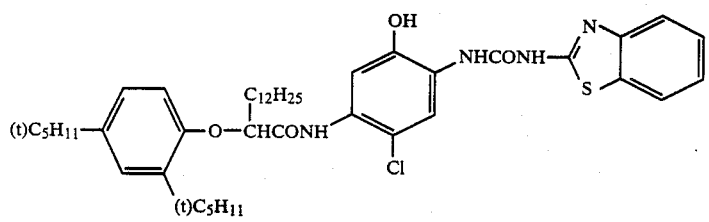

C-49

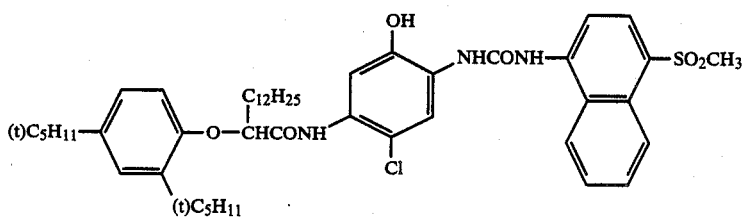

C-50

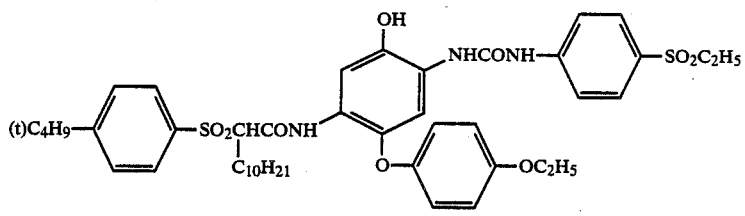

These cyan couplers can be synthesized by the known method, and for example, they can be synthesized by the methods as disclosed in U.S. Pat. Nos.2,772,162, 3,758,308, 3,880,661, 4,124,396 and 3,222,176; British Pat. No. 975,773; Japanese Provisional Patent Publication Nos. 21139/1972, 112038/1975, 163537/1980, 29235/1981, 99341/1980, 116030/1981, 69329/1977, 55945/1981, 80045/1981 and 134644/1975; British Pat. No. 1,011,940; U.S. Pat. Nos. 3,446,622 and 3,996,253; Japanese Provisional Patent Publication Nos. 65134/1981, 204543/1982, 204544/1982, 204545/1982, 33249/1983, 33251/1983, 33252/1983, 33250/1983, 33248/1983, 46645/1984, 31334/1983, 146050/1984, 166956/1984, 24547/1985, 35731/1985 and 37557/1985 and the like.

In the present invention, the cyan couplers represented by the formulae (VI), (VII) or (VIII) may be used in combination with the conventionally known cyan couplers so long as it does not contradict to the scope of the objects of the present invention. Further, the cyan couplers represented by the formulae (VI), (VII) and (VIII) may be used in combination therewith.

When the cyan couplers represented by the formulae (VI) to (VIII) in accordance with the present invention is contained in the silver halide emulsion layers, they may generally be used in an amount of about 0.005 to 2 mole per mole of silver halide, preferably in the range of 0.01 to 1 mole.

When the magenta coupler represented by the formula (XIII) is used in the present invention, it has been understood that there is an effect of improving a color fading of the magenta dye due to light during preservation with a lapse of time as well as the object of the present invention has well performed.

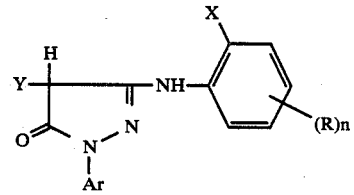

(XIII)

In the formula, Ar represents a phenyl group; Y represents an eliminable group by the coupling reaction with an oxidized product of a color developing agent; X represents a halogen atom, an alkoxy group or an alkyl group; R represents a group capable of substituting for a benzene ring; and n represents 1 or 2.

In the magenta coupler represent by the formula (XIII) to be used in the present invention, the phenyl group represented by Ar may preferably be a substitued phenyl group substituted by the following substituents.

Said substituent may include a halogen atom, an alkyl group, an alkoxy group, an aryloxy group, an alkoxycarbonyl group, a cyano group, a carbamoyl group, a sulfamoyl group, a sulfonyl group, a sulfonamide group or an acylamino group, and 2 or more substituents may be bonded to the phenyl group represented by Ar.

In the following, specific examples of the above substituents may be mentioned:

a halogen atom: chlorine, bromine, fluorine;

an alkyl group: a methyl group, an ethyl group, an iso-propyl group, a butyl group, a t-butyl group, a t-pentyl group, etc., and alkyl groups having 1 to 5 carbon atoms are particularly preferred;

an alkoxy group: a methoxy group, an ethoxy group, a butoxy group, a sec-butoxy group, an iso-pentyloxy group, etc., and alkoxy groups having 1 to 5 carbon atoms are particularly preferred;

an aryloxy group: a phenoxy group, a β-naphthoxy group, etc., and a substituent as mentioned in the phenyl group represented by Ar may further be bonded to the aryl portion;

an alkoxycarbonyl group: a carbonyl group having the aforesaid alkoxy group and those which have 1 to 5 carbon atoms at the alkyl portion such as a methoxycarbonyl group, a pentyloxycarbonyl group, etc. are preferred;

a carbamoyl group: an alkylcarbamoyl group such as a carbamoyl group, a dimethylcarbamoyl group, etc.;

a sulfamoyl group: an alkylsulfamoyl group such as a sulfamoyl group, a methylsulfamoyl group, a dimethylsulfamoyl group, an ethylsulfamoyl group, etc.;

a sulfonyl group: an alkylsulfonyl group such as a methansulfonyl group, an ethansulfonyl group, a butansulfonyl group, etc.;

a sulfonamide group: an alkylsulfonamide group such as a methansulfonamide group and an arylsulfonamide group such as toluenesulfonamide group, etc.;

an acylamino group: an acetamino group, a pivaloylamino group, a benzamino group, etc.;

and particularly preferred is halogen atoms, among them, a chlorine atom is the most preferred.

The group which eliminates when a dye is formed by coupling with an oxidized body of a color developing agent represented by Y may specifically include, for example, a halogen atom, an alkoxy group, an aryloxy group, an acyloxy group, an arylthio group, an alkylthio group,

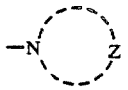

(where Z represents an atomic group necessary for formation of a 5- or 6-membered ring with a nitrogen atom and atoms selected from the group consisting of a carbon atom, an oxygen atom, a nitrogen atom and a sulfur atom) and the like.

In the following, specific examples of the above substituents may be mentioned:

a halogen atom: chlorine, bromine, fluorine;

an alkoxy group: an ethoxy group, a benzyloxy group, a methoxyethylcarbamoylmethoxy group, a tetradecylcarbamoylmethoxy group, etc.;

an aryloxy group: a phenoxy group, a 4-methoxyphenoxy group, a 4-nitrophenoxy group, etc.;

an acyloxy group: an acetoxy group, a mirystoyloxy group, a benzoyloxy group, etc;

an arylthio group: a phenylthio group, a 2-butoxy-5-octylphenylthio group, 2,5-dihexyloctylphenylthio group, etc.;

an alkylthio group: a methylthio group, an octylthio group, a hexadecylthio group, a benzylthio group, a 2-(diethylamino)ethylthio group, an ethoxycarbonylmethylthio group, an ethoxyethylthio group, a phenoxyethylthio group, etc.;

an

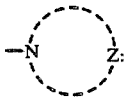

a pyrazolyl group, an imidazolyl group, a triazolyl group, a tetrazolyl group, etc.

In the following, specific examples of the halogen atom, the alkoxy group and the alkyl group represented by X may be mentioned:

a halogen atom: chlorine, bromine, flourine;

an alkoxy group: preferred are an alkoxy group having 1 to 5 carbon atoms such as a methoxy group, an ethoxy group, a sec-butoxy group, an iso-pentyloxy group, etc.;

an alkyl group: preferred are an alkyl group having 1 to 5 carbon atoms such as a methyl group, an ethyl group, an iso-propyl group, a butyl group, a t-butyl group, a t-pentyl group, etc.

Particularly preferred is a halogen atom, among them, a chlorine atom is more preferred.

The group represented by R capable of substituting for a benzene ring may be the same or different when n is 2, and the group represented by R capable of substituting for a benzene ring may include a halogen atom,

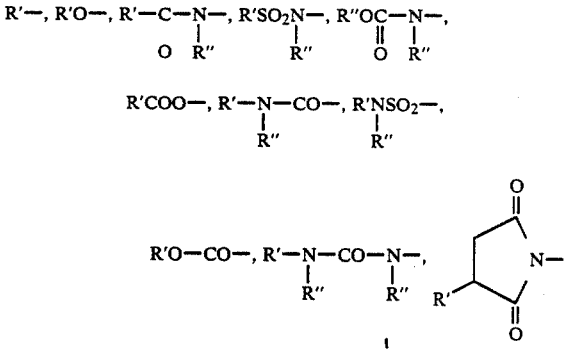

and the like.

R', R'' and R'' may be the same or different from each other and each represent a halogen atom or an alkyl group, an alkenyl group or an aryl group each may have a substituent. Of these groups, preferred are R'CONH—, R'$SO_2$NH—and

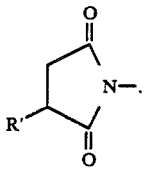

In the following, specific examples of the magenta coupler represented by the formula (VIII) are shown below but the present invention is not limited by these compounds.

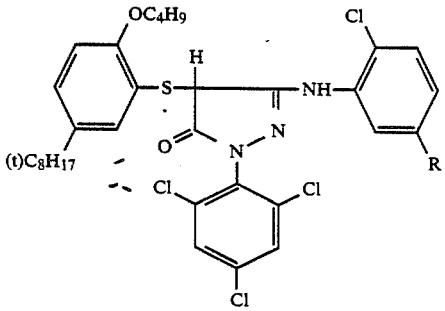

R in the above formula may be mentioned below.

$-NHCOC_{13}H_{27}$ (M-1)
$-NHCOC_{14}H_{29}$ (M-2)
(M-3)
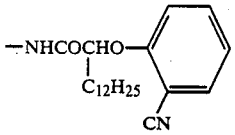
(M-4)
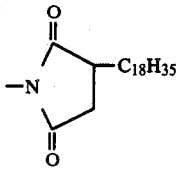
(M-5)
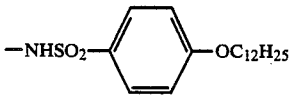
-continued
(M-6)
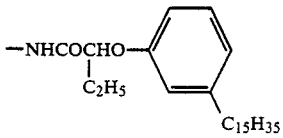
(M-7)
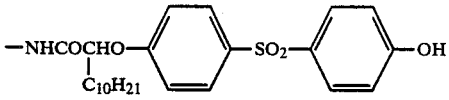
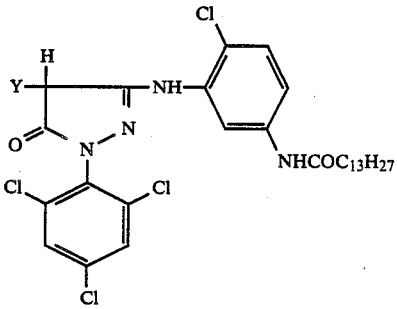
Y in the above formula may be mentioned below.
(M-8)
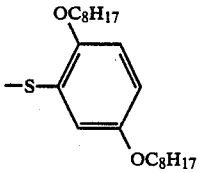
(M-9)
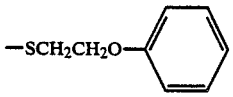
(M-10)
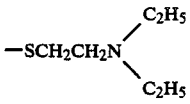
$-SC_{12}H_{25}$ (M-11)
$-SCH_2CO_2C_2H_5$ (M-12)
$-SCH_2COOH$ (M-13)
(M-14)
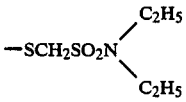
$-SCH_2CONH_2$ (M-15)
$-SCH_2CH_2OC_2H_5$ (M-16)
$-SCH_2CH_2OH$ (M-17)
(M-18)
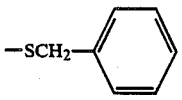
$-SCH_2CH_2NHSO_2CH_3$ (M-19)

-continued
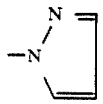
(M-20)
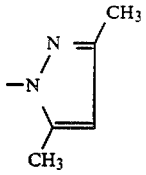
(M-21)
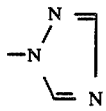
(M-22)
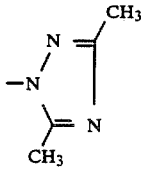
(M-23)
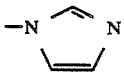
(M-24)
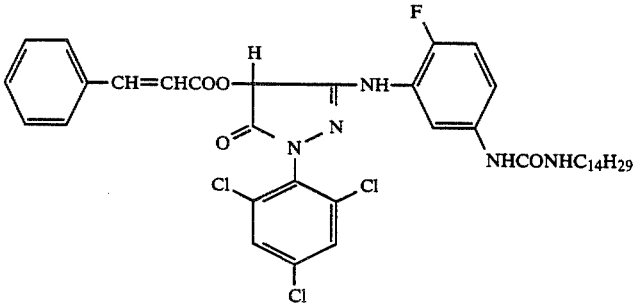
(M-25)
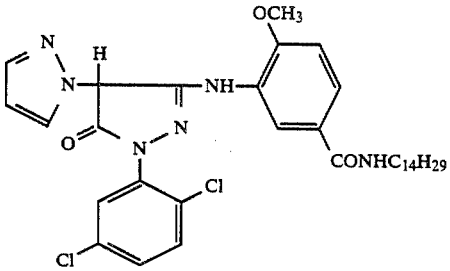
(M-26)
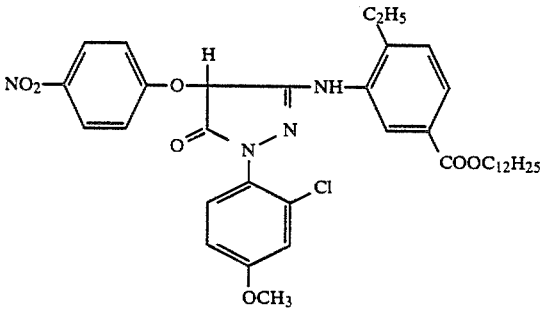
(M-27)

-continued
(M-28)
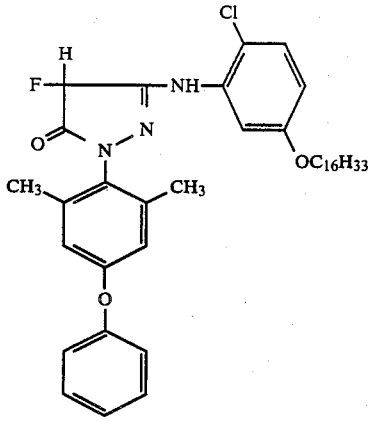
(M-29)
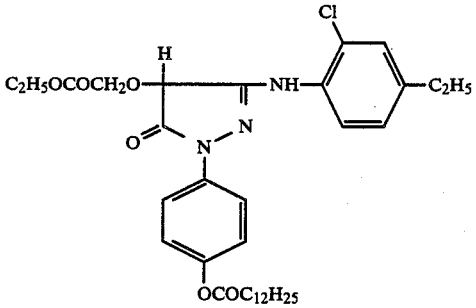
(M-30)
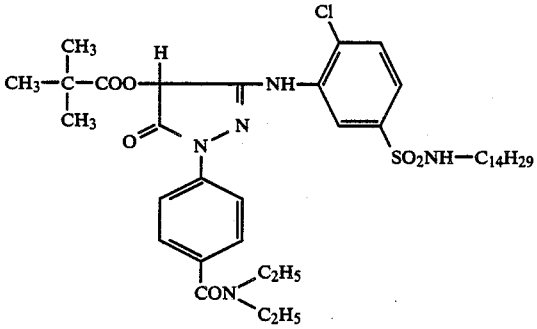
(M-31)
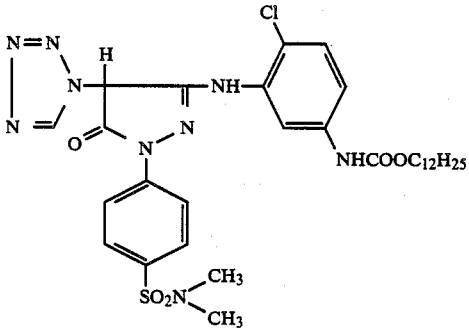

-continued (M-32)

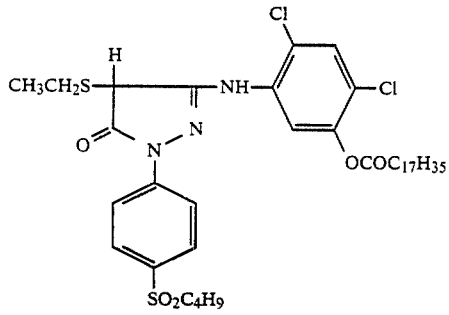

(M-33)

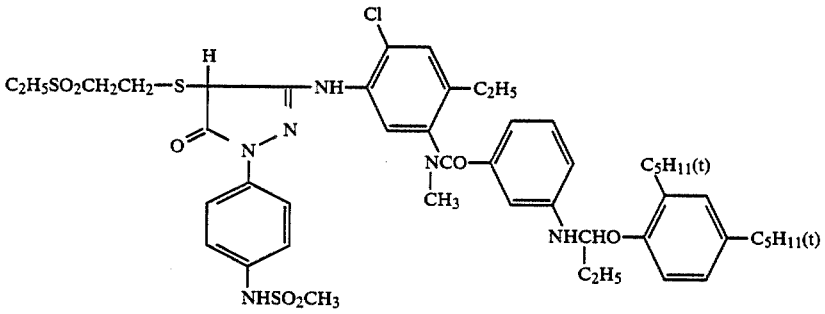

(M-34)

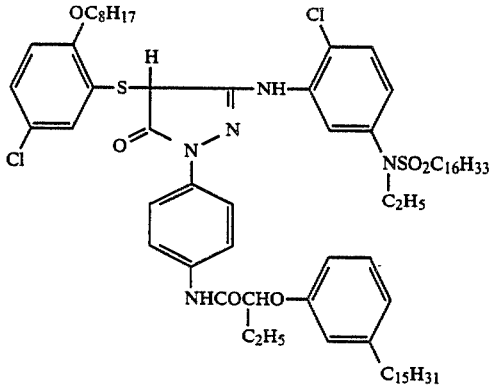

When the magenta coupler represented by the formula (XIII) is contained in the silver halide emulsion layer, it may generally be used in an amount of about 0.005 to 2 mole per mole of silver halide, preferably in the range of 0.01 to 1 mole.

In the present invention, the magenta coupler represented by the formula (XIII) can be used in combination with the conventionally known magenta coupler so long as it does not contradict to the scope of the objects of the present invention.

As an embodiment to be contained the magenta coupler represented by the formula (XIII) in the light-sensitive material, it can be employed a conventional method in which the magenta coupler is added to the light-sensitive material.

That is, in the general multi-layer light-sensitive material, these magenta couplers are contained in the green-sensitive silver halide emulsion layer. Said emulsion layer containing magenta coupler may be two or more layers.

The light-sensitive material of the present invention may be contained a magenta coupler other than the magenta coupler represented by the formula (XIII) as the magenta coupler, but an amount thereof may desirably be 50 mole % or less based on the whole magenta coupler in the whole layers of the emulsion layers.

When the magenta coupler represented by the formula (XIV) is used in the present invention, it has been understood that there is an effect of improving a color fading under high temperature and high humidity as well as the object of the present invention has well performed.

(XIV)

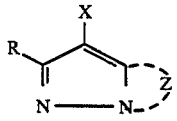

In the formula, Z represents a group of non-metallic atoms necessary for forming a nitrogen-containing heterocyclic ring and said ring formed by Z may have a substituent.

X represents a hydrogen atom or a substituent eliminable through the reaction with the oxidized product of a color developing agent.

R represents a hydrogen atom or a substituent.

In the magneta coupler represented by the formula (XIV),

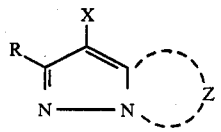

(XIV)

Z represents a group of non-metallic atoms necessary for forming a nitrogen-containing heterocyclic ring and said ring formed by Z may have a substituent.

X represents a hydrogen atom or a substituent eliminable through the reaction with the oxidized product of a color developing agent.

While R represents a hydrogen atom or a substituent, as the substituent represented by R, there may be mentioned, for example, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclicoxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group and a heterocyclicthio group.

As halogen atoms, for example, chlorine atom, bromine atom may be used, particularly preferably chlorine atom.

The alkyl group represented by R may include preferably those having 1 to 32 carbon atoms, the alkenyl group or the alkynyl group those having 2 to 32 carbon atoms and the cycloalkyl group or the cycloalkenyl group those having 3 to 12 carbon atoms, particularly 5 to 7 carbon atoms. The alkyl group, alkenyl group or alkynyl group may be either straight or branched.

These alkyl group, alkenyl group, alkynyl group, cycloalkyl group and cycloalkenyl group may also have substituents [e.g. an aryl group, a cyano group, a halogen atom, a heterocyclic ring, a cycloalkyl group, a cycloalkenyl group, a spiro ring compound residual group, a bridged hydrocarbon compound residual group; otherwise those substituted through a carbonyl group such as an acyl group, a carboxy group, a carbamoyl group, an alkoxycarbonyl group and an aryloxycarbonyl group; further those substituted through a hetero atom, specifically those substituted through an oxygen atom such as of a hydroxy group, an alkoxy group, an aryloxy group, a heterocyclicoxy group, a siloxy group, an acyloxy group, a carbamoyloxy group, etc.; those substituted through a nitrogen atom such as of a nitro group, an amino (including a dialkylamino group, etc.), a sulfamoylamino group, an alkoxycarbonylamino group, an aryloxycarbonylamino group, an acylamino group, a sulfonamide group, an imide group, an ureido group, etc.; those substituted through a sulfur atom such as of an alkylthio group, an arylthio group, a heterocyclicthio group, a sulfonyl group, a sulfinyl group, a sulfamoyl group, etc.; and those substituted through a phosphorus atom such as of a phosphonyl group, etc.].

More specifically, there may be included, for example, a methyl group, an ethyl group, an isopropyl group, a t-butyl group, a pentadecyl group, a heptadecyl group, a l-hexynonyl group, a 1,1'-dipentylnonyl group, a 2-chloro-t-butyl group, a trifluoromethyl group, a l-ethoxytridecyl group, a l-methoxyisopropyl group, a methanesulfonylethyl group, a 2,4-di-t-amylphenoxymethyl group, an anilino group, a l-phenylisopropyl group, a 3-m-butanesulfoneaminophenoxypropyl group, a 3,4'-{α-[4''-(p-hydroxybenzensulfonyl)phenoxy]dodecanoylamino}phenylpropyl group, a 3{4'-[α-(2'',4''-di-t-amylphenoxy)butaneamido]phenyl}propyl group, a 4-[α-(o-chlorophenoxy)tetradecaneamidophenoxy]propyl group, an allyl group, a cyclopentyl group, a cyclohexyl group, and so on.

The aryl group represented by R may preferably be a phenyl group, which may also have a substituent (e.g. an alkyl group, an alkoxy group, an acylamino group, etc.).

More specifically, there may be included a phenyl group, a 4-t-butylphenyl group, a 2,4-di-t-amylphenyl group, a 4-tetradecaneamidophenyl group, a hexadecyloxyphenyl group, a 4'-[α-(4''-t-butylphenoxy)tetradecaneamido]phenyl group and the like.

The heterocyclic group represented by R may preferably be a 5- to 7-membered ring, which may either be substituted or fused. More specifically, a 2-furyl group, a 2-thienyl group, a 2-pyrimidinyl group, a 2-benzothiazolyl group, etc. may be mentioned.

The acyl group represented by R may be, for example, an alkylcarbonyl group such as an acetyl group, a phenylacetyl group, a dodecanoyl group, an α-2,4-di-t-amylphenoxybutanoyl group and the like; an arylcarbonyl group such as a benzoyl group, a 3-pentadecyloxybenzoyl group, a p-chlorobenzoyl group and the like.

The sulfonyl group represented by R may include alkylsulfonyl groups such as a methylsulfonyl group, a dodecylsulfonyl group and the like; arylsulfonyl groups such as a benzenesulfonyl group, a p-toluenesulfonyl group and the like.

Examples of the sulfinyl group represented by R are alkylsulfinyl groups such as an ethylsulfinyl group, an octylsulfinyl group, a 3-phenoxybutylsulfinyl group and the like; arylsulfinyl groups such as a phenylsulfinyl group, a m-pentadecylphenylsulfinyl group and the like.

The phosphonyl group represented by R may be exemplified by alkylphosphonyl groups such as a butyloctylphoshonyl group and the like; alkoxyphosphonyl groups such as an octyloxyphosphonyl group and the like; aryloxyphosphonyl groups such as a phenoxyphosphonyl group and the like; and arylphosphonyl groups such as a phenylphosphonyl group and the like.

The carbamoyl group represented by R may be substituted by an alkyl group, an aryl group (preferably a phenyl group), etc., including, for example, an N-methylcarbamoyl group, an N,N-dibutylcarbamoyl group, an N-(2-pentadecyloctylethyl)carbamoyl group, an N-ethyl-N-dodecylcarbamoyl group, an N-{3-(2,4-di-t-amylphenoxy)propyl}carbamoyl group and the like.

The sulfamoyl group represented by R may be substituted by an alkyl group, an aryl group (preferably a phenyl group), etc., including, for example, an N-propylsulfamoyl group, an N,N-diethylsulfamoyl group, an N-(2-pentadecyloxyethyl)sulfamoyl group, an N-ethyl-N-dodecylsulfamoyl group, an N-phenylsulfamoyl group and the like.

The spiro compound residue represented by R may be, for example, spiro[3.3]heptan-l-yl and the like.

The bridged hydrocarbon residual group represented by R may be, for example, bicyclo[2.2.1]heptan-l-yl, tricyclo[3.3.1.1$^{3,7}$]decan-l-yl, 7,7-dimethylbicyclo[2.2.1-]heptan-l-yl and the like.

The alkoxy group represented by R may be substituted by those as mentioned above as substituents for alkyl groups, including a methoxy group, a propoxy group, a 2-ethoxyethoxy group, a pentadecyloxy group, a 2-dodecyloxyethoxy group, a phenethyloxyethoxy group and the like.

The aryloxy group represented by R may preferably be a phenyloxy group of which the aryl nucleus may be further substituted by those as mentioned above as substituents or atoms for the aryl groups, including, for example, a phenoxy group, a p-t-butylphenoxy group, a m-pentadecylphenoxy group and the like.

The heterocyclicoxy group represented by R may preferably be one having a 5- to 7-membered hetero ring, which hetero ring may further have substituents, including a 3,4,5,6-tetrahydropyranyl-2-oxy group, a 1-phenyltetrazole-5-oxy group and the like.

The siloxy group represented by R may further be substituted by an alkyl group, etc., including a siloxy group, a trimethylsiloxy group, a triethylsiloxy group, a dimethylbutylsiloxy group and the like.

The acyloxy group represented by R may be exemplified by an alkylcarbonyloxy group, an arylcarbonyloxy group, etc., which may further have substituents, including specifically an acetyloxy group, an α-chloroacetyloxy group, a benzoyloxy and the like.

The carbamoyloxy group represented by R may be substituted by an alkyl group, an aryl group, etc., including an N-ethylcarbamoyloxy group, an N,N-diethylcarbamoyloxy group, an N-phenylcarbamoyloxy group and the like.

The amino group represented by R may be substituted by an alkyl group, an aryl group (preferably a phenyl group), etc., including an ethylamino group, an anilino group, a m-chloroanilino group, a 3-pentadecyloxycarbonylanilino group, a 2-chloro-5-hexadecaneamidoanilino group and the like.

The acylamino group represented by R may include an alkylcarbonylamino group, an arylcarbonylamino group (preferably a phenylcarbonylamino group), etc., which may further have substituents, specifically an acetamide group, an α-ethylpropaneamide group, an N-phenylacetamide group, a dodecaneamide group, a 2,4-di-t-amylphenoxyacetoamide group, an α-3-t-butyl-4-hydroxyphenoxybutaneamide group and the like.

The sulfonamide group represented by R may include an alkylsulfonylamino group, an arylsulfonylamino group, etc., which may further have substituents, specifically a methylsulfonylamino group, a pentadecylsulfonylamino group, a benzenesulfonamide group, a p-toluenesulfonamide group, a 2-methoxy-5-amylbenzenesulfonamide and the like.

The imide group represented by R may be either open-chained or cyclic, which may also have substituents, as exemplified by a succinimide group, a 3-heptadecylsuccinimide group, a phthalimide group, a glutarimide group and the like.

The ureido group represented by R may be substituted by an alkyl group, an aryl group (preferably a phenyl group), etc., including an N-ethylureido group, an N-methyl-N-decylureido group, an N-phenylureido group, an N-p-tolylureido group and the like.

The sulfamoylamino group represented by R may be substituted by an alkyl group, an aryl group (preferably a phenyl group), etc., including an N,N-dibutylsulfamoylamino group, an N-methylsulfamoylamino group, an N-phenylsulfamoylamino group and the like.

The alkoxycarbonylamino group represented by R may further have substituents, including a methoxycarbonylamino group, a methoxyethoxycarbonylamino group, an octadecyloxycarbonylamino group and the like.

The aryloxycarbonylamino group represented by R may have substituents, and may include a phenoxycarbonylamino group, a 4-methylphenoxycarbonylamino group and the like.

The alkoxycarbonyl group represented by R may further have substituents, and may include a methoxycarbonyl group, a butyloxycarbonyl group, a dodecyloxycarbonyl group, an octadecyloxycarbonyl group, an ethoxymethoxycarbonyloxy group, an benzyloxycarbonyl group and the like.

The aryloxycarbonyl group represented by R may further have substituents, and may include a phenoxycarbonyl group, a p-chlorophenoxycarbonyl group, a m-pentadecyloxyphenoxycarbonyl group and the like.

The alkylthio group represented by R may further have substituents, and may include an ethylthio group, a dodecylthio group, an octadecylthio group, a phnethylthio group, a 3-phenoxypropylthio group and the like.

The arylthio group represented by R may preferably be a phenylthio group, which may further have substituents, and may include, for example, a phenylthio group, a p-methoxyphenylthio group, a 2-t-octylphenylthio group, a 3-octadecylphenylthio group, a 2-carboxyphenylthio group, a p-acetaminophenylthio group and the like.

The heterocyclicthio group represented by R may preferably be a 5- to 7-membered heterocyclicthio group, which may further have a fused ring or have substituents, including, for example, a 2-pyridylthio group, a 2-benzothiazolylthio group, a 2,4-di-phenoxy-1,3,5-triazole-6-thio group and the like.

The atom eliminable through the reaction with the oxidized product of a color developing agent represented by X may include halogen atoms (e.g. a chlorine atom, a bromine atom, a fluorine atom, etc.) and also groups substituted through a carbon atom, an oxygen atom, a sulfur atom or a nitrogen atom.

The group substituted through a carbon atom may include the groups represented by the formula:

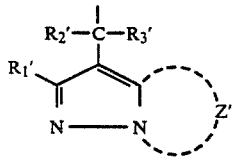

wherein $R_1'$ has the same meaning as the above R, Z' has the same meaning as the above Z, $R_2'$ and $R_3'$ each represent a hydrogen atom, an aryl group, an alkyl group or a heterocyclic group, a hydroxymethyl group and a triphenylmethyl group.

The group substituted through an oxygen atom may include an alkoxy group, an aryloxy group, a heterocyclicoxy group, an acyloxy group, a sulfonyloxy group, an alkoxycarbonyloxy group, an aryloxycarbonyloxy group, an alkyloxalyloxy group, an alkoxyoxalyloxy groups.

Said alkoxy group may further have substituents, including an ethoxy group, a 2-phenoxyethoxy group, a 2-cyanoethoxy group, a phenethyloxy group, a p-chlorobenzyloxy group and the like.

Said aryloxy group may preferably be a phenoxy group, which aryl group may further have substituents. Specific examples may include a phenoxy group, a 3-methylphenoxy group, a 3-dodecylphenoxy group, a 4-methanesulfonamidophenoxy group, a 4-[α-(3'-pentadecylphenoxy)butaneamido]phenoxy group, a hexadecylcarbamoylmethoxy group, a 4-cyanophenoxy group, a 4-methanesulfonylphenoxy group, a 1-naphthyloxy group, a p-methoxyphenoxy group and the like.

Said heterocyclicoxy group may preferably be a 5- to 7-membered heteroxyclicoxy group, which may be a fused ring or have substituents. Specifically, a 1-phenyltetrazolyloxy group, a 2-benzothiazolyloxy group and the like may be included.

Said acyloxy group may be exemplified by an alkylcarbonyloxy group such as an acetoxy group, a butanoyloxy group, etc.; an alkenylcarbonyloxy group such as a cinnamoyloxy group; an arylcarbonyloxy group such as a benzoyloxy group.

Said sulfonyloxy group may be, for example, a butanesulfonyloxy group, a methanesulfonyloxy group and the like.

Said alkoxycarbonyloxy group may be, for example, an ethoxycarbonyloxy group, a benzyloxycarbonyloxy group and the like.

Said aryloxycarbonyl group may be, for example, a phenoxycarbonyloxy group and the like.

Said alkyloxalyloxy group may be, for example, a methyloxalyloxy group.

Said alkoxyoxalyloxy group may be, for example, an ethoxyoxalyloxy group and the like.

The group substituted through a sulfur atom may include an alkylthio group, an arylthio group, a heterocyclicthio group, an alkyloxythiocarbonylthio groups.

Said alkylthio group may include a butylthio group, a 2-cyanoethylthio group, a phenethylthio group, a benzylthio group and the like.

Said arylthio group may include a phenylthio group, a 4-methanesulfonamidophenylthio group, a 4-dodecylphenethylthio group, a 4-nonafluoropentaneamidophenethylthio group, a 4-carboxyphenylthio group, a 2-ethoxy-5-t-butylphenylthio group and the like.

Said heterocyclicthio group may be, for example, a 1-phenyl-1,2,3,4-tetrazolyl-5-thio group, a 2-benzothiazolylthio group and the like.

Said alkyloxythiocarbonylthio group may include a dodecyloxythiocarbonylthio group and the like.

The group substituted through a nitrogen atom may include, for example, those represented by the formula:

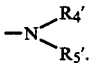

Here, $R_4'$ and $R_5'$ each represent a hydrogen atom, an alkyl group, an aryl group, a heterocyclic group, a sulfamoyl group, a carbamoyl group, an acyl group, a sulfonyl group, an aryloxycarbonyl group or an alkoxycarbonyl group. $R_4'$ and $R_5'$ may be bonded to each other to form a hetero ring. However, $R_4'$ and $R_5'$ cannot both be hydrogen atoms.

Said alkyl group may be either straight or branched, having preferably 1 to 22 carbon atoms. Also, the alkyl group may have substituents such as an aryl group, an alkoxy group, an aryloxy group, an alkylthio group, an arylthio group, an alkylamino group, an arylamino group, an acylamino group, a sulfonamide group, an imino group, an acyl group, an alkylsulfonyl group, an arylsulfonyl group, a carbamoyl group, a sulfamoyl group, an alkoxycarbonyl group, an aryloxycarbonyl group, an alkyloxycarbonylamino group, an aryloxycarbonylamino group, a hydroxyl group, a carboxyl group, a cyano group, halogen atoms, etc. Typical examples of said alkyl group may include an ethyl group, an octyl group, a 2-ethylhexyl group, a 2-chloroethyl group and the like.

The aryl group represented by $R_4'$ or $R_5'$ may preferably have 6 to 32 carbon atoms, particularly a phenyl group or a naphthyl group, which aryl group may also have substituents such as those as mentioned above for substituents on the alkyl group represented by $R_4'$ or $R_5'$ and alkyl groups. Typical examples of said aryl group may be, for example, a phenyl group, a 1-naphtyl group, a 4-methylsulfonylphenyl group and the like.

The heterocyclic group represented by $R_4'$ or $R_5'$ may preferably a 5- or 6-membered ring, which may be a fused ring or have substituents. Typical examples may include a 2-furyl group, a 2-quinolyl group, a 2-pyrimidyl group, a 2-benzothiazolyl group, a 2-pyridyl group and the like.

The sulfamoyl group represented by $R_4'$ or $R_5'$ may include an N-alkylsulfamoyl group, an N,N-dialkylsulfamoyl group, an N-arylsulfamoyl group, an N,N-diarylsulfamoyl group and the like, and these alkyl and aryl groups may have substituents as mentioned above for the alkyl groups and aryl groups. Typical examples of the sulfamoyl group are, for example, an N,N-diethylsulfamoyl group, an N-methylsulfamoyl group, an N-dodecylsulfamoyl group, an N-p-tolylsulfamoyl group and the like.

The carbamoyl group represented by $R_4'$ or $R_5'$ may include an N-alkylcarbamoyl group, an N,N-dialkylcarbamoyl group, an N-arylcarbamoyl group, an N,N-diarylcarbamoyl group and the like, and these alkyl and aryl groups may have substituents as mentioned above for the alkyl groups and aryl groups. Typical examples of the carbamoyl group are an N,N-diethylcarbamoyl group, an N-methylcarbamoyl group, an N-dodecylcarbamoyl group, an N-p-cyanocarbamoyl group, an N-p-tolylcarbamoyl group and the like.

The acyl group represented by $R_4'$ or $R_5'$ may include an alkylcarbonyl group, an arylcarbonyl group, a heterocyclic carbonyl group, which alkyl group, aryl group and heterocyclic group may have substituents. Typical examples of the acyl group are a hexafluorobutanoyl group, a 2,3,4,5,6-pentafluorobenzoyl group, an acetyl group, a benzoyl group, a naphthoyl group, a 2-furylcarbonyl group and the like.

The sulfonyl group represented by $R_4'$ or $R_5'$ may be, for example, an alkylsulfonyl group, an arylsulfonyl group or a heterocyclic sulfonyl group, which may also have substituents, including specifically an ethanesulfonyl group, a benzenesulfonyl group, an octanesulfonyl group, a naphthalenesulfonyl group, a p-chlorobenzenesulfonyl group and the like.

The aryloxycrbonyl group represented by $R_4'$ or $R_5'$ may have substituents as mentioned for the above aryl group, including specifically a phenoxycarbonyl group and the like.

The alkoxycarbonyl group represented by $R_4'$ or $R_5'$ may have substituents as mentioned for the above alkyl group, and its specific examples are a methoxycarbonyl group, a dodecyloxycarbonyl group, a benzyloxycarbonyl group and the like.

The heterocyclic ring formed by bonding between $R_4'$ and $R_5'$ may preferably be a 5- or 6-membered ring, which may be either saturated or unsaturated, either has aromaticity or not, or may also be a fused ring. Said heterocyclic ring may include, for example, an N-phthalimide group, an N-succinimide group, a 4-N-urazolyl group, a 1-N-hydantoinyl group, a 3-N-2,4-dioxooxazolidinyl group, a 2-N-1,1-dioxo-3-(2H)-oxo-1,2-benzthiazolyl group, a 1-pyrrolyl group, a 1-pyrrolidinyl group, a 1-pyrazolyl group, a 1-pyrazolidinyl group, a 1-piperidinyl group, a 1-pyrrolinyl group, a 1-imidazolyl group, a 1-imidazolinyl group, a 1-indolyl group, a 1-isoindolinyl group, a 2-isoindolyl group, a 2-isoindolinyl group, a 1-benzotriazolyl group, a 1-benzoimidazolyl group, a 1-(1,2,4-triazolyl) group, a 1-(1,2,3-triazolyl) group, a 1-(1,2,3,4-tetrazolyl) group, an N-morpholinyl group, a 1,2,3,4-tetrahydroquinolyl group, a 2-oxo-1-pyrrolidinyl group, a 2-1H-pyrridone group, a phthaladione group, a 2-oxo-1-piperidinyl group, etc. These heterocyclic groups may be substituted by an alkyl group, an aryl group, an alkyloxy group, an aryloxy group, an acyl group, a sulfonyl group, an alkylamino group, an arylamino group, an acylamino group, a sulfonamino group, a carbamoyl group, a sulfamoyl group, an alkylthio group, an arylthio group, an ureido group, an alkoxycarbonyl group, an aryloxycarbonyl group, an imide group, a nitro group, a cyano group, a carboxyl group or halogen atoms.

The nitrogen-containing heterocyclic ring formed by Z and Z' may include a pyrazole ring, a imidazole ring, a triazole ring or a tetrazole ring, and the substituents which may be possessed by the above rings may include those as mentioned for the above R.

When the substituent (e.g. R, $R_1$ to $R_8$) on the heterocyclic ring in the formula (XIV) and the formulae (XV) to (XXI) as hereinafter described has a moiety of the formula:

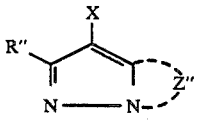

(wherein R", X and Z" have the same meanings as R, X and Z in the formul (XIV)), the so-called bis-form type coupler is formed, which is of course included in the present invention. The ring formed by Z, Z', Z" and $Z_1$ as hereinafter described may also be fused with another ring (e.g. a 5- to 7-membered cycloalkene). For example, $R_5$ and $R_6$ in the formula (XVIII), $R_7$ and $R_8$ in the formula (XIX) may be bonded to each other to form a ring (e.g. a 5- to 7-membered rings).

The compounds represented by the formula (XIV) can be also represented specifically by the following formulae (XV) through (XX).

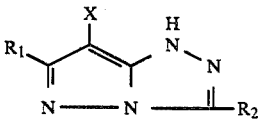

(XV)

-continued

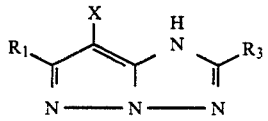

(XVI)

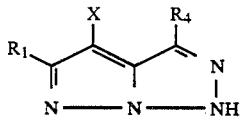

(XVII)

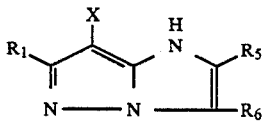

(XVIII)

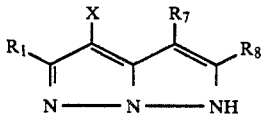

(XIX)

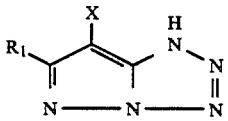

(XX)

In the above formulae (XV) to (XX), $R_1$ to $R_8$ and X have the same meanings as the above R and X.

Of the compounds represented by the formula (XIV), those represented by the following formula (XXI) are preferred.

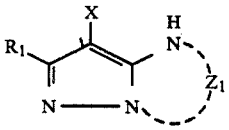

(XXI)

wherein $R_1$, X and $Z_1$ have the same meanings as R, X and Z in the formula (XIV).

Of the magenta couplers represented by the formulae (XV) to (XX), the magenta coupler represented by the formula (XV) is particularly preferred.

To describe about the substituents on the heterocyclic ring in the formulae (XIV) and (XV) to (XXI), R in the formula (XIV) and $R_1$ in the formulae (XV) to (XVII) should preferably satisfy the following condition 1, more preferably satisfy the following conditions 1 and 2, and particularly preferably satisfy the following conditions 1, 2 and 3:

Condition 1: a root atom directly bonded to the heterocyclic ring is a carbon atom, Condition 2: only one of hydrogen atom is bonded to said carbon atom or no hydrogen atom is bonded to it, and Condition 3: the bondings between the root atom and adjacent atoms are all single bonds.

Of the substituents R and $R_1$ on the above heterocyclic ring, most preferred are those represented by the formula (XXII) shown below:

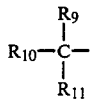

(XXII)

In the above formula, each of $R_9$, $R_{10}$ and $R_{11}$ represents a hydrogen atom, a halogen atom, an alkyl group, a cycloalkyl group, an alkenyl group, a cycloalkenyl group, an alkynyl group, an aryl group, a heterocyclic group, an acyl group, a sulfonyl group, a sulfinyl group, a phosphonyl group, a carbamoyl group, a sulfamoyl group, a cyano group, a spiro compound residual group, a bridged hydrocarbon compound residual group, an alkoxy group, an aryloxy group, a heterocyclicoxy group, a siloxy group, an acyloxy group, a carbamoyloxy group, an amino group, an acylamino group, a sulfonamide group, an imide group, an ureido group, a sulfamoylamino group, an alkoxycarbonylamino group, an aryloxycarbonylamino group, an alkoxycarbonyl group, an aryloxycarbonyl group, an alkylthio group, an arylthio group or a heterocyclicthio group.

Also, at least two of said $R_9$, $R_{10}$ and $R_{11}$, for example, $R_9$ and $R_{10}$ may be bonded together to form a saturated or unsaturated ring (e.g. cycloalkane ring, cycloalkene ring or heterocyclic ring), and further to form a bridged hydrocarbon compound residual group by bonding $R_{11}$ to said ring.

The groups represented by $R_9$ to $R_{11}$ may have substituents, and examples of the groups represented by $R_9$ to $R_{11}$ and the substituents which may be possessed by said groups may include examples of the substituents which may be possessed by the R in the above formula (XIV), and substituents which may be possessed by said substituents.

Also, examples of the ring formed by bonding between $R_9$ and $R_{10}$, the bridged hydrocarbon compound residual group formed by $R_9$ to $R_{11}$ and the substituents which may be possessed thereby may include examples of cycloalkyl, cycloalkenyl and heterocyclic groups as mentioned for substituents on the R in the aforesaid formula (XIV) and substituents thereof.

Of the compounds of the formula (XXII), preferred are:

(i) the case where two of $R_9$ to $R_{11}$ are alkyl groups; and (ii) the case where one of $R_9$ to $R_{11}$, for example, $R_{11}$ is a hydrogen atom and two of the other $R_9$ and $R_{10}$ are bonded together with the root carbon atom to form a cycloalkyl group.

Further, preferred in (i) is the case where two of $R_9$ to $R_{11}$ are alkyl groups and the other one is a hydrogen atom or an alkyl group.

Here, said alkyl and said cycloalkyl may further have substituents, and examples of said alkyl, said cycloalkyl and substituents thereof may include those of alkyl, cycloalkyl and substituents thereof as mentioned for the substituents on the R in the formula (XIV) and the substituents thereof.

The substituents which the ring to be formed by Z in the formula (XIV) and the ring to be formed by $Z_1$ in the formula (XXI) may have, and the substituents $R_2$ to $R_8$ in the formulae (XV) to (XIX), are preferably those represented by the formula (XXIII) shown below:

$$-R^1-SO_2-R^2 \qquad \text{(XXIII)}$$

wherein $R^1$ represents an alkylene group, $R^2$ represents an alkyl group, a cycloalkyl group or an aryl group.

The alkylene represented by $R^1$ preferably has 2 or more, and more preferably 3 to 6 carbon atoms at the straight chain portion, and may be of straight chain or branched structure. Also, this alkylene may have a substituent.

Examples of such substituent may include those shown as the substituents which the alkyl group when R in the formula (XIV) may have.

Preferable substituents may include a phenyl.

Preferable examples for the alkylene represented by $R^1$ are shown below:

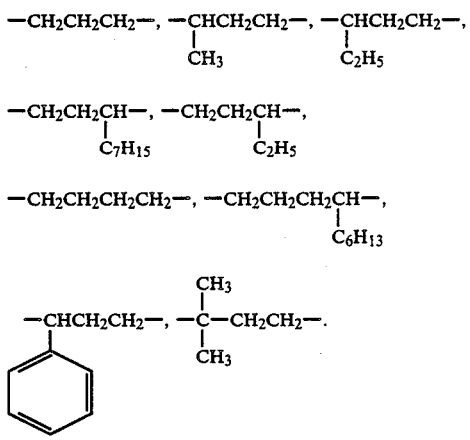

The alkyl group represented by $R^2$ may be of straight chain or branched structure.

Specifically, it may include methyl, ethyl, propyl, iso-propyl, butyl, 2-ethylhexyl, octyl, dodecyl, tetradecyl, hexadecyl, octadecyl, 2-hexyldecyl, etc.

The cycloalkyl group represented by $R^2$ is preferably of 5 to 6 members, and may include, for example, a cyclohexyl group.

The alkyl group and the cycloalkyl group represented by $R^2$ may each have a substituent including, for example, those exemplified as the substituents for the above $R^1$.

The aryl group represented by $R^2$ may specifically include a phenyl group and a naphthyl group. The aryl group may have a substituent. Such a substituent may include, for example, a straight chain or branched alkyl group, and besides, those exemplified as the substituents for the above $R^1$.

Also, when there are two or more substituents, they may be the same or different substituents.

Particularly preferable in the compounds represented by the formula (XIV) are those represented by the formula (XXIV) shown below:

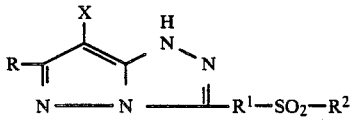

(XXIV)

wherein R and X each have the same meaning as R and X in the formula (XIV), and $R^1$ and $R^2$ each have the same meaning as $R_1$ and $R_2$ in the formula (XIX).

In the following, examples of the magenta coupler of the present invention are enumerated, which are not limitative of the present invention.
1
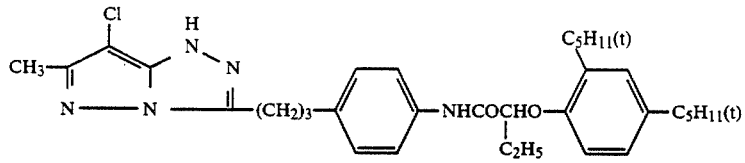
2
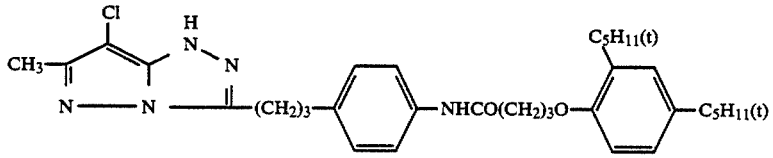
3
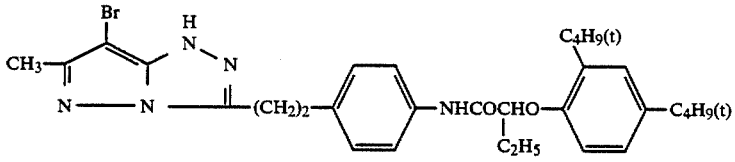
4
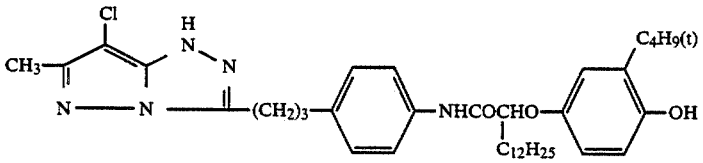
5
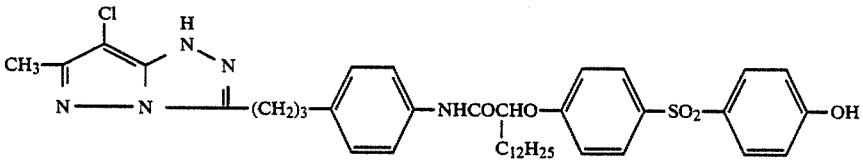
6
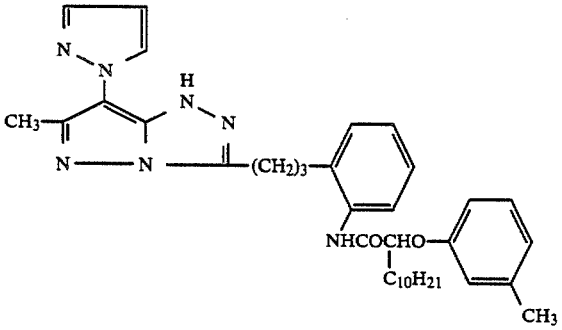
7
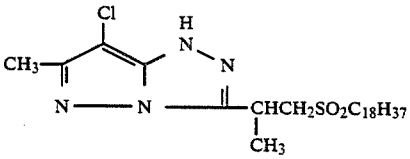
8
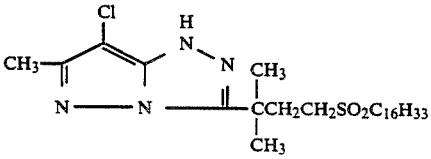

-continued
9
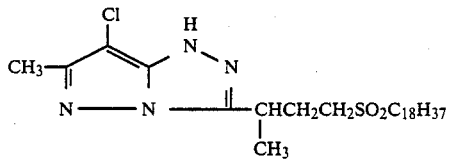
10
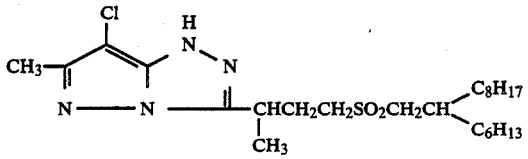
11
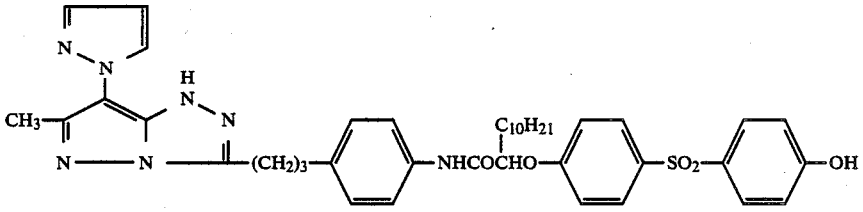
12
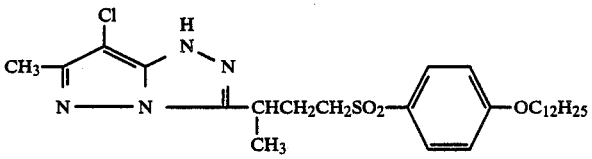
13
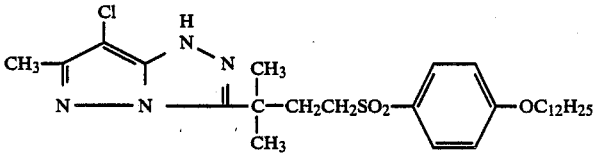
14
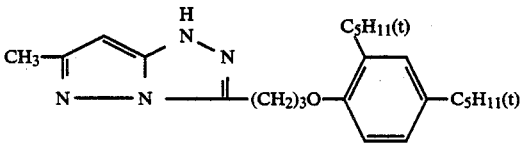
15
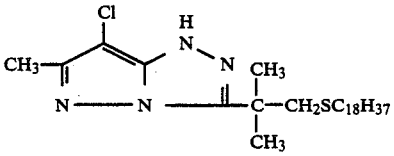
16
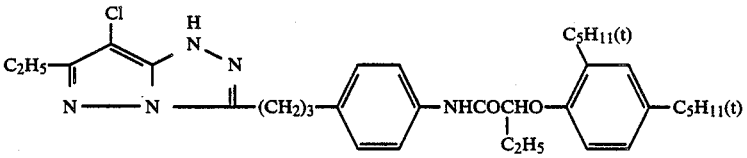

-continued
17
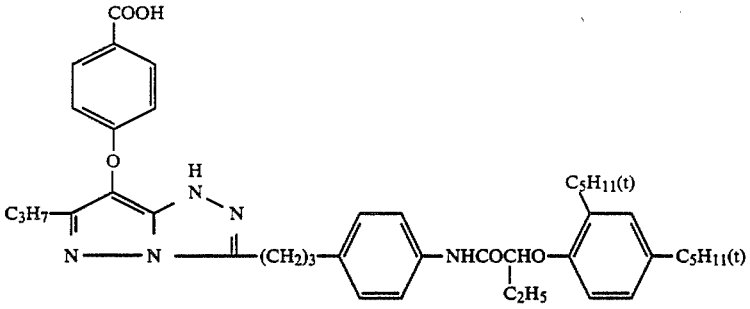
18
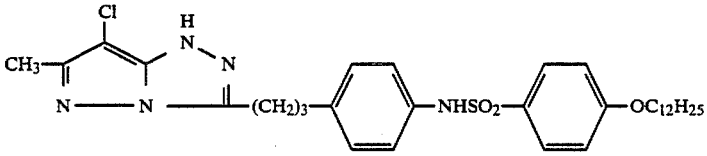
19
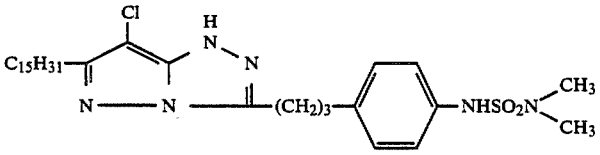
20
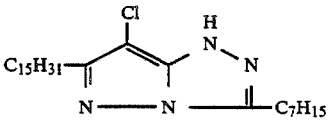
21
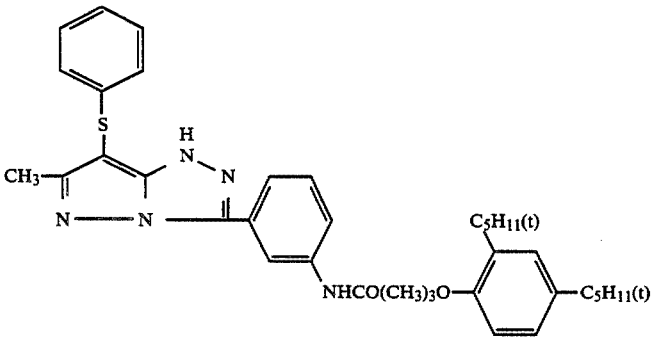
22
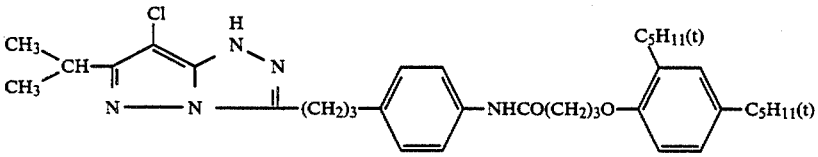
23
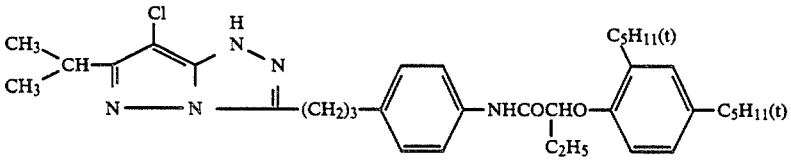
24
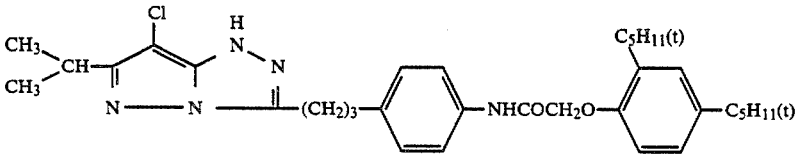

-continued
25
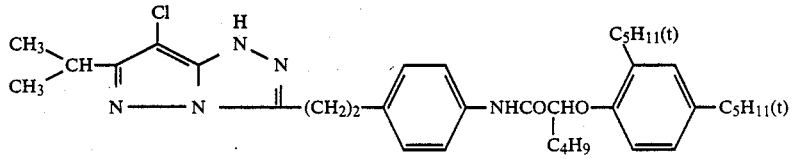
26
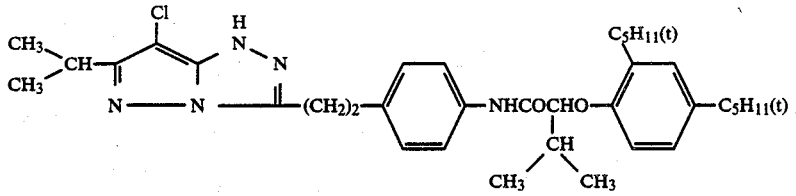
27
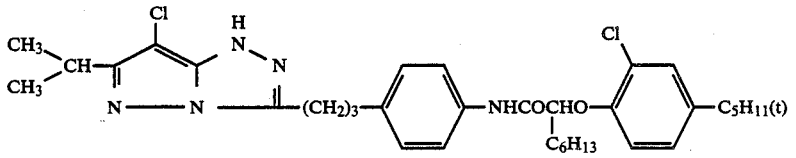
28
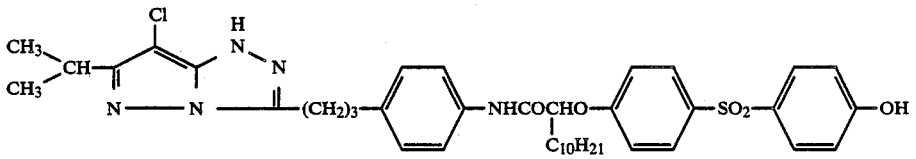
29
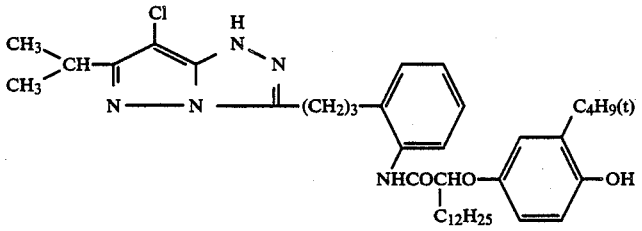
30
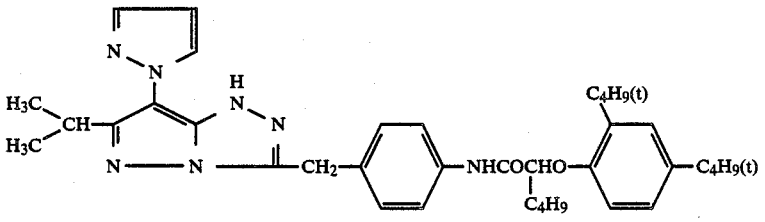
31
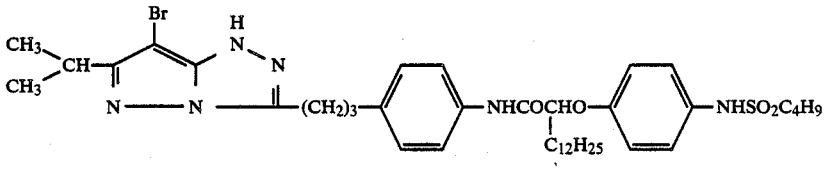
32
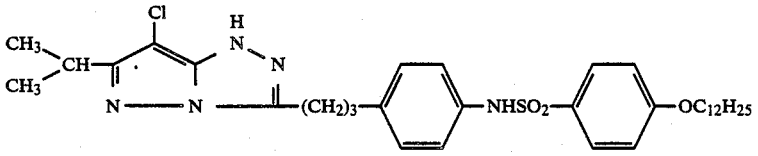
33
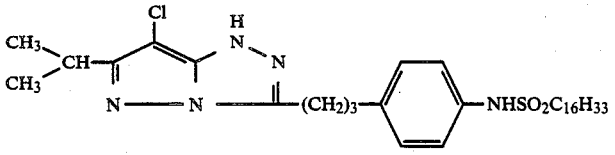

-continued
34
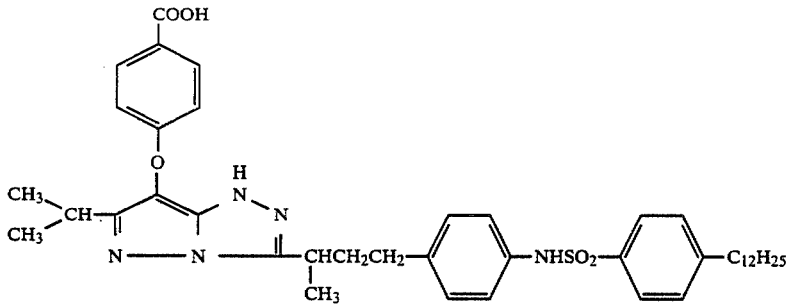
35
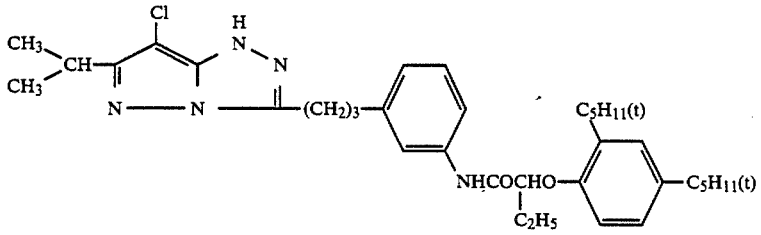
36
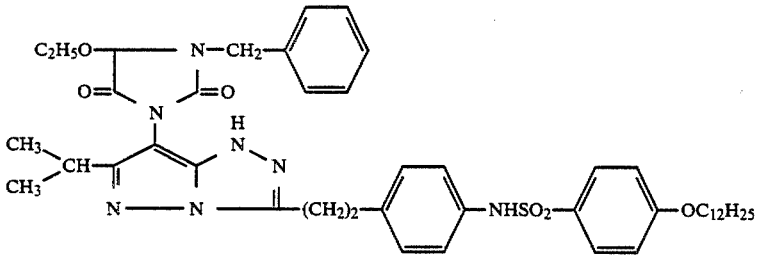
37
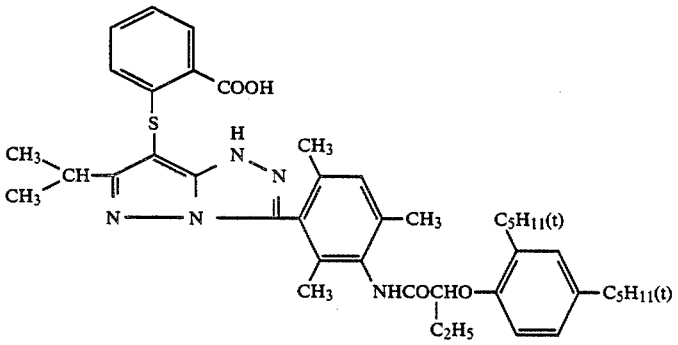
38
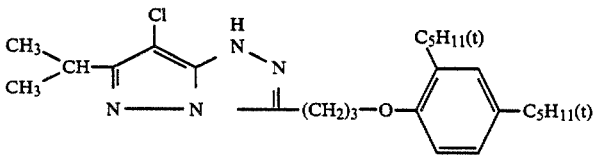
39
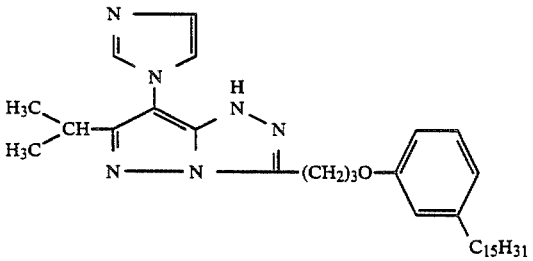

-continued
40
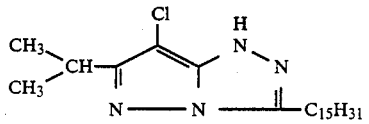
41
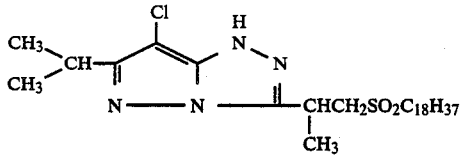
42
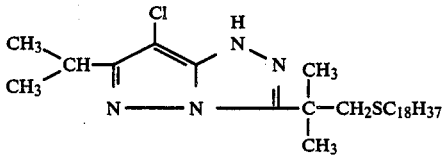
43
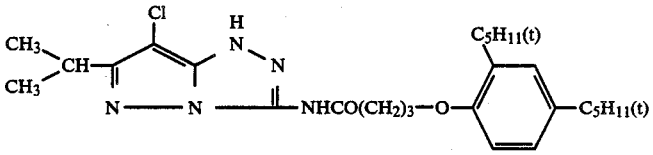
44
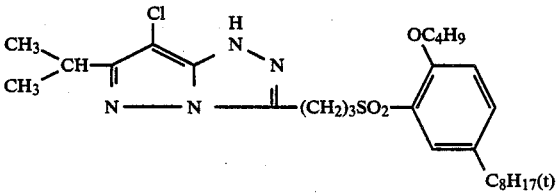
45
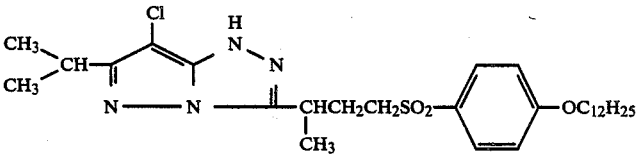
46
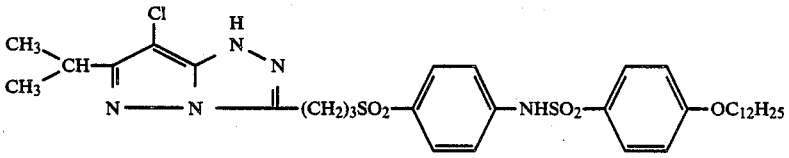
47
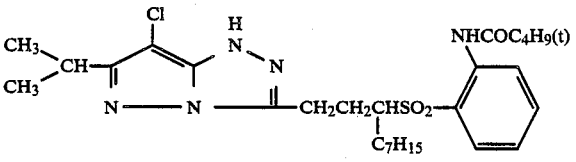
48
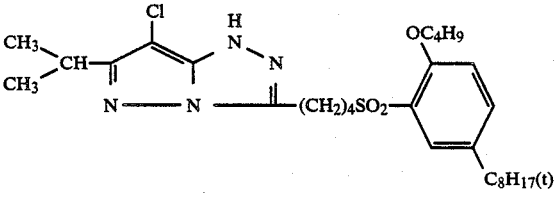

-continued
49
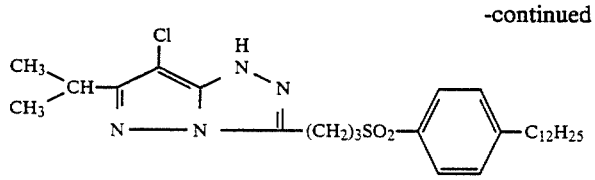
50
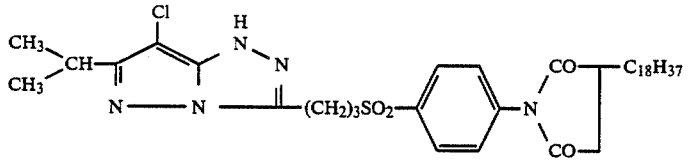
51
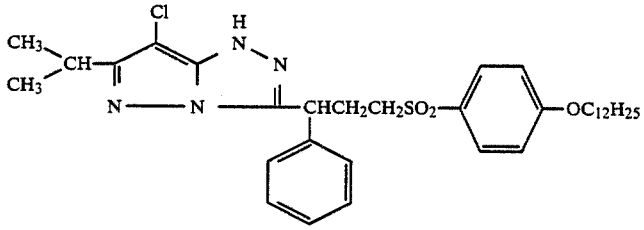
52
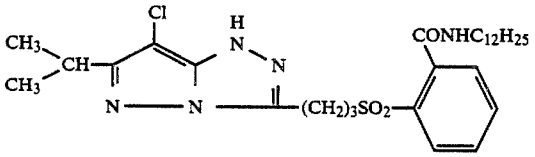
53
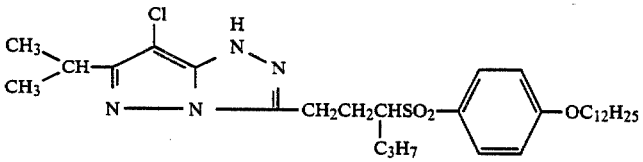
54
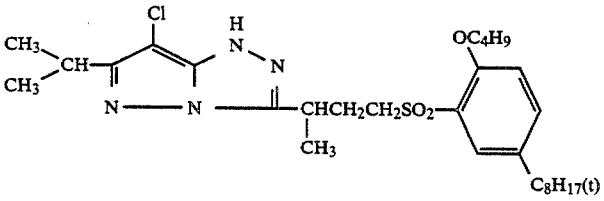
55
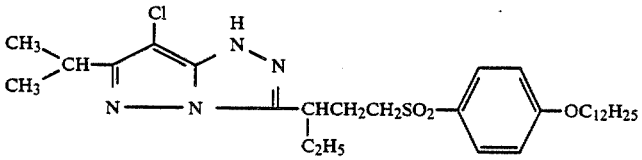
56
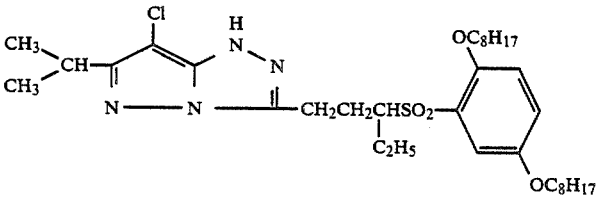
57
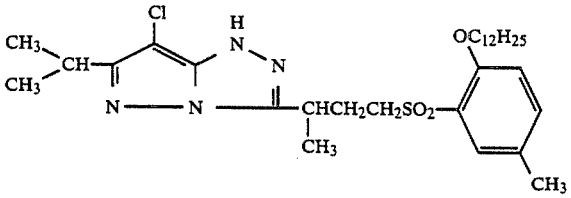

-continued
58
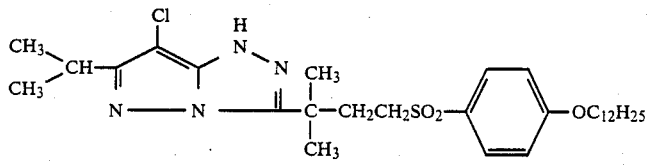
59
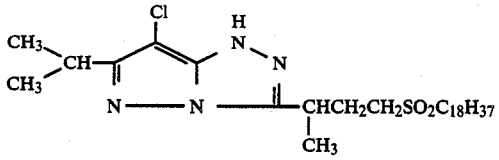
60
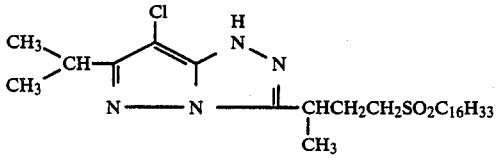
61
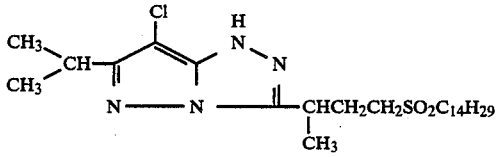
62
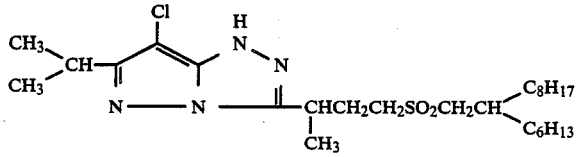
63
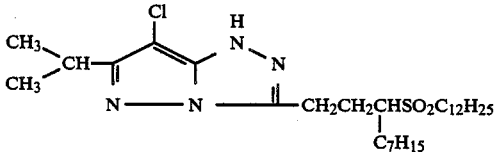
64
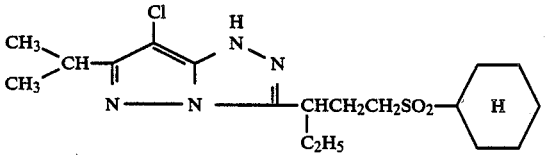
65
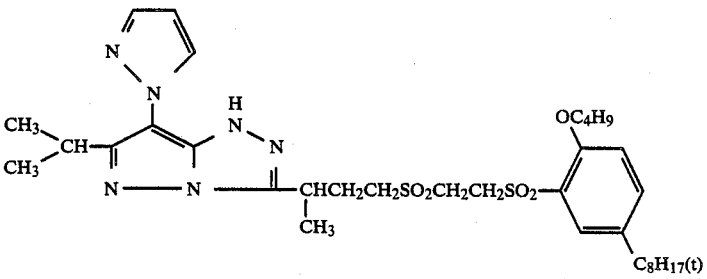
66
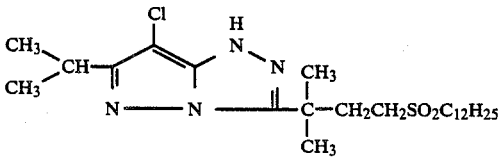

-continued
67
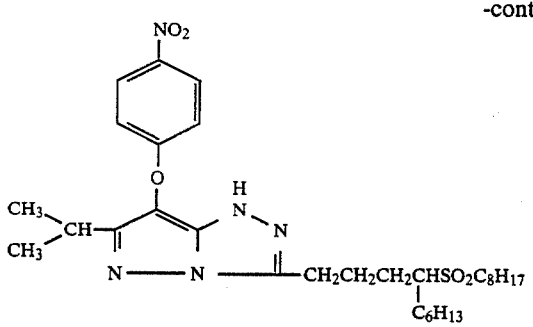
68
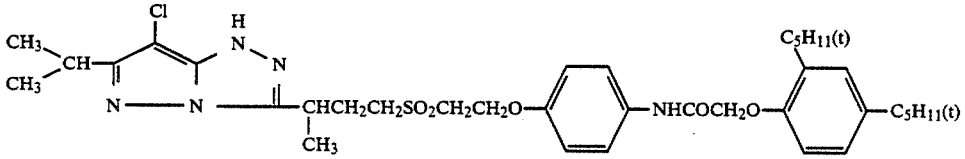
69
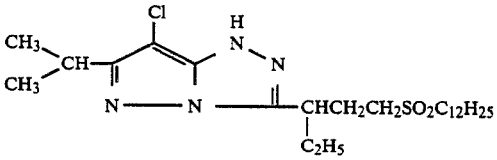
70
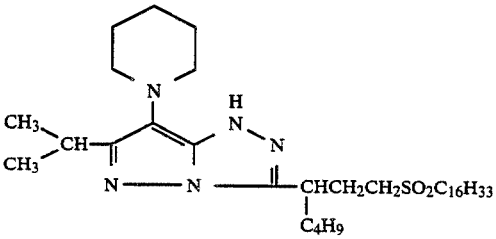
71
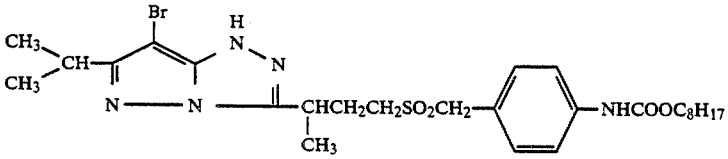
72
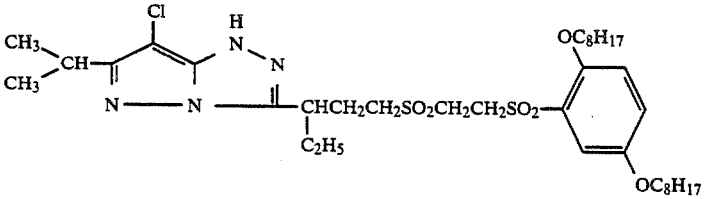
73
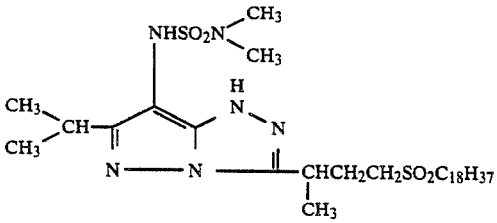
74
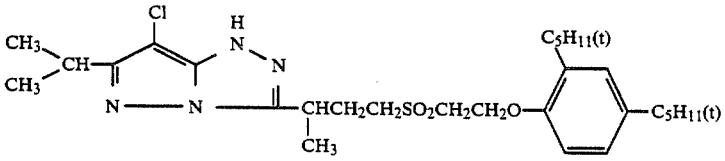

-continued
75
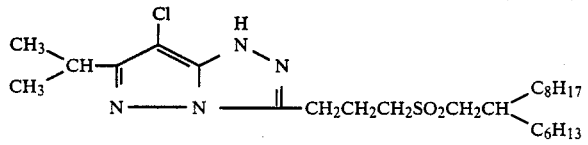
76
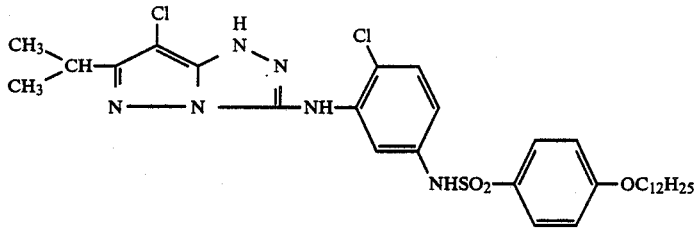
77
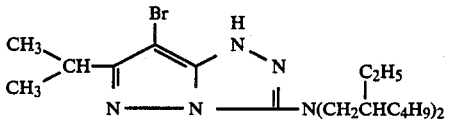
78
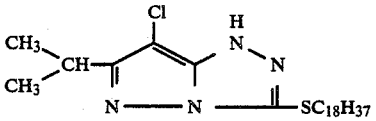
79
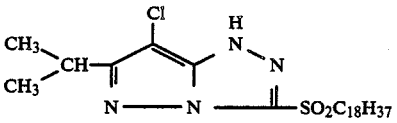
80
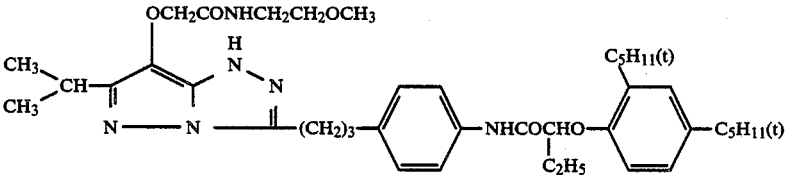
81
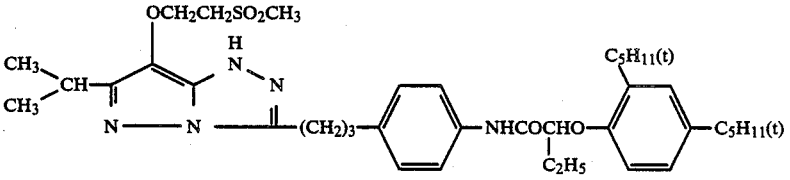
82
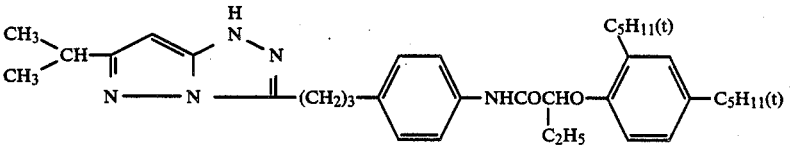
83
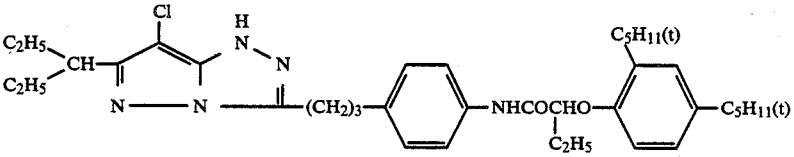
84
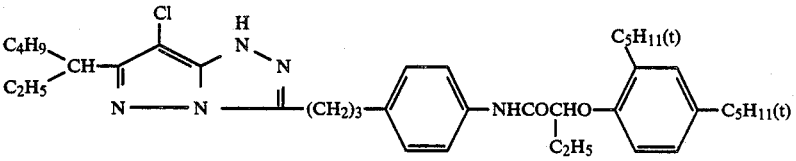

-continued
85
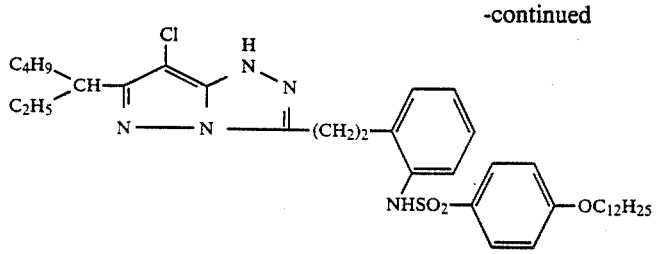
86
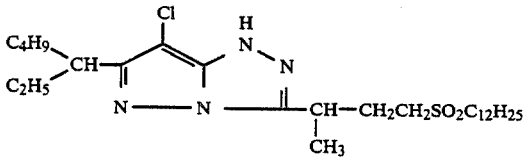
87
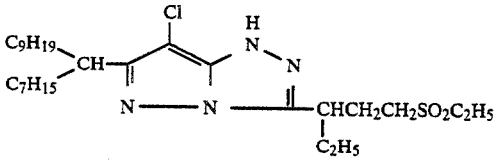
88
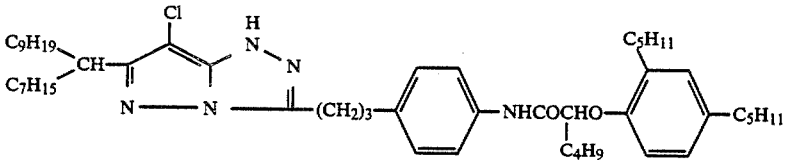
89
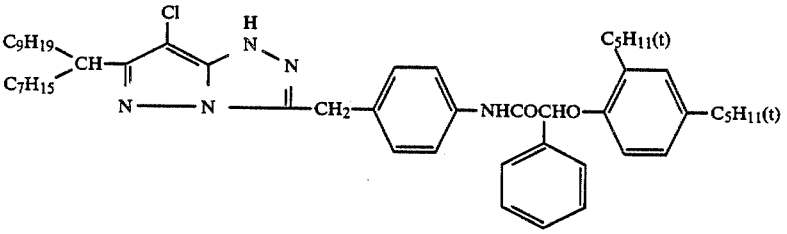
90
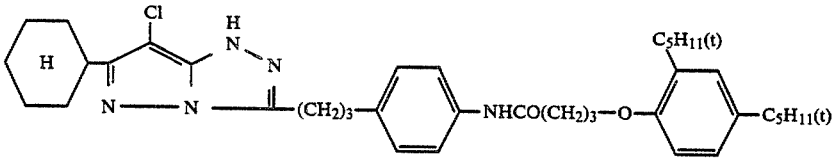
91
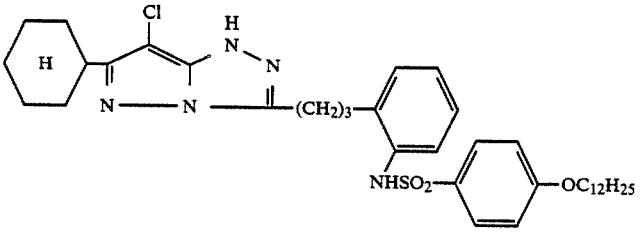
92
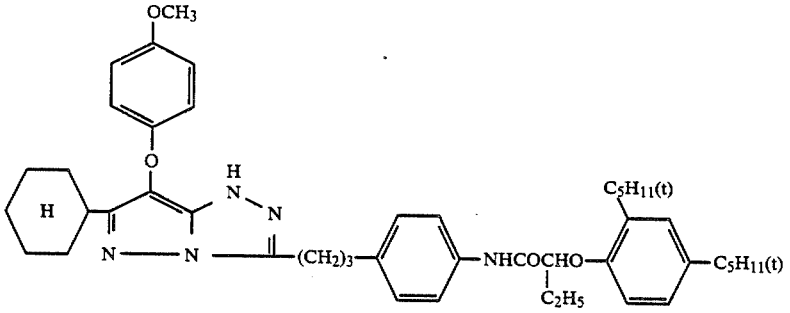

-continued
93
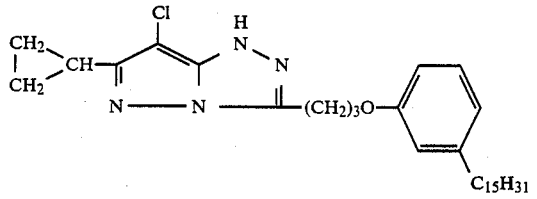
94
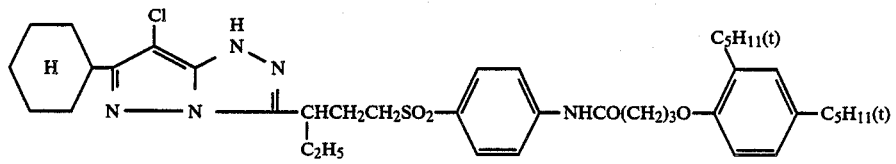
95
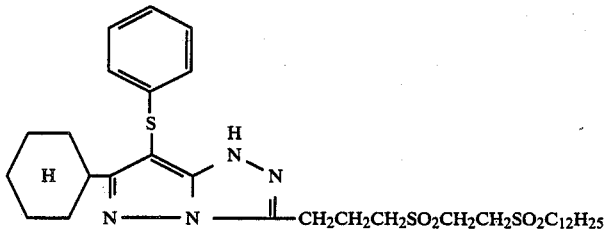
96
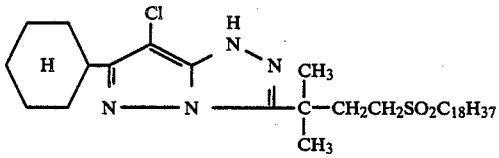
97
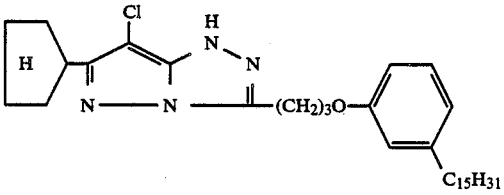
98
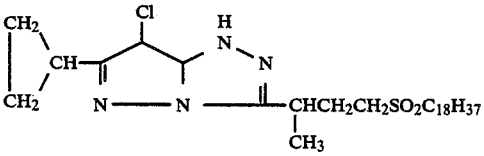
99
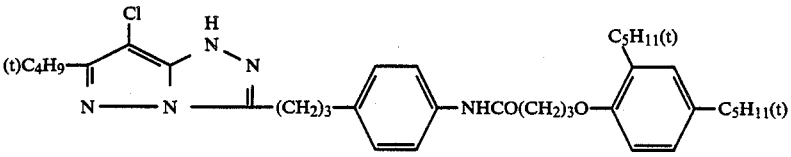
100
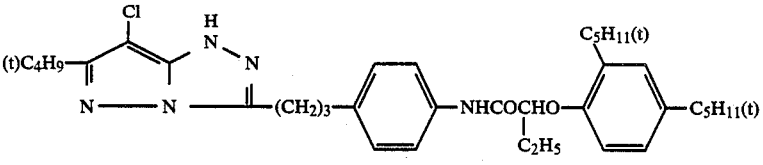
101
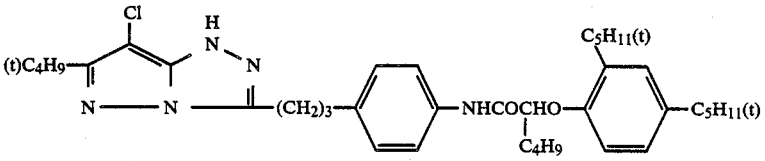

-continued
102
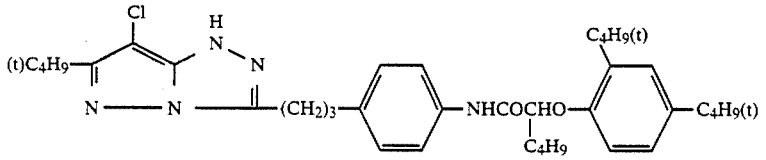
103
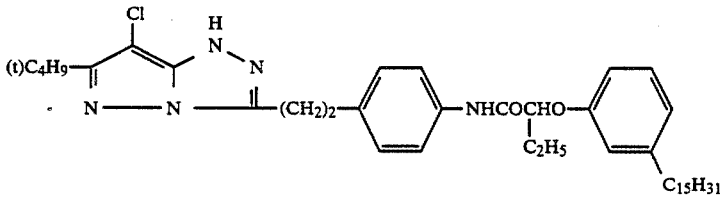
104
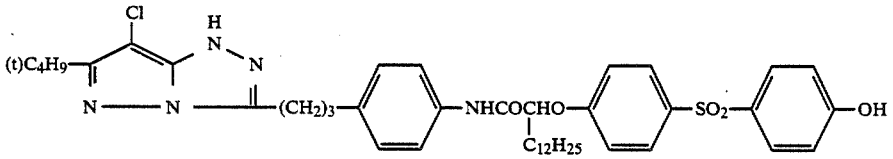
105
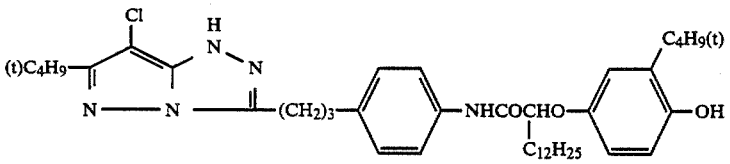
106
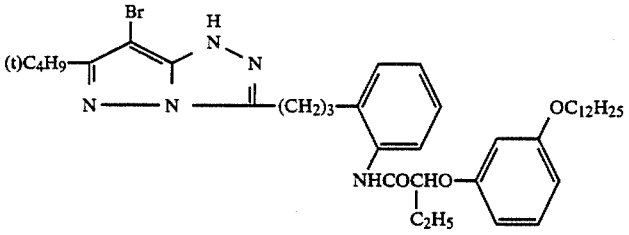
107
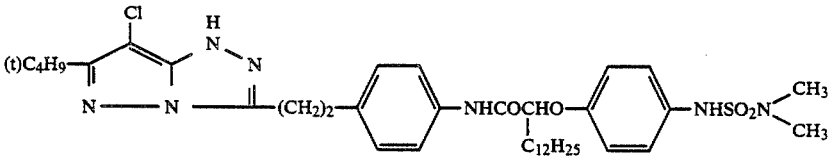
108
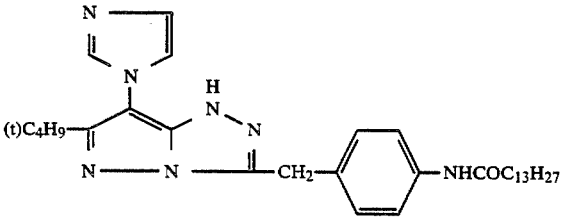
109
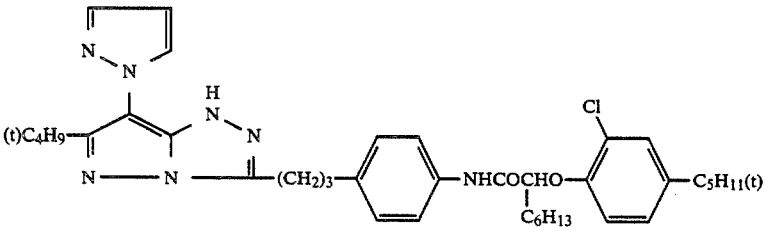

-continued
110
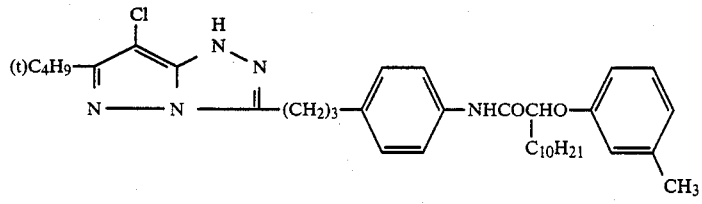
111
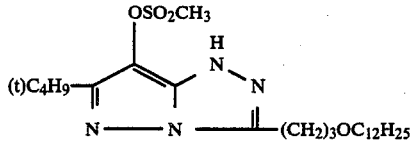
112
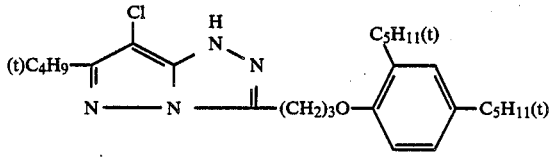
113
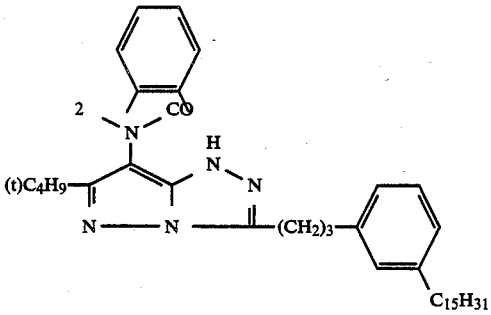
114
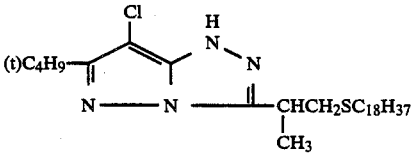
115
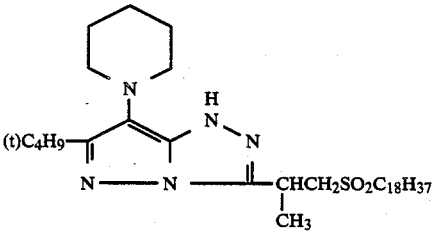
116
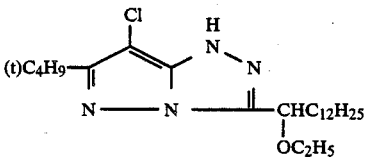
117
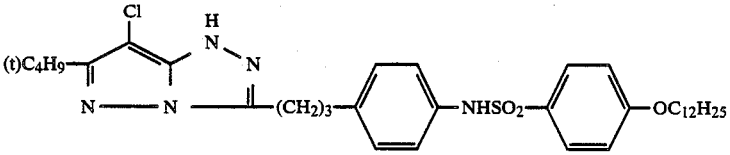

-continued
118
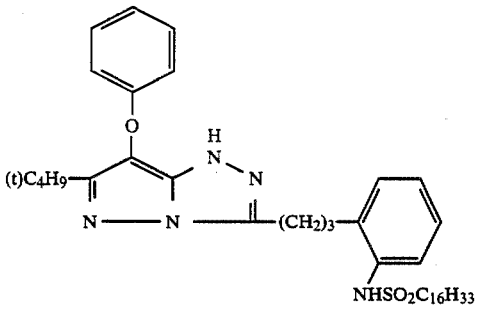
119
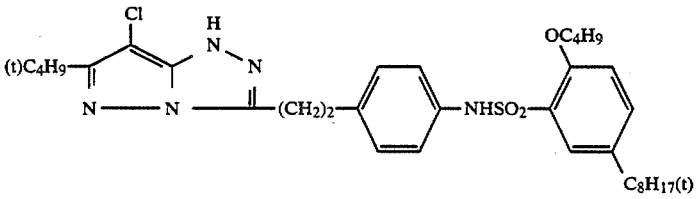
120
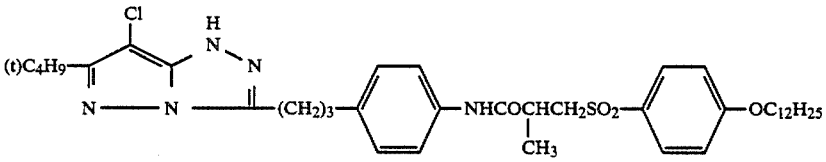
121
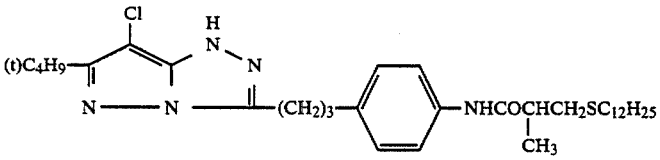
122
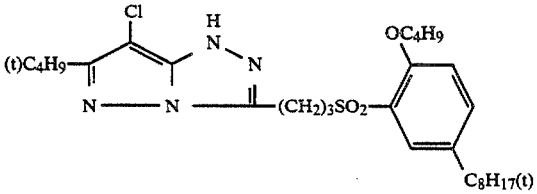
123
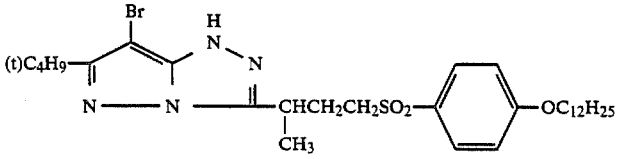
124
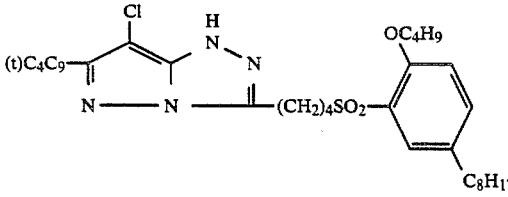

-continued
125
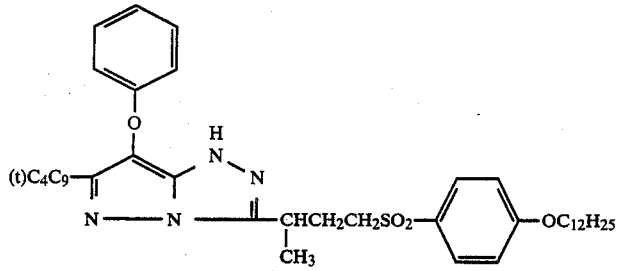
126
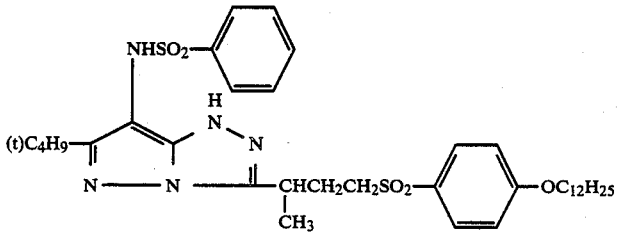
127
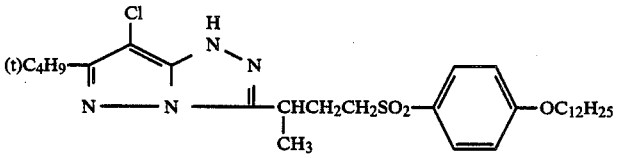
128
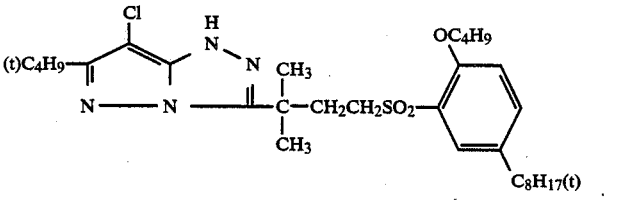
129
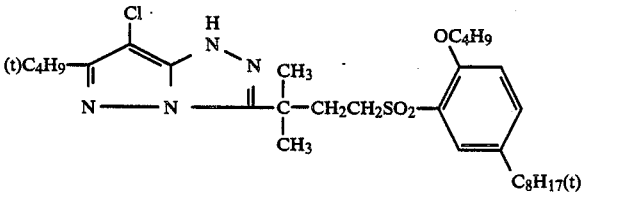
130
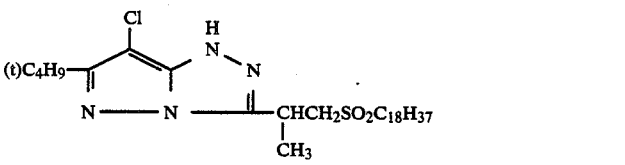
131
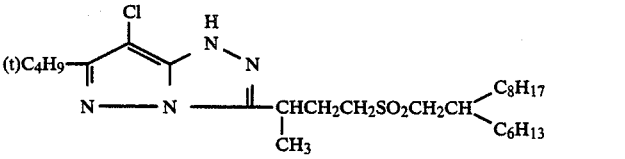
132
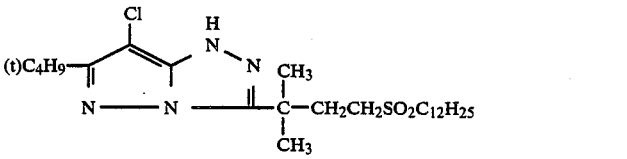

-continued
133
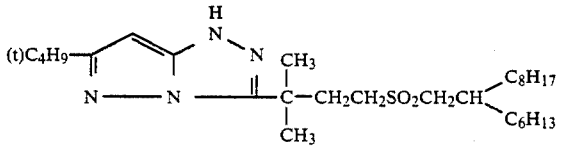
134
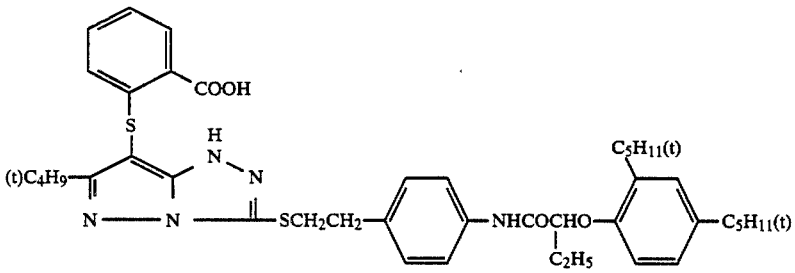
135
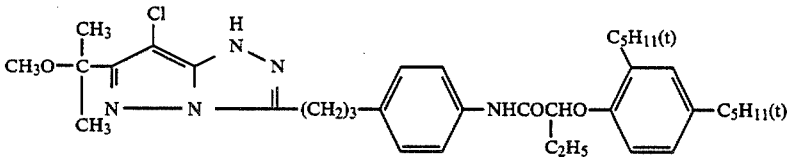
136
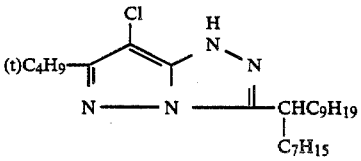
137
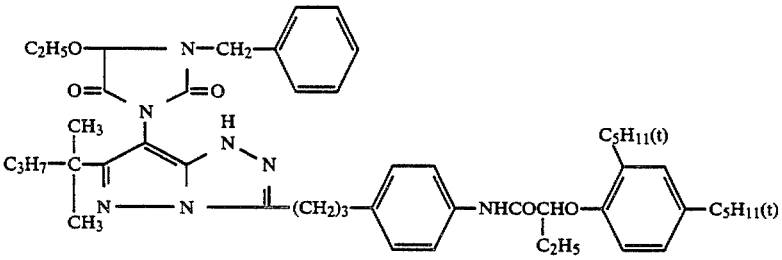
138
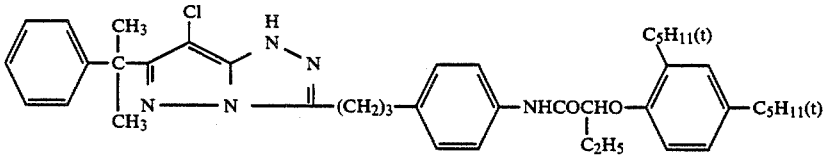
139
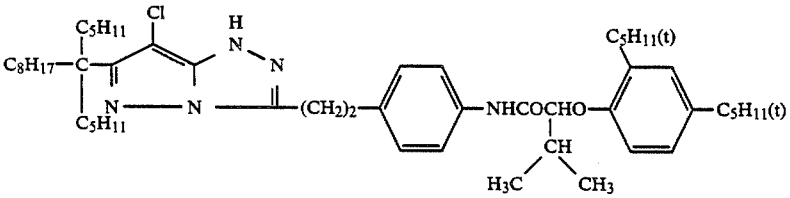
140
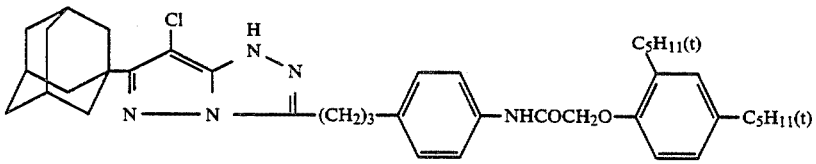

-continued
141
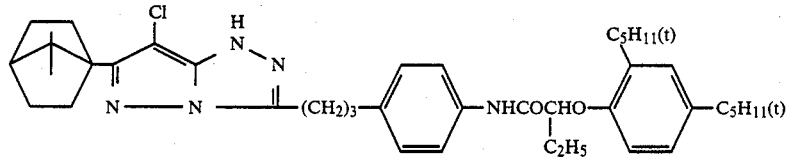
142
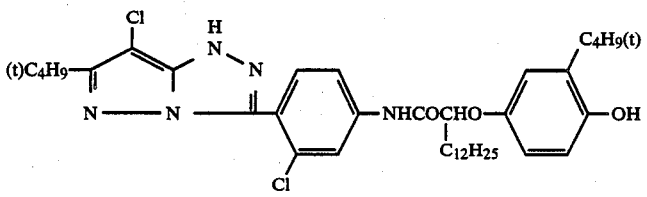
143
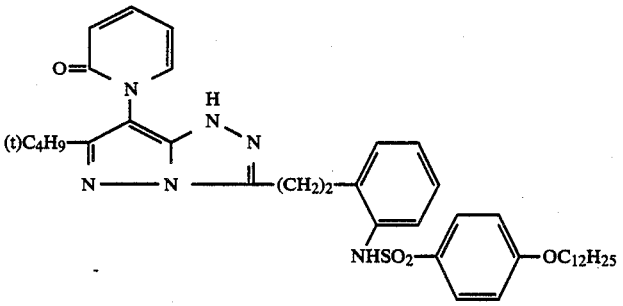
144
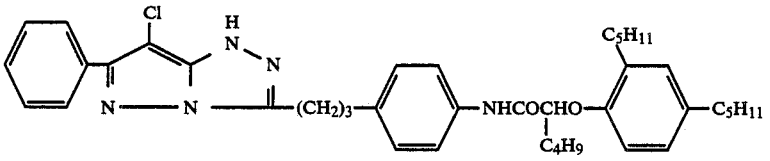
145
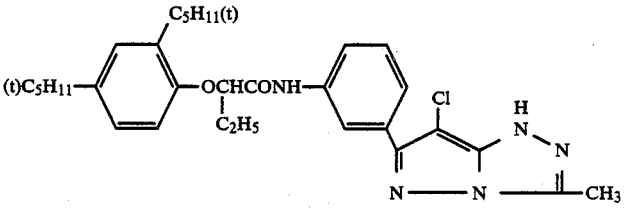
146
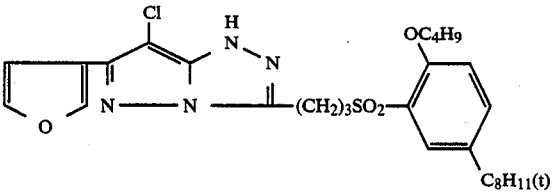
147
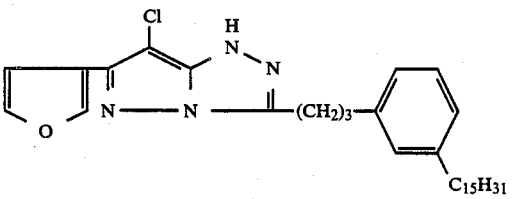

-continued
148
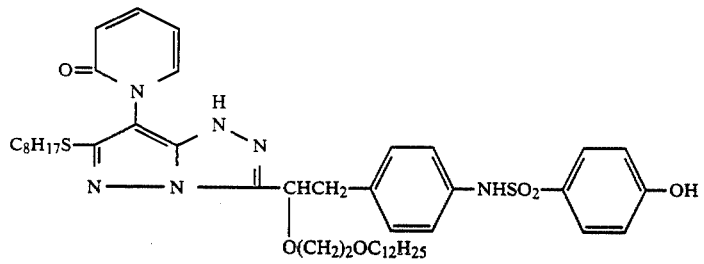
149
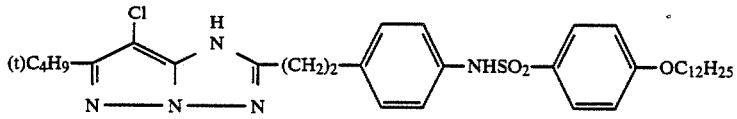
150
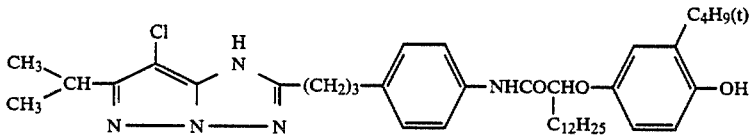
151
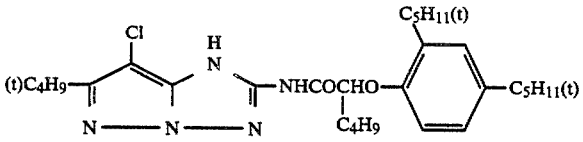
152
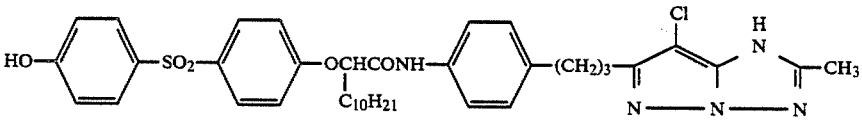
153
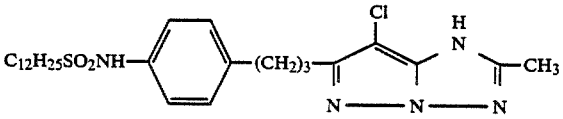
154
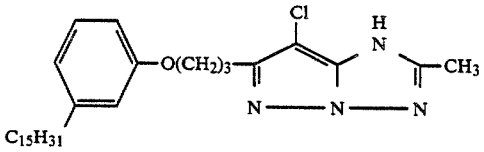
155
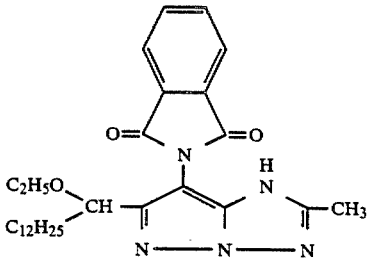
156
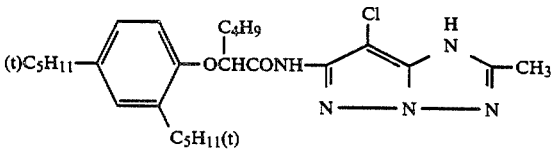

-continued
157
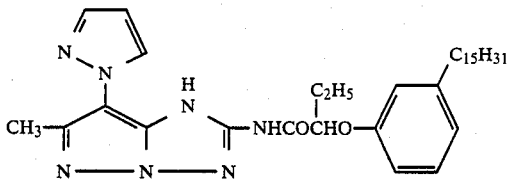
158
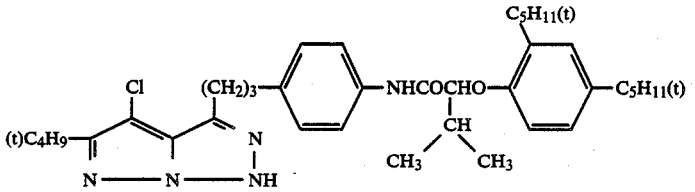
159
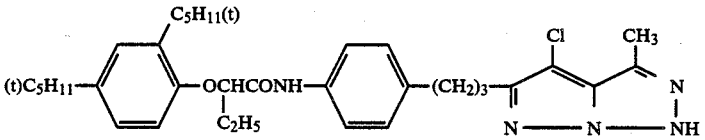
160
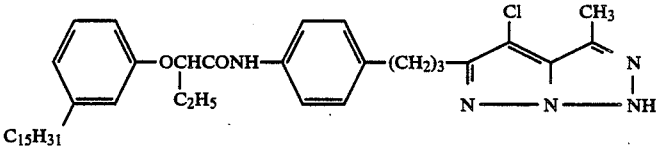
161
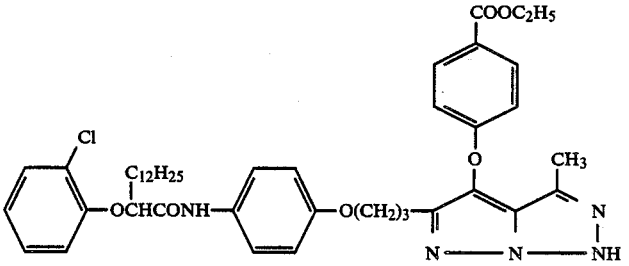
162
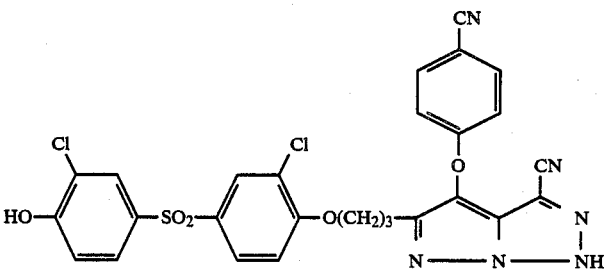
163
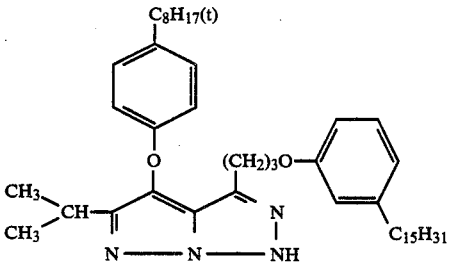

-continued
164
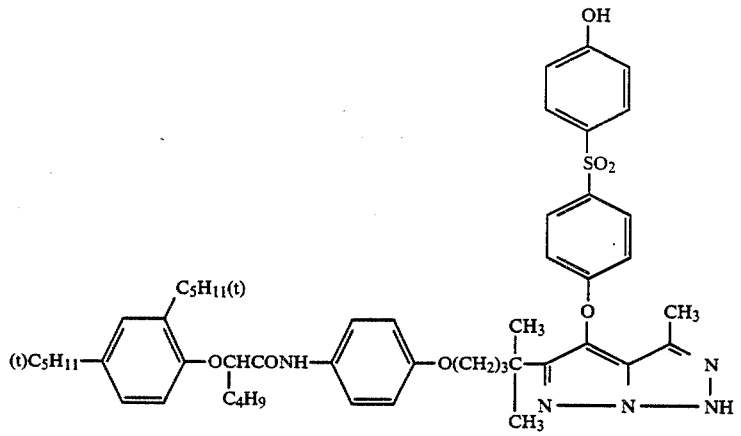
165
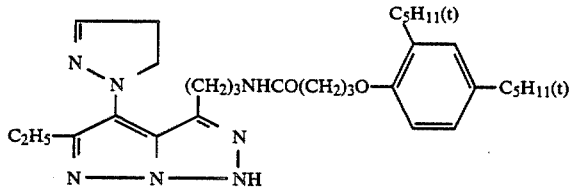
166
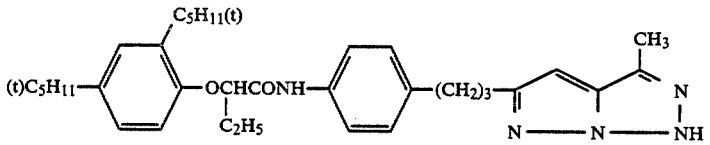
167
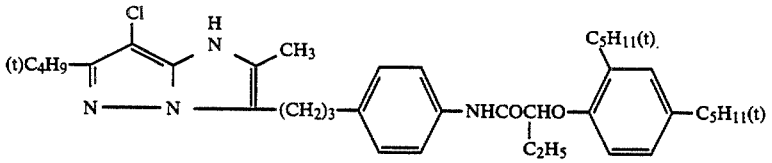
168
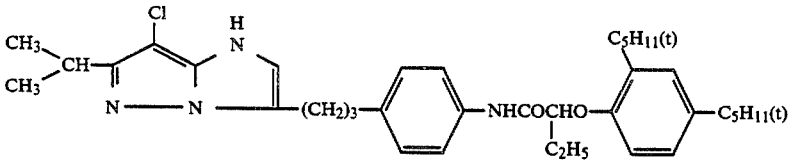
169
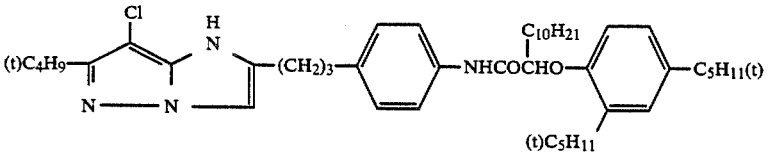
170
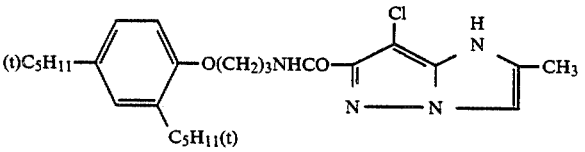
171
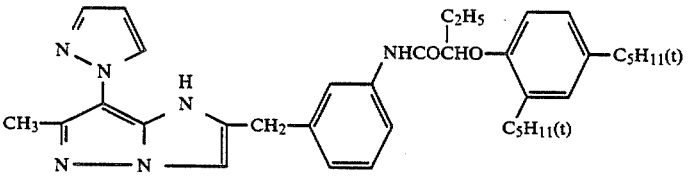

-continued
172
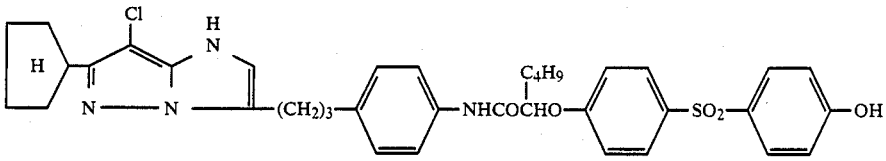
173
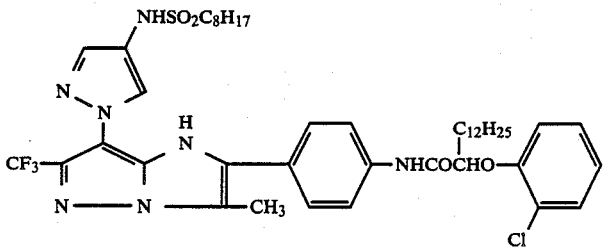
174
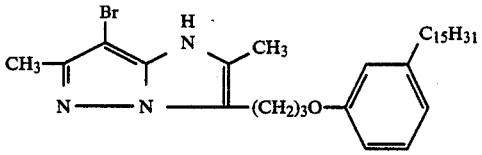
175
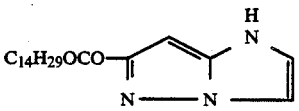
176
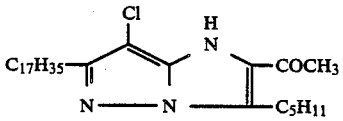
177
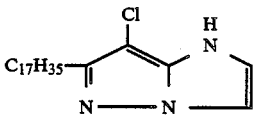
178
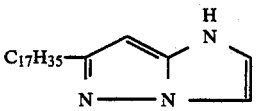
179
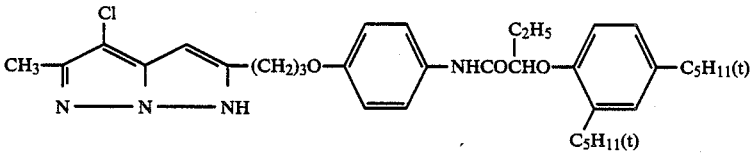
180
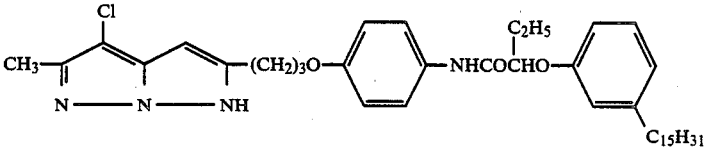

-continued
181
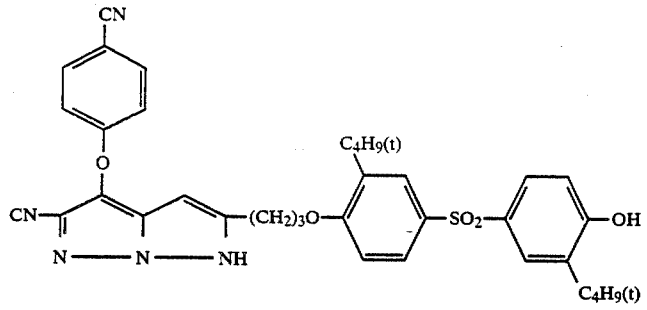
182
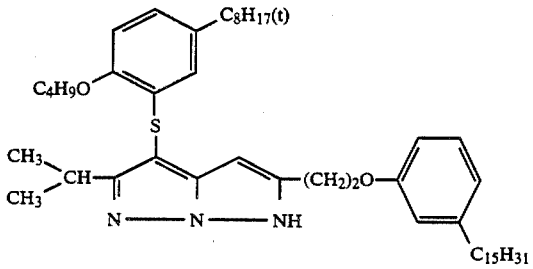
183
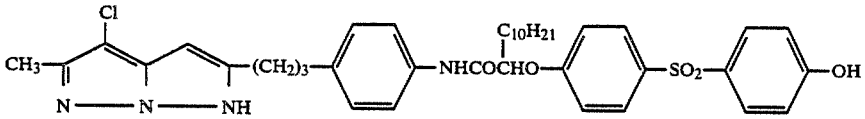
184
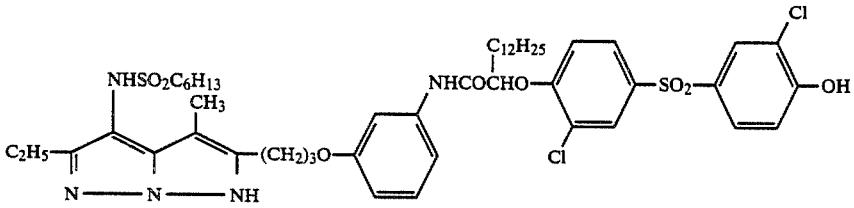
185
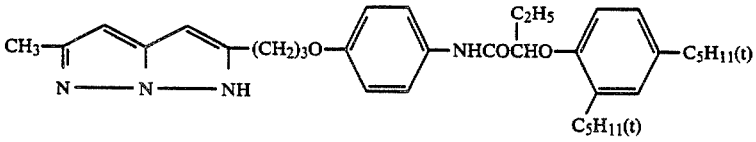
186
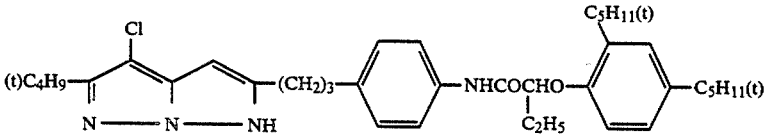
187
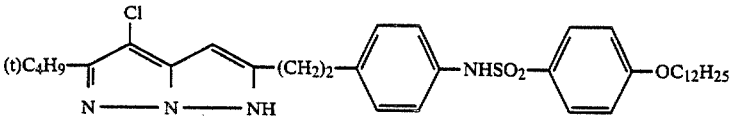
188
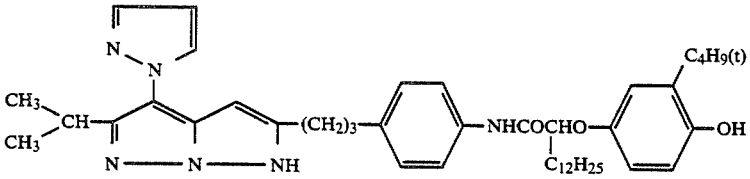

-continued
189
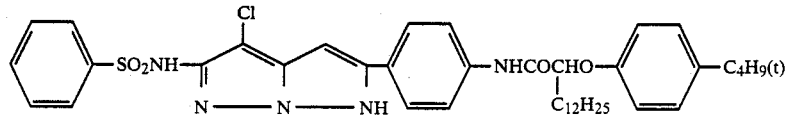
190
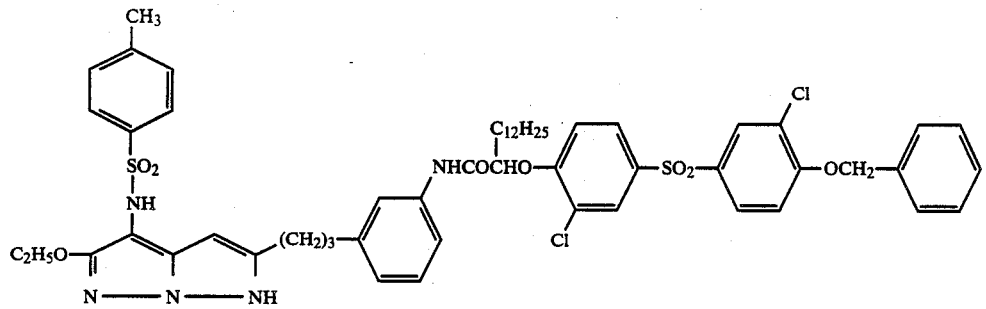
191
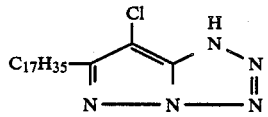
192
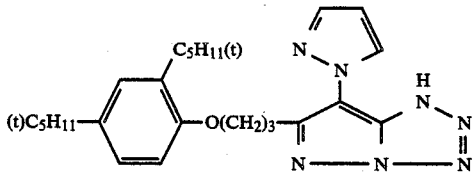
193
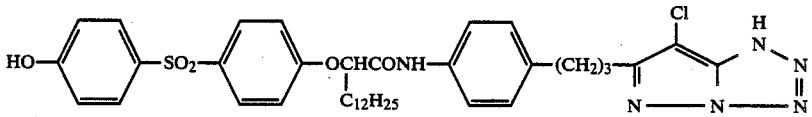
194
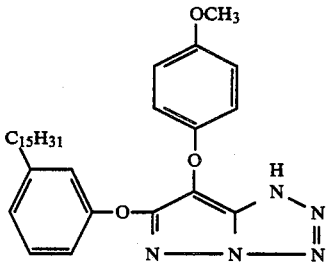
195
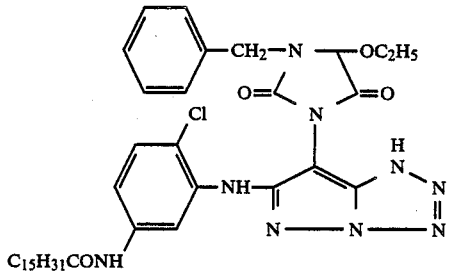
196
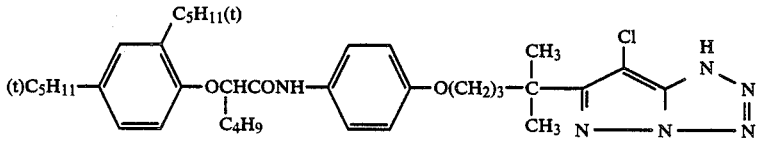

-continued

197

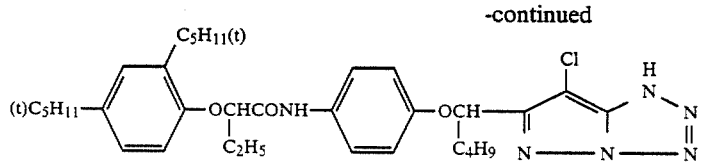

198

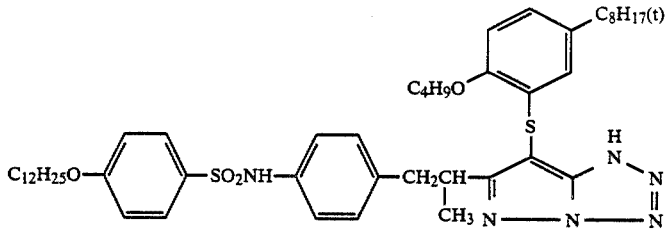

199

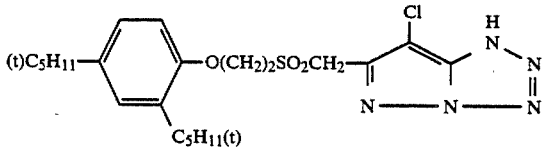

The above couplers were synthesized by referring to Journal of the Chemical Society, Perkin I (1977), pp. 2047–2052, U.S. Pat. No. 3,725,067, Japanese Provisional Patent Publications No. 99437/1984 and No. 42045/1984.

The coupler of the present invention can be used in an amount generally within the range of from $1\times10^{-3}$ mole to 1 mole, preferably from $1\times10^{-2}$ to $8\times10^{-1}$ mole, per mole of the silver halide.

The coupler of the present invention can be used in combination with other kinds of magenta couplers.

The light-sensitive material to be applied the method of the present invention is one coated silver halide emulsion layers and non-light-sensitive layers (non-emulsion layers) on a support, and as a silver halide emulsion, any of silver halide may be used such as silver chloride, silver bromide, silver iodide, silver chlorobromide, silver chloroiodide, silver bromoiodide, silver chloroiodobromide, etc. In these emulsion layers and non-light-sensitive layers, various couplers and additives known in the photographic industries can be contained and for example yellow dye forming couplers, magenta dye forming couplers, cyan dye forming couplers, stabilizers, sensitizing dyes, auric compounds, high boiling point solvents, antifoggants, dye image fading preventives, stain preventives, fluorescent brighteners, antistatic agents, film hardeners, surfactants, plasticizers, wetting agents, and UV-ray absorbers and the like may optionally be included therein.

The light-sensitive material to be applied the method of the present invention can be prepared by coating, on a support which is performed a corona discharge treatment, a flame treatment or a UV-ray irradiation treatment, each constituent layers such as emulsion layers containing the aforesaid various additives for photography if necessary and non-light-sensitive layers directly or through a subbing layer or a intermediate layer. As an advantageously used support, there may be mentioned, for example, baryta paper, polyethylene-coated paper, polypropylene synthetic paper, transparent support such as glass provided also a reflacting layer or using a reflecting body, cellulose acetate, cellulose nitrate, or polyester film such as polyethyleneterephthalate, polyamide film, polycarbonate film, polystyrene film and the like.

The most part of the above-mentioned silver halide emulsion layers and non-light-sensitive layers are constitued of a hydrophilic colloidal layer containing a hydrophilic binder. As the hydrophilic binders, there may preferably be employed a gelatin, or gelatin derivatives such as acylated gelatin, guanidyl-modified gelatin, phenyl-carbamyl-modified gelatin, phthalic acid-modified gelatin, cyanoethanol-modified gelatin, esterified gelatin and the like.

As the hardener to be cured the hydrophilic colloidal layer, there may be used, for example, chromium salts (chrome alum, chromium acetate, etc.), aldehydes (formaldehyde, glyoxal, glutaraldehyde, etc.), N-methylol compounds (dimethylol urea, methyloldimethylhydantoin, etc.), dioxane derivatives (2,3-dihydroxydioxane, etc.), active vinyl compounds (1,3,5-triacryloyl-hexahydro-s-triazine, 1,3-vinylsulfonyl-2-propanol, etc.), active halogen compounds (2,4-dichloro-6-hydroxy-s-triazine, etc.), mucohalogenic acid derivatives (mucochloric acid, mucophenoxychloric acid, etc.) and the like, and they may be used singly or in combination therewith.

Also, the present invention is particularly effective to a so-called oil-protect type in which the light-sensitive material contains a coupler contained in a high boiling point solvent in a dispersed state. As the high boiling point solvent, organic acid amides, carbamates, esters, ketones, urea derivatives, particularly phthalic acid esters such as dimethylphthalate, diethylphthalate, dipropylphthalate, dibutylphthalate, di-n-octylphthalate, di-isooctylphthalate, diamylphthalate, dinonylphthalate, di-isodecylphthalate, etc.; phospholic acid esters such as tricresylphosphate, triphenylphosphate, tri-(2-ethylhexyl)phosphate, trisnonylphosphate, etc.; sebacic acid esters such as dioctylsebacate, di-(2-ethylhexy)-sebacate, di-isodecylsebacate, etc.; glycerine esters such as glycerol tripropionate, glycerol tributyrate, etc.; and adipic acid esters, glutaric acid esters, succinic acid esters, maleic acid esters, fumaric acid esters, citric acid esters, phenol derivatives such as di-tert-amylphenol, n-octylphenol, etc. are employed, large effect of the present invention can be obtained.

In the color developing of the present invention, an aromatic primary amine color developing agent is employed and in the developing agent, known agents used widely in the various color photographic processing are included. In these developing agents, aminophenol type and p-phenylenediamine type derivatives are included. These compounds are generally used in the form of salts, for example, such as in the form of hydrochloride or sulfate since they are stable than the free state. Also, these compounds are generally used in a concentration of about 0.1 g to about 30 g per liter of a color developing solution, preferably about 1 g to about 1.5 g per liter of the color developing solution.

As the aminophenol type developing agent, they may include, for example, o-aminophenol, p-aminophenol, 5-amino-2-oxytoluene, 2-amino-3-oxytoluene, 2-oxy-3-amino-1,4-dimethylbenzene, etc.

Particularly available aromatic primary amine type color developing agents are N,N'-dialkyl-p-phenylenediamine type compounds and the alkyl group and the phenyl group may be substituted by optionaly substituents. Of these compounds, particularly available exemplary compounds may include N,N'-diethyl-p-phenylenediamine hydrochloride, N-methyl-p-phenylenediamine hydrochloride, N,N-dimethyl-p-phenylenediamine hydrochloride, 2-amino-5-(N-ethyl-N-dodecylamino)-toluene, N-ethyl-N-β-methanesulfonamide-ethyl-3-methyl-4-aminoaniline sulfate, N-ethyl-N-β-hydroxyethylaminoaniline, 4-amino-3-methyl-N,N'-diethylaniline, 4-amino-N-(2-methoxyethyl)-N-ethyl-3-methylaniline-p-toluenesulfonate and the like.

In the color developing solution, in addition to the above aromatic primary amine type color developing agents, various components which are usually added to the color developing solution may further optionally be added, and they may include, for example, alkali agents such as sodium hydroxide, sodium carbonate, potassium carbonate, etc., alkali metal thiocyanic acid salts, alkali metal halides, benzyl alcohol, water softening agents, concentrates and the like.

A pH value of the color developing solution using the aromatic primary amine color developing agent as a color developing agent is generally 7 or more and the most general value is about 10 to about 13.

Also, the effects of the present invention is remarkable when the light-sensitive material is a printing paper and the color developing solution contains a fluorescent brightening agent. Preferred fluorescent brightening agents are 4,4-diaminostylbene type fluorescent brightening agents and an amount thereof is preferably within the range of 0.1 g to 30 g per liter of the color developing solution and more preferably 0.3 g to 10 g. Preferred exemplary fluorescent brightening agents are disclosed in Japanese Patent Publication No. 58651/1982.

The stabilizing solution substituted for water washing to be used in the processing method of the present invention may of course be recovered a silver by a known method from a processing solution containing soluble silver complex salts such as a fixing solution and a bleach-fixing solution. For example, the electrolytic method (disclosed in French Pat. No. 2,299,667), the precipitation method (disclosed in Japanese Provisional Patent Publication No. 73037/1977 and West German Pat. No. 2,331,220), the ion-exchange method (disclosed in Japanese Provisional Patent Publication No. 17114/1976 and West German Pat. No. 2,548,237) and the metal substitution method (disclosed in Bristish Pat. No. 1,353,805) may advantageously be utilized. The processing method of the present invention is advantageously applied for processings of a color negative paper, a color positive paper and a reversal color paper. Also, particularly effective processing steps of the present invention may be mentioned, for example, the following (1).

(1) Color developing - Bleach-fixing - Stabilization processing substituted for water washing.

In the following, the present invention will be explained in more detail by referring to the Example, but the practical embodiments of the present invention is not limited by these.

EXAMPLE 1

By using the color paper, the processing solutions and the processing steps as mentioned below, experiments were carried out.

[COLOR PAPER]

On a polyethylene coated paper support, the following each layers were successively coated from the support side to prepare a light-sensitive material.

As the polyethylene coated paper, used was that on a high-quality paper having a weight of 170 g/m$^2$ was formed a coating layer having a thickness of 0.035 mm by coating a mixture prepared by adding 6.8% by weight of anatase type titanium dioxide to a mixture comprising 200 parts by weight of polyethylene having an average molecular weight of 100,000 and a density of 0.95 and 20 parts by weight of polyethylene having an average molecular weight of 2,000 and a density of 0.80 by the extruding coating method, and the back surface of the paper has coated only by a polyethylene to provide a coated layer having a thickness of 0.040 mm. After on the polyethylene coated surface on the support surface was carried out a pretreatment by the corona-discharge, each layers were successively coated thereon.

The first layer:

Blue-sensitive silver halide emulsion layer comprising a silver chlorobromide containing 80 mole % of silver bromide, and said emulsion contains 350 g of gelatin per mole of silver halide, sensitized by using the sensitizing dye having the following formula:

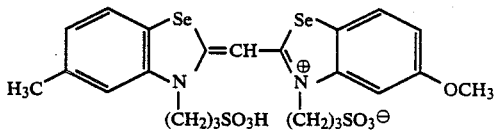

containing $2.5\times10^{-4}$ mole per mole of silver halide (isopropyl alcohol was used as a solvent), contains 200 mg/m$^2$ of 2,5-di-t-butylhydroquinone dissolved in dibutylphthalate and dispersed and $2\times10^{-1}$ mole of α-[4-(1-benzyl-2-phenyl-3,5-dioxo-1,2,4-triazolidyl)]-α-pivalyl-2-chloro-5-[γ-(2,4-di-t-amylphenoxy)-butyramido]acetanilide as the yellow coupler per mole of silver halide, and coated so as to become a silver amount of 330 mg/m$^2$.

The second layer:

A gelatin layer containing 300 mg/m$^2$ of di-t-octylhydroquinone dissolved in dibutylphthalate and dispersed, and as UV-ray absorbers 200 mg/m$^2$ of a mixture comprising 2-(2'-hydroxy-3',5'-butylphenyl)benzotriazol, 2-(2'-hydroxy-5'-t-butylphenyl)benzotriazole, 2-(2'-hydroxy-3'-t-butyl-5'-methylphenyl)-5-chlorobenzotriazole and 2-(2'-hydroxy-3',5'-di-t-butylphenyl)-5-chloro-benzotriazole, and the mixture was coated so as to become an amount of gelatin of 2000 mg/m$^2$.

The third layer:

Green-sensitive silver halide emulsion layer comprising a silver chlorobromide containing 85 mole % of silver bromide, and said emulsion contains 450 g of gelatin per mole of silver halide, sensitized by using $2.5\times10^{-4}$ mole of the sensitizing dye having the following structure:

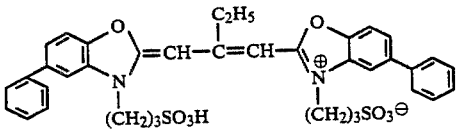

per mole of silver halide, contains 150 mg/m$^2$ of 2,5-di-t-butylhydroquinone dissolved in the solvent mixed dibutylphthalate and tricresylphosphate to 2:1 and dispersed and as magenta couplers $1.5\times10^{-1}$ mole of 1-(2,4,6/trichlorophenyl)-3-(2-chloro-5-octadecenylsuccinimidoanilino)-5-pyrazolone per mole of silver halide and coated so as to become a silver amount of 300 mg/m$^2$. The (B-22) of the exemplary compound of the above formula (III) was contained so as to become 15 mg/m$^2$.

The fourth layer:

A gelatin layer containing 30 mg/m$^2$ of di-t-octylhydroquinone dissolved in dioctylphthalate and dispersed and as UV-absorbers 500 mg/m$^2$ of a mixture comprising 2-(2'-hydroxy-3',5'-di-t-butylphenyl)benzotriazole, 2-(2'-hydroxy-5'-t-butylphenyl)benzotriazole, 2-(2'-hydroxy-3'-t-butyl-5'-methylphenyl)-5-chlorobenzotriazole and 2-(2'-hydroxy-3',5'-t-butylphenyl)-5-chloro-benzotriazole (2:1.5:1.5:2), and coated so as to become a gelatin amount of 2000 mg/m$^2$.

The fifth layer:

Red-sensitive silver halide emulsion layer comprising a silver chlorobromide emulsion containing 85 mole % of silver bromide, and said emulsion contains 500 g of gelatin per mole of silver halide, sensitized by using $2.5\times10^{-4}$ mole of the sensitizing dye having the following structure:

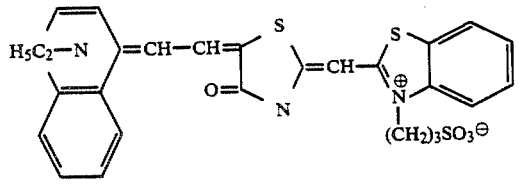

per mole of silver halide, contains 2,5-di-t-butylhydroquinone dissolved in dibutylphthalate and dispersed and as a cyan coupler $3.5\times10^{-1}$ mole of 2,4-dichloro-3-methyl-6-[γ-(2,4-diamylphenoxy)butyramido]phenol per mole of silver halide, and coated so as to become a silver amount of 300 mg/m$^2$. The (A-l) of the exemplary compound of the above formula (II) was contained so as to 15 mg/m$^2$.

The sixth layer:

A gelatin layer coated with a gelatin amount of 1000 mg/m$^2$.

The silver halide emulsions used in each of the light-sensitive emulsion layer (the 1st, 3rd and 5th layers) were prepared by those disclosed in Japanese Patent Publication No. 7772/1971, and each was chemically sensitized by using sodium thiosulfate pentahydrates and contained 4-hydroxy-6-methyl-1,3,3*a*, 7-tetrazaindene as a stabilizer, bis(vinylsulfonylmethyl)ether as a hardening agent and saponin as a coating aids.

The color paper prepared by the above-mentioned method was exposed, and then the successive processing was carried out by the following processing steps and the processing solutions.

| Standard processing steps | | |
|---|---|---|
| [1]Color developing | 38° C. | 3 min. |
| [2]Bleach-fixing | 33° C. | 1 min. |
| [3]Stabilizing | 25–35° C. | 1 min. |
| [4]Drying | 75–100° C. | about 1 min. |

Compositions of processing solutions:

| <Color developing tank solution> | |
|---|---|
| Benzyl alcohol | 15 ml |
| Ethylene glycol | 15 ml |
| Potassium sulfite | 2.0 g |
| Potassium bromide | 1.3 g |
| Sodium chloride | 0.2 g |
| Potassium carbonate | 30.0 g |
| 3-Methyl-4-amino-N-ethyl-N-(β-methane-sulfonamidoethyl)-aniline sulfate | 5.5 g |
| Fluorescent brightening agent | 1.0 g |
| (4,4-diaminostylbene derivative) | 1.0 g |
| Hydroxylamine sulfate | 3.0 g |
| 1-Hydroxyethylidene-1,1-diphosphonic acid | 0.4 g |
| Hydroxyethyliminodiacetic acid | 5.0 g |
| Magnesium chloride.hexahydrates | 0.7 g |
| 1,2-Dihydroxybenzene-3,5-disulfonic acid disodium salt | 0.2 g |

Made up to one liter with addition of water and adjusted to pH 10.20 with KOH and $H_2SO_4$.

| <Color developing supplementing solution> | |
|---|---|
| Benzyl alcohol | 20.0 ml |
| Ethylene glycol | 20.0 ml |
| Potassium sulfite | 3.0 g |
| Potassium carbonate | 30.0 g |
| Hydroxylamine sulfate | 4.0 g |
| 3-Methyl-4-amino-N-ethyl-N-(β-methane-sulfonamidoethyl)-aniline sulfate | 7.5 g |
| Fluorescent brightening agent (4,4-diaminostylbene derivative) | 2.5 g |
| 1-Hydroxyethylidene-1,1-diphosphonic acid | 0.5 g |
| Hydroxyethyliminodiacetic acid | 5.0 g |
| Magnesium chloride.hexahydrates | 0.8 g |
| 1,2-Dihydroxybenzene-3,5-disulfonic acid disodium salt | 0.3 g |

Made up to one liter with addition of water and adjusted to pH 10.70 with KOH.

| <Bleach-fixing tank solution> | |
|---|---|
| Ferric complex salt of chelating agent shown in Table 1 | 80 g |
| Chelating agent shown in Table 1 | 20 g |
| Ammonium thiosulfate (70% dissolved) | 100 ml |
| Ammonium sulfite (40% dissolved) | 27.5 ml |

Made up to a total quantity of one liter with addition of water simultaneously adjusted to pH 7.1 with aqueous ammonia or glacial acetic acid.

| <Bleach-fixing supplementing solution A> | |
|---|---|
| Ferric complex salt of chelating agent shown in Table 1 | 300 g |
| Chelating agent shown in Table 1 | 50 g |

Made up to a total quantity of one liter with addition of water simultaneously adjusted to pH 6.7 with potassium carbonate or glacial acetic acid.

| <Bleach-fixing supplementing solution B> | |
|---|---|
| Ammonium thiosulfate (70% dissolved) | 500 ml |
| Ammonium sulfite (40% dissolved) | 250 ml |
| Chelating agent shown in Table 1 | 15 g |

Made up to a total quantity of one liter with addition of water simultaneously adjusted to pH 5.3 with aqueous ammonia or glacial acetic acid.

| <Stabilizing tank solution substituted for water washing and supplementing solution> | |
|---|---|
| 5-Chloro-2-methyl-4-isothiazolin-3-one | 0.02 g |
| 2-Methyl-4-isothiazolin-3-one | 0.02 g |
| Ethylene glycol | 1.0 g |
| 2-Octyl-4-isothiazolin-3-one | 0.01 g |
| 1-Hydroxyethylidene-1,1-diphosphonic acid (60% aqueous solution) | 3.0 g |
| $BiCl_3$ (45% aqueous solution) | 0.65 g |
| Aqueous ammonia (ammonium hydroxide 25% aqueous solution) | 3.0 g |
| Nitrilotrimethylenephosphonic acid | 1.5 g |

Made up to one liter with water and adjusted to pH 8.0 with $H_2SO_4$ and KOH.

The aforesaid color developing tank solution, the bleach-fixing tank solution and the stabilizing tank solution were filled in the automatic processer and a running test was carried out by processing the color paper and supplementing the above color developing supplementing solution, the bleach-fixing supplementing solutions A and B and the stabilizing supplementing solution through quantitative cups for each three minutes. The supplementing solutions were supplemented per 1 $m^2$ of the color paper in amounts of 190 ml as a supplementing amount for the color developing tank, each 50 ml of the bleach-fixing supplementing solutions A and B as a supplementing amount for the bleach-fixing tanks, and 230 ml of the stabilizing supplementing solution substituted for water washing as the supplementing amount for the stabilization processing bath, respectively.

The stabilizing processing bath of the automatic processer was set the first bath to the third bath of the stabilizing baths to a flow direction of the light-sensitive material and processing time was 20 sec per one bath. Supplementing was carried out with the multi-layer counter current direction in which an overflow solution was introduced from the last bath into the bath just prior to it and the overflow solution of the latter bath was further introduced into the bath just prior to it.

Continuous processing was carried out until the total supplementing amount of the stabilizing solution substituted for water washing became 2-fold of the stabilizing tank capacity with respect to each of the bleach-fixing solutions of No. 1 to No. 10 each of which use chelating agents shown in Table 1, and at the completion time of the continuous processing, the aforesaid light-sensitive materials processed were taken as Samples and the stabilizing solution was sampled from the stabilizing processing second bath. Also, as comparative, a light-sensitive material was processed by substituting the stabilizing processing by the flowing water washing after continuous processing.

The resulting light-sensitive materials after processing were preserved at 80° C. and 70% RH in an incubater for 3 days and yellow stain after preservation was measured by blue light of the photodensitometer PDA - 65 (produced by Konishiroku Photo Industry Co., Ltd.). The results are shown in Table 1.

Further, the sampled stabilizing processing solution substituted for water washing of the first bath was allowed to stand in a one liter beaker at room temperature and observed the date until black precipitates were occured. The results are also shown in Table 1.

TABLE 1

| | Sample No. | Chelating agent used as ferric complex in the bleach-fixing solution | Yellow stain: Flowing water washing (Comparative) | Yellow stain: Stabilizing processing substituted for water washing (This invention) | Date until occuring precipitation (second stabilizing solution) |
|---|---|---|---|---|---|
| Chelating agent of comparative | 1 | Ethylenediamine-tetraacetic acid | 0.23 | 0.26 | 11 days |
| | 2 | Diaminopropanol-tetraacetic acid | 0.23 | 0.29 | 11 days |
| | 3 | Glycoletherdiamine-tetraacetic acid | 0.23 | 0.35 | 8 days |
| | 4 | Ethylenediaminetetra-kismethylenephos-phonic acid | 0.23 | 0.28 | 14 days |
| Chelating agent of this invention | 5 | Exemplary compound (1) | 0.23 | 0.14 | 30 days or longer |
| | 6 | Exemplary compound (3) | 0.23 | 0.15 | 30 days or longer |
| | 7 | Exemplary compound (5) | 0.23 | 0.14 | 30 days or longer |
| | 8 | Exemplary compound (17) | 0.23 | 0.14 | 30 days or longer |
| | 9 | Exemplary compound (28) | 0.23 | 0.19 | 22 days |
| | 10 | Exemplary compound (25) | 0.23 | 0.18 | 24 days |

As clearly seen from the results of Table 1, as compared with those using chelating agents of ferric complex salt having large molecular weight as the bleaching agent (Samples No. 1 to No. 4), Samples No. 5 to No. 10 of the present invention are extremely excellent in both yellow stain and solution preservability. Further, comparing Samples No. 5 to No. 8 and No. 9 and No. 10, it can be understood that the use of the chelating agent represented by the formula (I) is extremely preferred.

EXAMPLE 2

After continuous processing was carried out with respect to Samples No. 1 and No. 8 of Example 1, processing time was changed to 45 sec. (15 sec. per one bath), 1 min. (20 sec. per one bath), 1 min. and 30 sec. (30 sec. per one bath), 2 min. (40 sec. per one bath), 2 min. and 30 sec. (50 sec. per one bath) and 3 min. (1 min. per one bath) to process color paper of Example 1. A white ground of an unexposed portion of the resulting color paper processed was measured its density of spectral reflectance (at 440 nm) by Color Analyzer (produced by Hitachi Co., Ltd.). The results are shown in Table 2.

TABLE 2

| | Processing time of stabilizing substituted for water washing | | | | | |
|---|---|---|---|---|---|---|
| Sample No. | 45 sec. | 1 min. | 1 min. 30 sec. | 2 min. | 2 min. 30 sec. | 3 min. |
| No. 1 (Comparative Bleach-fixing solution) | 0.152 | 0.146 | 0.138 | 0.128 | 0.125 | 0.125 |
| No. 8 (Bleach-fixing solution of this invention) | 0.119 | 0.115 | 0.117 | 0.118 | 0.123 | 0.123 |

(The numerical values are densities of spectral reflectance (at 440 nm)).

As clearly seen from the results of Table 2, when the time of the stabilizing processing substituted for water washing is within 2 minutes, the sample using the bleach-fixing solution has been employed is low in reflectance density of the white ground and thus it can be understood that it is extremely excellent.

EXAMPLE 3

By using bleach-fixing solution of Samples No. 1 and No. 5 of Example 1, each was carried out continuous processing by changing a supplementing amount of the stabilizing supplementing solution substituted for water washing to 30 ml/m$^2$, 60 ml/m$^2$, 100 ml/m$^2$, 250 ml/m$^2$, 500 ml/m$^2$, 800 ml/m$^2$ and 2 l/m$^2$ as shown in Table 2, and the same experiment as in Example 1 was carried out to obtain yellow stain. The results are shown in Table 3.

Incidentally, an amount of solution carrying in the stabilizing tank solution substituted for water washing from the bleach-fixing tank by the light-sensitive material was 30 ml/m$^2$.

TABLE 3

| | | | | | | | | |
|---|---|---|---|---|---|---|---|---|
| Supplementing amount | Supplementing amount [ml/m$^2$] | 30 | 60 | 100 | 250 | 500 | 800 | 2000 |
| | Ratio to amount carrying from previous bath | 1.0 | 2.0 | 3.3 | 8.3 | 16.7 | 26.7 | 66.7 |
| Yellow stain | Sample No. 1 Comparative Bleach-fixing solution | 0.50 | 0.47 | 0.43 | 0.23 | 0.20 | 0.16 | 0.14 |
| | Sample No. 5 Bleach-fixing solution of this invention | 0.42 | 0.27 | 0.21 | 0.13 | 0.12 | 0.11 | 0.10 |

As clearly seen from the results of Table 3, in the present invention, large effect can be obtained when the supplementing amount of the stabilizing solution substituted for water washing is 2 to 20-fold of the amount carrying from the previous bath.

EXAMPLE 4

Light-sensitive materials were prepared in the same manner as in Example 1 except that, in the preparation of the light-sensitive materials (Samples No. 1 and No. 8) of Example 1, Exemplary compound B - 22 was eliminated from the third layer and Exemplary compound A - 1 from the fifth layer, respectively. By using this light-sensitive material, countinuous processing was carried out in the same manner as in Samples No. 1 and No. 8 of Example 1. With respect to a white ground of an unexposed portion obtained by said processing, density of spectral reflectance at 440 nm was measured. Also, by using preserved samples, yellow stain was measured.

As results, the densities of spectral reflectance of Sample No. 1 was 0.148 and Sample No. 8 was 0.119. Also, yellow stain of Sample No. 1 was 0.27 and Sample No. 8 was 0.19.

As compared with the results of Examples 1 and 2 which contains the exemplary compounds of the formulae (II) to (V) in the light-sensitive material, density differences of the yellow stain were 0.01 for Sample No. 1 and 0.05 for Sample No. 8, and difference of density of spectral reflectance were 0.01 for Sample No. 1 and 0.04 for Sample No. 8, respectively. From the results as mentioned above, it can be understood that Exemplary compounds A - 1 and B - 22 represented by the formulae (II) to (V) are effectively worked to the present invention.

EXAMPLE 5

Color paper samples were prepared in the same manner as in Example 1 except for replacing the cyan coupler in the color paper used in Example 1 with the cyan coupler as shown in Table 4 below and developing processings were carried out following the processing steps of Example 1.

At the same time, as comparative processings, the processing which was carried out the stabilizing processing in place of the stabilizing processing substituted for water washing.

With respect to samples for the stabilizing processing and the flowing water washing processing concerning the obtained respective Samples No. 11 to No. 32 of the light-sensitive materials, by alternating a degradation accelerating test using a high humidity and high temperature at 70° C. and 50% RH and a degradation accelerating test using a xenon arc lamp evry other day, they were preserved for 4 weeks. Cyan dye densities before and after preservation were measured with red-light using a photodensitometer PDA - 65 (produced by Konishiroku Photo Industry Co., Ltd.) to obtain fading rates of the cyan dye. The results are shown in Table 4.

Comparative cyan coupler (1)

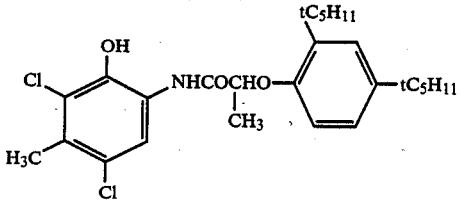

Comparative cyan coupler (2)

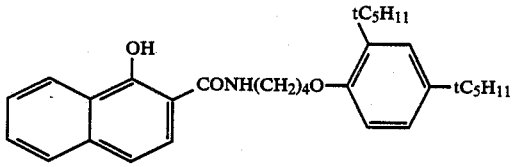

TABLE 4

| Light-sensitive material Sample No. | | Cyan coupler used in the light-sensitive material | Free acid of organic acid ferric complex salt contained in bleach-fixing solution | Cyan dye fading rate (%) Flowing water washing (Comparative) | Stabilizing processing substituted for washing (This invention) |
|---|---|---|---|---|---|
| 11 | Comparative | Comparative coupler (1) | Ethylenediaminetetraacetic acid (MW = 292.25) | 36 | 43 |
| 12 | | | Exemplary compound (5) | 36 | 44 |
| 13 | | | Exemplary compound (17) | 37 | 43 |
| 14 | | Comparative coupler (2) | Ethylenediaminetetraacetic acid (MW = 292.25) | 35 | 40 |
| 15 | | | Exemplary compound (5) | 36 | 41 |
| 16 | | | Exemplary compound (17) | 35 | 41 |
| 17 | | Exemplary compound C - 8 | Ethylenediaminetetraacetic acid (MW = 292.25) | 37 | 40 |
| 18 | invent | | Exemplary compound (5) | 36 | 25 |
| 19 | | | Exemplary compound (17) | 35 | 23 |
| 20 | Comp. | Exemplary compound C - 103 | Ethylenediaminetetraacetic acid (MW = 292.25) | 35 | 40 |
| 21 | invent | | Exemplary compound (5) | 36 | 22 |
| 22 | | | Exemplary compound (17) | 35 | 20 |
| 23 | Comparative | Exemplary compound C - 59 | Ethylenediaminetetraacetic acid (MW = 292.25) | 37 | 42 |
| 24 | | | Diaminopropanoltetraacetic acid (MW = 302.77) | 37 | 40 |
| 25 | | | Glycoletherdiaminetetraacetic acid (MW = 380.35) | 36 | 42 |
| 26 | | | Ethylenediaminetetrakismethylenephosphonic acid (MW = 436.13) | 37 | 46 |
| 27 | invention | | Exemplary compound (1) | 37 | 21 |
| 28 | | | Exemplary compound (3) | 36 | 21 |
| 29 | | | Exemplary compound (5) | 37 | 18 |
| 30 | | | Exemplary compound (17) | 37 | 17 |
| 31 | | | Exemplary compound (28) | 37 | 29 |
| 32 | | | Exemplary compound (25) | 37 | 25 |

As clearly seen from the results of Table 4, the light-sensitive materials of Samples No. 18, No. 19, No. 21, No. 22, No. 27 to No. 32 of this invention which contain the cyan coupler in accordance with the present invention and processed with the bleach-fixing solution containing the chelating agent of ferric salt having low molecular weight as the bleaching agent are extremely excellent in low cyan dye fading retes, and particularly preferred in case of using the ferric complex salt of free acid represented by the formula (I) as the bleaching agent.

EXAMPLE 6

Color paper samples were prepared in the same manner as in Example 1 except for replacing the magenta coupler in the color paper used in Example 1 with the magenta coupler as shown in Table 5 below and developing processings were carried out following the processing steps of Example 1.

At the same time, as comparative processings, the processing which was carried out the stabilizing processing in place of the stabilizing processing substituted for water washing.

With respect to samples for the stabilizing processing and the flowing water washing processing concerning the obtained respective Samples No. 33 to No. 54 of the light-sensitive materials, by alternating a degradation accelerating test using a high humidity and high temperature at 70° C. and 50% RH and a degradation accelerating test using a xenon arc lamp evry other day, they were preserved for 4 weeks. Magenta dye densities before and after preservation were measured with red-light using a photodensitometer PDA - 65 (produced by Konishiroku Photo Industry Co., Ltd.) to obtain fading rates of the magenta dye. The results are shown in Table 5.

Comparative coupler (1)

-continued

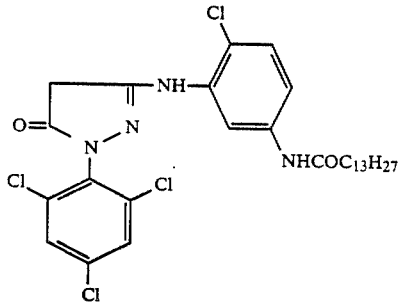

Comparative coupler (2)

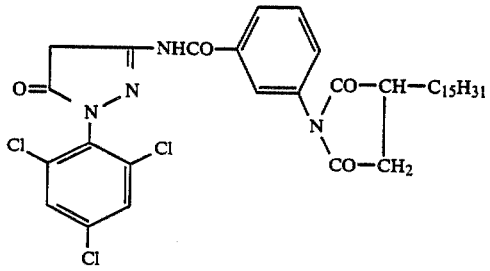

molecular weight as the bleaching agent are extremely excellent in low magenta dye fading retes, and particularly preferred in case of using the ferric complex salt of free acid represented by the formula (I) as the bleaching agent.

EXAMPLE 7

Color paper samples were prepared in the same manner as in Example 1 except for replacing the magenta coupler in the color paper used in Example 1 with the magenta coupler as shown in Table 6 below and developing processings were carried out following the processing steps of Example 1.

At the same time, as comparative processings, the processing which was carried out the stabilizing processing in place of the stabilizing processing substituted for water washing.

With respect to samples for the stabilizing processing and the flowing water washing processing concerning the obtained respective Samples No. 55 to No. 76 of the light-sensitive materials, by alternating a degradation accelerating test using a high humidity and high temperature at 70° C. and 50% RH and a degradation accelerating test using a xenon arc lamp evry other day, they were preserved for 4 weeks. Magenta dye densities before and after preservation were measured with red-

TABLE 5

| Light-sensitive material Sample No. | | Magenta coupler used in the light-sensitive material | Free acid of organic acid ferric complex salt contained in bleach-fixing solution | Magenta dye fading rate (%) Flowing water washing (Comparative) | Stabilizing processing substituted for washing (This invention) |
|---|---|---|---|---|---|
| 33 | Comparative | Comparative coupler (1) | Ethylenediaminetetra-acetic acid (MW = 292.25) | 41 | 47 |
| 34 | | | Exemplary compound (5) | 42 | 47 |
| 35 | | | Exemplary compound (17) | 40 | 46 |
| 36 | | Comparative coupler (2) | Ethylenediaminetetra-acetic acid (MW = 292.25) | 42 | 48 |
| 37 | | | Exemplary compound (5) | 42 | 48 |
| 38 | | | Exemplary compound (17) | 42 | 48 |
| 39 | | Exemplary compound | Ethylenediaminetetra-acetic acid (MW = 292.25) | 48 | 52 |
| 40 | invent | M - 7 | Exemplary compound (5) | 48 | 25 |
| 41 | | | Exemplary compound (17) | 47 | 23 |
| 42 | Comparative | Exemplary compound | Ethylenediaminetetra-acetic acid (MW = 292.25) | 47 | 52 |
| 43 | | M - 28 | Diaminopropanoltetra-acetic acid (MW = 322.77) | 47 | 52 |
| 44 | | | Glycoletherdiaminetetra-acetic acid (MW = 380.35) | 47 | 53 |
| 45 | | | Ethylenediaminetetrakis-methylenephosphonic acid (MW = 436.13) | 47 | 49 |
| 46 | This invention | Exemplary compound | Exemplary compound (1) | 47 | 24 |
| 47 | | M - 28 | Exemplary compound (3) | 47 | 24 |
| 48 | | | Exemplary compound (5) | 47 | 23 |
| 49 | | | Exemplary compound (17) | 47 | 21 |
| 50 | | | Exemplary compound (28) | 47 | 33 |
| 51 | | | Exemplary compound (25) | 47 | 34 |
| 52 | Comp | Exemplary compound | Ethylenediaminetetra-acetic acid | 45 | 50 |
| 53 | | M - 74 | Exemplary compound (5) | 45 | 25 |
| 54 | | | Exemplary compound (17) | 45 | 23 |

As clearly seen from the results of Table 5, the light-sensitive materials of Samples No. 40, No. 41, No. 46 to No. 51, No. 53 and No. 54 of this invention which contain the magenta coupler in accordance with the present invention and processed with the bleach-fixing solution containing the chelating agent of ferric salt having low light using a photodensitometer PDA - 65 (produced by Konishiroku Photo Industry Co., Ltd.) to obtain fading rates of the magenta dye. The results are shown in Table 6.

The comparative magenta couplers (1) and (2) are the same used as in Example 6.

TABLE 6

| Light-sensitive material Sample No. | | Magenta coupler used in the light-sensitive material | Free acid of organic acid ferric complex salt contained in bleach-fixing solution | Magenta dye fading rate (%) Flowing water washing (Comparative) | Stabilizing processing substituted for washing (This invention) |
|---|---|---|---|---|---|
| 55 | Comparative | Comparative coupler (1) | Ethylenediaminetetra-acetic acid (MW = 292.25) | 41 | 47 |
| 56 | | | Exemplary compound (5) | 42 | 47 |
| 57 | | | Exemplary compound (17) | 40 | 46 |
| 58 | | Comparative coupler (2) | Ethylenediaminetetra-acetic acid (MW = 292.25) | 42 | 48 |
| 59 | | | Exemplary compound (5) | 42 | 48 |
| 60 | | | Exemplary compound (17) | 42 | 48 |
| 61 | | Exemplary compound | Ethylenediaminetetra-acetic acid (MW = 292.25) | 43 | 49 |
| 62 | invent | M - 1 | Exemplary compound (5) | 44 | 26 |
| 63 | | | Exemplary compound (17) | 43 | 24 |
| 64 | Comparative | Exemplary compound | Ethylenediaminetetra-acetic acid (MW = 292.25) | 45 | 51 |
| 65 | | M - 8 | Diaminopropanoltetra-acetic acid (MW = 322.77) | 45 | 51 |
| 66 | | | Glycoletherdiaminetetra-acetic acid (MW = 380.35) | 46 | 52 |
| 67 | | | Ethylenediaminetetrakis-methylenephosphonic acid (MW = 436.13) | 45 | 51 |
| 68 | This invention | Exemplary compound | Exemplary compound (1) | 45 | 26 |
| 69 | | | Exemplary compound (3) | 45 | 25 |
| 70 | | M - 8 | Exemplary compound (5) | 45 | 25 |
| 71 | | | Exemplary compound (17) | 45 | 23 |
| 72 | | | Exemplary compound (28) | 45 | 31 |
| 73 | | | Exemplary compound (25) | 45 | 32 |
| 74 | Comp | Exemplary compound | Ethylenediaminetetra-acetic acid (MW = 292.25) | 47 | 52 |
| 75 | invent | M - 7 | Exemplary compound (5) | 47 | 26 |
| 76 | | | Exemplary compound (17) | 48 | 24 |

As clearly seen from the results of Table 6, the light-sensitive materials of Samples No. 62, No. 63, No. 68 to No. 73, No. 75 and No. 76 of this invention which contain the magenta coupler in accordance with the present invention and processed with the bleach-fixing solution containing the chelating agent of ferric salt having low molecular weight as the bleaching agent are extremely excellent in low magenta dye fading retes, and particularly preferred in case of using the ferric complex salt of free acid represented by the formula (I) as the bleaching agent.

According to the method of the present invention, when the staying time of the stabilizing solution substituted for water washing in the processing method processing with the stabilizing solution substituted for water washing succesively processing with the bleach-fixing solution containing thiosulfate is long, generation of fine black precipitates which generate in said solution can be prevented. Further, generation of yellow stain when preserved for a long time a photographic image which is made a processing with a decreased amount of supplementing stabilizing solution substituted for water washing and occurrence of edge contamination can also be prevented.

We claim:

1. A processing method of a light-sensitive silver halide color photographic material which comprises, in a method of processing a light-sensitive silver halide color photographic material with a bleach-fixing solution after color developing, and thereafter treating said photographic material with a stabilizing solution substituted for water washing, said bleach-fixing solution containing as main components an organic acid ferric complex salt of which the molecular weight of a free acid being not more than 280, a thiosulfate and a sulfite, and a processing time with said stabilizing solution substituted for water washing of 2 minutes or shorter, the added amount of stabilizing solution added to the stabilizing bath being in the range of 1 to 50 fold based on the amount brought from a prebath per unit area of the light sensitive material to be processed.

2. A processing method of a light-sensitive silver halide color photographic material according to claim 1, wherein said organic acid ferric complex salt is contained in the range of $2\times10^{-2}$ to 2 mole based on one liter of said bleach-fixing solution.

3. A processing method of a light-sensitive silver halide color photographic material according to claim 1, wherein said free acid of said organic acid ferric complex salt is a compound represented by the following formula (I):

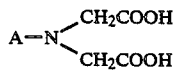

(I)

wherein A represents a hydrogen atom, an alkyl group having 1 to 4 carbon atoms, a hydroxyalkyl group having 1 to 4 carbon atoms or a carboxyalkyl group having 1 to 4 carbon atoms.

4. A processing method of a light-sensitive silver halide color photographic material according to claim 1, wherein a supplementing amount of said stabilizing solution substituted for water washing is 2 to 20-folds of a carrying amount from a previous bath per unit area of the light-sensitive material to be processed.

5. A processing method of a light-sensitive silver halide color photographic material according to claim 1, said silver halide color photographic material contains at least one compounds represented by the following formulae (II) to (V):

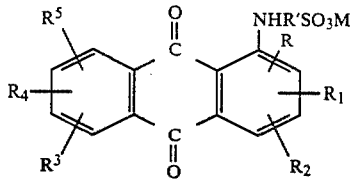

(II)

wherein R, $R_1$, $R_2$, $R_3$, $R_4$ and $R_5$ each represent a hydrogen atom, a halogen atom, a hydroxy group, an alkyl group, an alkoxy group, a sulfo group or —NHR'$SO_3M$ where R' represents an alkylene group and M represents a cation group,

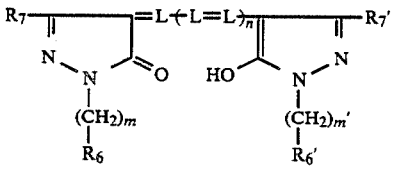

(III)

wherein $R_6$ and $R_6'$ each represent a hydrogen atom, an alkyl group, an aryl group or a heterocyclic group; $R_7$ and $R_7'$ each represent a hydroxy group, an alkoxy group, a cyano group, a trifluoromethyl group, —$COOR_8$, —$CONHR_8$, —$NHCOR_8$, a ureido group, an imino group, an amino group, a substituted amino group substituted by an alkyl group having 1 to 4 carbon atoms or a cyclic amino group represented by

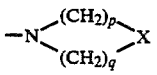

where p and q each represent 1 or 2; X represents an oxygen atom, a sulfur atom or —$CH_2$— group; $R_8$ represents a hydrogen atom, an alkyl group or an aryl group; L represents a methine group; n represents 0, 1 or 2; and m and m' each represent 0 or 1,

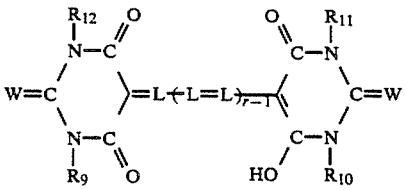

(IV)

wherein r represents an integer of 1 to 3; W represents an oxygen atom or a sulfur atom; L represents a methine group; $R_9$ to $R_{12}$ each represent a hydrogen atom, an alkyl group, an aryl group, an aralkyl group or a heterocyclic group and at least one of $R_9$ to $R_{12}$ are substituent other than the hydrogen atom,

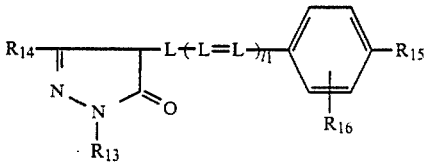

(V)

wherein l represents an integer of 1 or 2; L represents a methine group; $R_{13}$ represents an alkyl group, an aryl group or a heterocyclic group; $R_{14}$ and $R_{15}$ each represent a hydroxy group, an alkyl group, an alkoxy group, a cyano group, a trifluoromethyl group, —$COOR_8$, —$CONHR_8$, —$NHCOR_8$, a ureido group, an imino group, an amino group, a substituted amino group substituted by analkyl group having 1 to 4 carbon atom, a cyclic amino group represented by

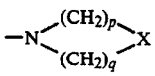

where p and q each represent 1 or 2; X represents an oxygen atom, a sulfur atom or —$CH_2$— group; $R_8$ represents a hydrogen atom, an alkyl group or an aryl group; $R_{16}$ represents a hydrogen atom, an alkyl group, a chlorine atom or an alkoxy group.

6. A processing method of a light-sensitive silver halide color photographic material according to claim 1, wherein said thiosulfate is contained in the range of 5 g or more per liter of said bleach-fixing solution.

7. A processing method of a light-sensitive silver halide color photographic material according to claim 6, wherein said thiosulfate is contained in the range of 70 g to 250 g per liter of said bleach-fixing solution.

8. A processing method of a light-sensitive silver halide color photographic material according to claim 1, wherein said sulfite is contained in the range of $1\times10^{-3}$ to 0.1 mole per liter of said bleach-fixing solution.

9. A processing method of a light-sensitive silver halide color photographic material according to claim 1, wherein said stabilizing solution substituted for water washing contains a chelating agent.

10. A processing method of a light-sensitive silver halide color photographic material according to claim 9, wherein said chelating agent has a chelate stabilizing constant of 8 or more.

11. A processing method of a light-sensitive silver halide color photographic material according to claim 9, wherein said chelating agent is contained in an amount of 0.01 to 50 g per liter of said stabilizing solution substituted for water washing.

12. A processing method of a light-sensitive silver halide color photographic material according to claim 5, said silver halide color photographic material further contains at least one cyan couplers represented by the formulae (VI) to (VIII):

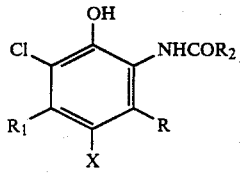

(VI)

wherein R and $R_1$ represent one of which is a hydrogen atom and the other is a straight or branched alkyl group having at least 2 to 12 carbon atoms; X represents a hydrogen atom or an eliminable group by the coupling reaction with a oxidized product of an aromatic primary amine color developing agent; and $R_2$ represents a ballast group,

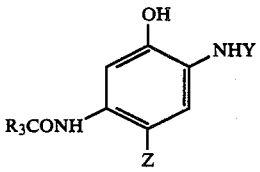

(VII)

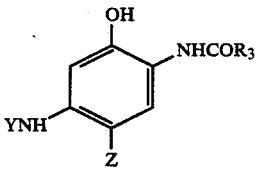

(VIII)

wherein Y represents

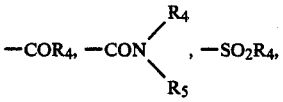

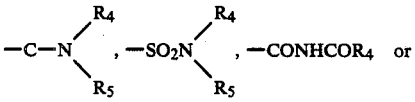

$-CONHSO_2R_4$ where $R_4$ represents an alkyl group, an alkenyl group, a cycloalkyl group, an aryl group or a heterocyclic group; $R_5$ represents a hydrogen atom, an alkyl group, an alkenyl group, a cycloalkyl group, an aryl group or a heterocyclic group; and $R_4$ and $R_5$ may be bonded with each other to form a 5- or 6-membered ring; $R_3$ represents a ballast group; and Z represents a hydrogen atom or an eliminable group by the coupling reaction with an aromatic primary amine color developing agent.

13. A processing method of a light-sensitive silver halide color photographic material according to claim 5, said silver halide color photographic material further contains at least one magenta couplers represented by the formula (XIII):

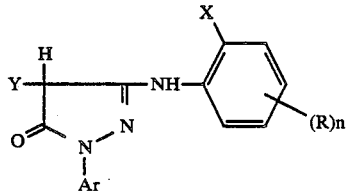

(XIII)

wherein Ar represents a phenyl group; Y represents an eliminable group by the coupling reaction with an oxidized product of a color developing agent; X represents a halogen atom, an alkoxy group or an alkyl group; R represents a group capable of substituting for a benzene ring; and n represents 1 or 2.

14. A processing method of a light-sensitive silver halide color photographic material according to claim 5, said silver halide color photographic material further contains at least one magenta couplers represented by the formula (XIV):

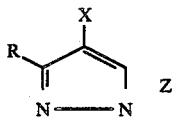

(XIV)

wherein Z represents a group of non-metallic atoms necessary for forming a nitrogen-containing heterocyclic ring and said ring formed by Z may have a substituent; X represents a hydrogen atom or a substituent eliminable through the reaction with the oxidized product of a color developing agent; and R represents a hydrogen atom or a substituent.

* * * * *